US008201903B2

(12) United States Patent
Hirano

(10) Patent No.: US 8,201,903 B2
(45) Date of Patent: Jun. 19, 2012

(54) INK SUPPLY AMOUNT ADJUSTMENT METHOD AND APPARATUS FOR PRINTING PRESS

(75) Inventor: Masahiro Hirano, Ibaraki (JP)

(73) Assignee: Komori Corporation, Tokyo (JP)

( * ) Notice: Subject to any disclaimer, the term of this patent is extended or adjusted under 35 U.S.C. 154(b) by 149 days.

(21) Appl. No.: 12/851,492

(22) Filed: Aug. 5, 2010

(65) Prior Publication Data

US 2011/0032289 A1 Feb. 10, 2011

(30) Foreign Application Priority Data

Aug. 10, 2009 (JP) ..... 2009-185631

(51) Int. Cl.
*B41J 2/195* (2006.01)

(52) U.S. Cl. ..... 347/7

(58) Field of Classification Search ..... 347/6, 7, 347/19, 84, 85; 101/365, 484
See application file for complete search history.

(56) References Cited

U.S. PATENT DOCUMENTS

| | | | | |
|---|---|---|---|---|
| 5,921,184 | A | 7/1999 | Sugiyama et al. | |
| 6,412,411 | B1 * | 7/2002 | Sugiyama et al. | 101/365 |
| 6,883,432 | B2 * | 4/2005 | Yamamoto et al. | 101/484 |
| 2007/0022888 | A1 | 2/2007 | Inde et al. | |

FOREIGN PATENT DOCUMENTS

| | | | |
|---|---|---|---|
| DE | 41 00 789 | A1 | 7/1992 |
| EP | 1 527 876 | A1 | 5/2005 |
| EP | 1 600 293 | A2 | 11/2005 |
| EP | 1 747 885 | A2 | 1/2007 |
| JP | S58-201008 | A | 11/1983 |
| JP | S58-201010 | A | 11/1983 |
| JP | 2001 047605 | A | 2/2001 |
| JP | 2003-118077 | A | 4/2003 |

* cited by examiner

*Primary Examiner* — An Do

(74) *Attorney, Agent, or Firm* — Blakely, Sokoloff, Taylor & Zafman

(57) ABSTRACT

An ink supply amount adjustment method for a printing press includes steps of measuring the density value of each density measurement patch printed in a range corresponding to each ink fountain key on a printed printing sheet, obtaining the opening ratio of each ink fountain key in preliminary ink feeding, based on the difference between the measured density value of a patch and a preset reference density value, and the current opening ratio of each ink fountain key or image data in the range corresponding to each ink fountain key, and performing the ink feed operation of an ink ductor roller while printing is suspended, after setting the opening ratio of each ink fountain key to the obtained opening ratio in preliminary ink feeding. An ink supply amount adjustment apparatus for a printing press is also disclosed.

12 Claims, 57 Drawing Sheets

INK SUPPLY AMOUNT ADJUSTMENT METHOD AND APPARATUS FOR PRINTING PRESS

BACKGROUND OF THE INVENTION

The present invention relates to an ink supply amount adjustment method and apparatus for a printing press, which adjust the amount of ink, to be supplied to a printing plate, by adjusting the ink fountain key opening ratio.

As shown in FIG. 12, an inking device (inker) in a printing unit of each color in a sheet-fed offset rotary printing press includes an ink fountain 2 which stores ink 1, an ink fountain roller 3, a plurality of ink fountain keys 4-1 to **4-*n* juxtaposed in the axial direction of the ink fountain roller 3, an ink ductor roller 5, and an ink roller group 6. Opening ratio of the ink fountain keys 4-1 to 4-*n* are adjustable. A printing plate 7 on which an image is printed is mounted on a plate cylinder 8**.

In an inking device with such an arrangement, the ink 1 in the ink fountain 2 is supplied to the ink fountain roller 3 from the gap between the ink fountain keys 4-1 to **4-*n* and the ink fountain roller 3. The ink 1 supplied to the ink fountain roller 3 is further supplied to the printing plate 7 through the ink roller group 6 by the ink feed operation of the ink ductor roller 5. The ink 1 supplied to the printing plate 7** is printed on a printing sheet through a blanket cylinder (not shown).

A printing product 9 printed by the printing press has a band-shaped color bar 9-2 printed in a margin other than an image region 9-1, as shown in FIG. 13. In case of general four-color printing, the color bar 9-2 has a plurality of regions S1 to Sn including density measurement patches (solid patches with a percent dot area of 100%) **9*a*1, 9*a*2, 9*a*3, and 9*a*4 of black, cyan, magenta, and yellow. The regions S1 to Sn correspond to the key zones of the ink fountain keys 4-1 to 4-*n*** in the printing unit of each color in the printing press.

[Color Matching]

A reference density value is preset for the printing unit of each color. That is, reference density values are individually set for respective colors, i.e., black, cyan, magenta, and yellow. In printing the printing product 9, a color matching operation in which the density value of each color is matched with the set reference density value takes place. The color matching operation is performed by an ink supply amount adjustment apparatus (not shown), before the start of final printing, based on the densities of the patches **9*a*1, 9*a*2, 9*a*3, and 9*a*4 of respective colors in the color bar 9-2 printed on the printing product 9**.

The region S1 on the printing product 9, for example, will be described as a representative. The density value of the density measurement patch **9*a* of each color on the printing product 9 (test printing sample) obtained by test printing or proof printing before the start of final printing is measured. The density difference between the measured density value and the preset reference density value is obtained for each color. The correction amount of the opening ratio of the ink fountain key 4-1 in the printing unit of each color (the correction amount of the amount of ink to be supplied to the region S1) is obtained based on the obtained density difference for the color. The opening ratio of the ink fountain key 4-1** in the printing unit of each color is adjusted using the obtained correction amount for feedback.

Similarly, the correction amounts of the opening ratios of the ink fountain keys 4-2 to **4-*n* in the printing unit of each color (the correction amounts of the amounts of ink to be supplied to the regions S2 to Sn, respectively) are obtained for the regions S2 to Sn, respectively. The opening ratios of the ink fountain keys 4-2 to 4-*n* in the printing unit of each color are adjusted using the obtained correction amounts for feedback. After the opening ratios of the ink fountain keys 4-1 to 4-*n*** are adjusted, test printing immediately restarts to repeat the same operation until the density value of each color reaches the reference density value (Japanese Patent Laid-Open No. 2003-118077: patent reference 1).

However, in the ink supply amount adjustment method disclosed in patent reference 1, the ink transfer path (the transfer path from the ink fountain roller to the blanket cylinder) in the inker is long. Therefore, to adjust the amount of ink to be supplied to a printing product, about 100 printing products must be printed from when the ink supply amount adjustment is complete until the ink supply amount adjustment result is reflected on an actual product so that the ink supply amount stabilizes at the corrected density. Therefore, this method requires much time and wastes printing materials.

In recent years, as disclosed in U.S. Pre-Grant Publication No. 2007/022888 (patent reference 2), the density value of the patch **9*a* of each color on the test printing sample 9 is measured to obtain the density difference between the measured density value and the reference density value of this color. The correction amounts of the opening ratios of the ink fountain keys 4-1 to 4-*n* in the printing unit of each color are obtained based on the obtained density difference for this color to correct the opening ratios of the ink fountain keys 4-1 to 4-*n***.

After the opening ratios of the ink fountain keys 4-1 to **4-*n* are corrected, the ink feed operation of the ink ductor roller 5 is performed while printing is suspended, to adjust the amount of ink in the inker, and printing is then performed. A process of performing the ink feed operation of the ink ductor roller 5 while printing is suspended, after the opening ratios of the ink fountain keys 4-1 to 4-*n*** are corrected, is called "preliminary ink feeding" in patent reference 2.

However, in the ink supply amount adjustment method disclosed in patent reference 2, preliminary ink feeding is performed upon correcting the opening ratios of the ink fountain keys 4-1 to **4-*n*. At this time, the correction amounts for use in preliminary ink feeding are obtained from only the density differences. Therefore, as for a portion with a low image area ratio (i.e., a portion with a low ink fountain key opening ratio) in a range corresponding to each of the ink fountain keys 4-1 to 4-*n***, if the density is so low that the ink supply amount is deficient, that portion is supplied with ink in an amount much larger than the required amount and has too a high density. Conversely, if the density is so high that the ink supply amount is excessive, that portion is supplied with ink in an amount much smaller than the required amount and has too low a density.

In contrast, as for a portion with a high image area ratio (i.e., a portion with a high ink fountain key opening ratio) in that range, if the density is so low that the ink supply amount is deficient, that portion is supplied with ink in an amount smaller than the required amount and remains to have a low density. Conversely, if the density is so high that the ink supply amount is excessive, that portion is supplied with ink in an amount larger than the required amount and remains to have a high density. This makes it impossible to print a normal printing product immediately after preliminary ink feeding. Therefore, a large number of printing products must be printed for adjustment until a normal product is obtained.

SUMMARY OF THE INVENTION

It is an object of the present invention to provide an ink supply amount adjustment method and apparatus for a printing press, which can print a normal printing product immediately after preliminary ink feeding.

In order to achieve the above object, according to the present invention, there is provided an ink supply amount adjustment method for a printing press including an ink fountain which stores ink, a plurality of ink fountain keys opening ratios of which are adjustable, an ink fountain roller supplied with the ink from the ink fountain through a gap between the ink fountain roller and the ink fountain keys, and an ink ductor roller which further supplies the ink, supplied to the ink fountain roller, to a printing plate by an ink feed operation, comprising the steps of measuring a density value of each density measurement patch printed in a range corresponding to each of the ink fountain keys on a printed printing sheet, obtaining an opening ratio of each of the ink fountain keys in preliminary ink feeding, based on a difference between a measured density value of a patch and a preset reference density value, and one of a current opening ratio of each of the ink fountain keys and image data in the range corresponding to each of the ink fountain keys, and performing an ink feed operation of the ink ductor roller while printing is suspended, after setting the opening ratio of each of the ink fountain keys to the obtained opening ratio in preliminary ink feeding.

DESCRIPTION OF THE PREFERRED EMBODIMENTS

First Embodiment

Figure 1:
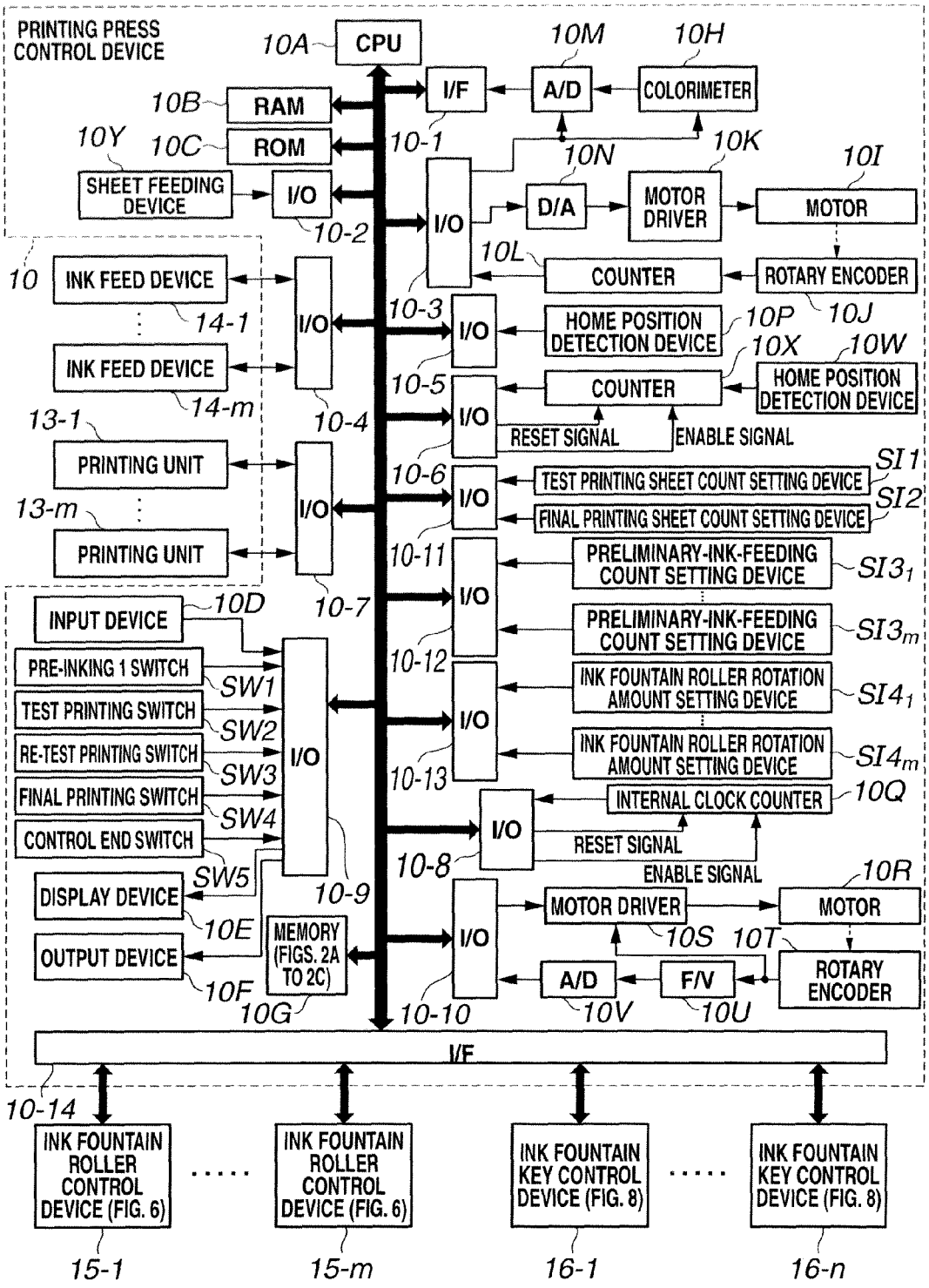
FIG. 1 is a block diagram showing the configuration of a printing press control device according to the first embodiment of the present invention.

An ink supply amount adjustment apparatus according to the first embodiment of the present invention will be described with reference to FIGS. 1 to 5Q. A printing press control device 10 according to this embodiment includes a CPU (Central Processing Unit) 10A, RAM (Random Access Memory) 10B, ROM (Read Only Memory) 10C, pre-inking 1 switch SW1, test printing switch SW2, re-test printing switch SW3, final printing switch SW4, control end switch SW5, input device 10D, display device 10E, output device 10F, and memory 10G, as shown in FIG. 1.

The printing press control device 10 also includes a colorimeter 10H, a motor 10I for moving the colorimeter 10H, a rotary encoder 10J for the motor 10I for moving the colorimeter 10H, a motor driver 10K for moving the colorimeter 10H, a counter 10L for measuring the current position of the colorimeter 10H, an A/D converter 10M, a D/A converter 10N, a colorimeter home position detection device 10P, and an internal clock counter 10Q.

The printing press control device 10 moreover includes a motor 10R of a printing press, a motor driver 10S of the printing press, a rotary encoder 10T for the motor 10R of the printing press, an F/V converter 10U, an A/D converter 10V, a home position detection device 10W of the printing press, a counter 10X for counting the rotational speed of the printing press, a sheet feeding device 10Y, a test printing sheet count setting device SI1, a final printing sheet count setting device SI2, preliminary-ink-feeding count setting devices $SI3_1$ to $SI3_m$, setting devices $SI4_1$ to $SI4_m$ for the ink fountain roller rotation amounts in preliminary ink feeding, and input/output interfaces (I/O, I/F) 10-1 to 10-14.

The CPU 10A receives various types of input information provided via the interfaces 10-1 to 10-14, and operates in accordance with a program stored in the ROM 10C, while accessing the RAM 10B and memory 10G.

The rotary encoder 10J generates a rotation pulse for each predetermined rotational speed (angle) of the motor 10I, and outputs it to the counter 10L. The rotary encoder 10T generates a rotation pulse for each predetermined rotational speed (angle) of the motor 10R, and outputs it to the F/V converter 10U and motor driver 10S.

Referring to FIG. 1, reference numerals 13-1 to **13-*m* denote a plurality of first to m-th printing units; 14-1 to 14-*m*, ink feed devices for the printing units 13-1 to 13-*m*, respectively; 15-1 to 15-*m*, ink fountain roller control devices for the printing units 13-1 to 13-*m*, respectively; and 16-1 to 16-*n*, ink fountain key control devices for the printing units 13-1 to 13-*m***, respectively.

Figure 12:
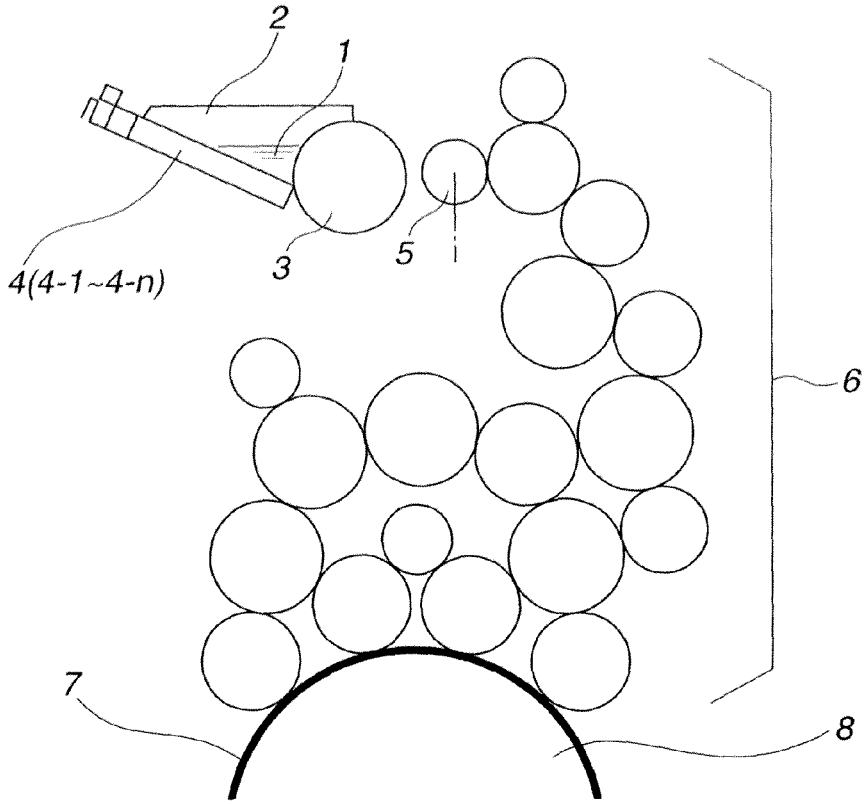
FIG. 12 is a view schematically showing the arrangement of rollers of an ink supply device in a printing unit of each color, which constitutes a sheet-fed offset rotary printing press.
Figure 13:
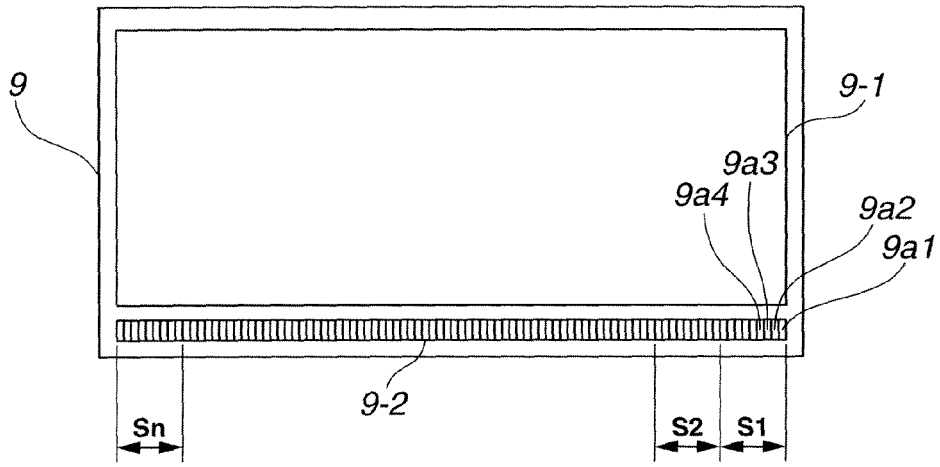
FIG. 13 is a plan view showing a printing product on which a color bar is printed.

The ink feed devices 14-1 to **14-*m* are provided in correspondence with ink ductor rollers 5 of the respective printing units shown in FIG. 12. The ink fountain roller control devices 15-1 to 15-*m* are provided in correspondence with ink fountain rollers 3 of the respective printing units shown in FIG. 12. The ink fountain key control devices 16-1 to 16-*n* are provided in correspondence with the ink fountain keys 4-1 to 4-*n*, respectively, of each printing unit shown in FIG. 12**.

Figure 2A:
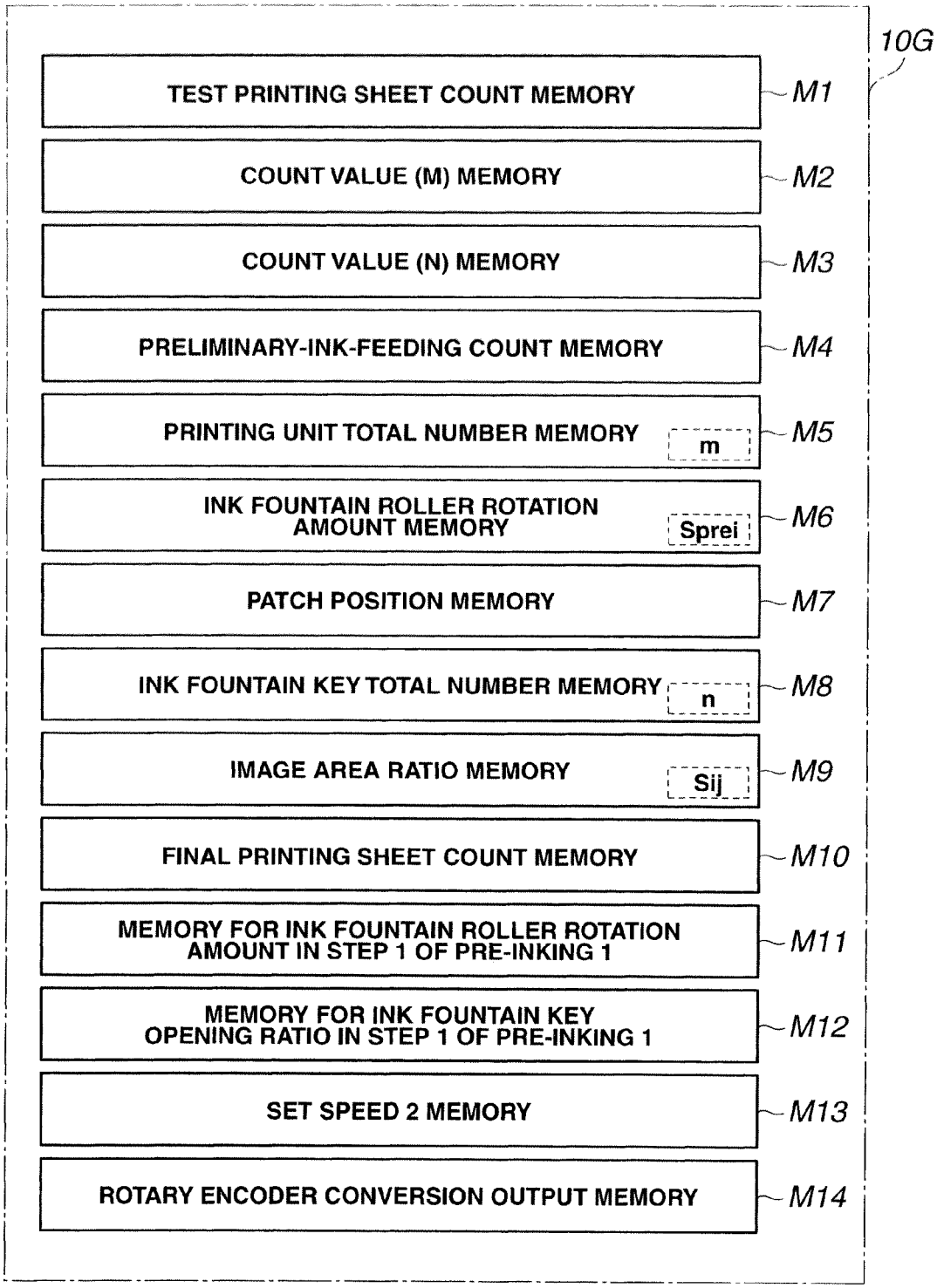
FIGS. 2A to 2C are views showing details of memories shown in FIG. 1.
Figure 2B:
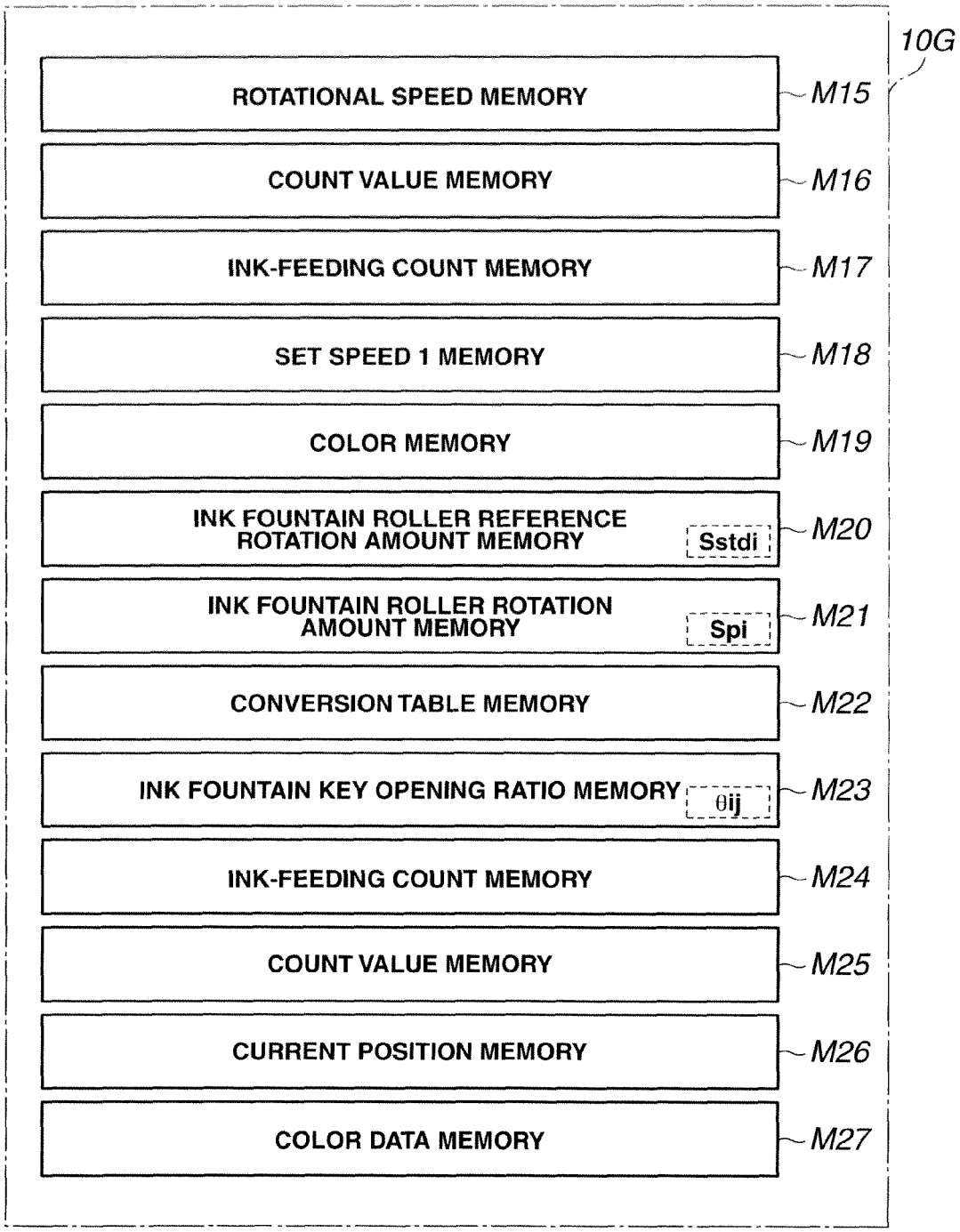
Figure 2C:
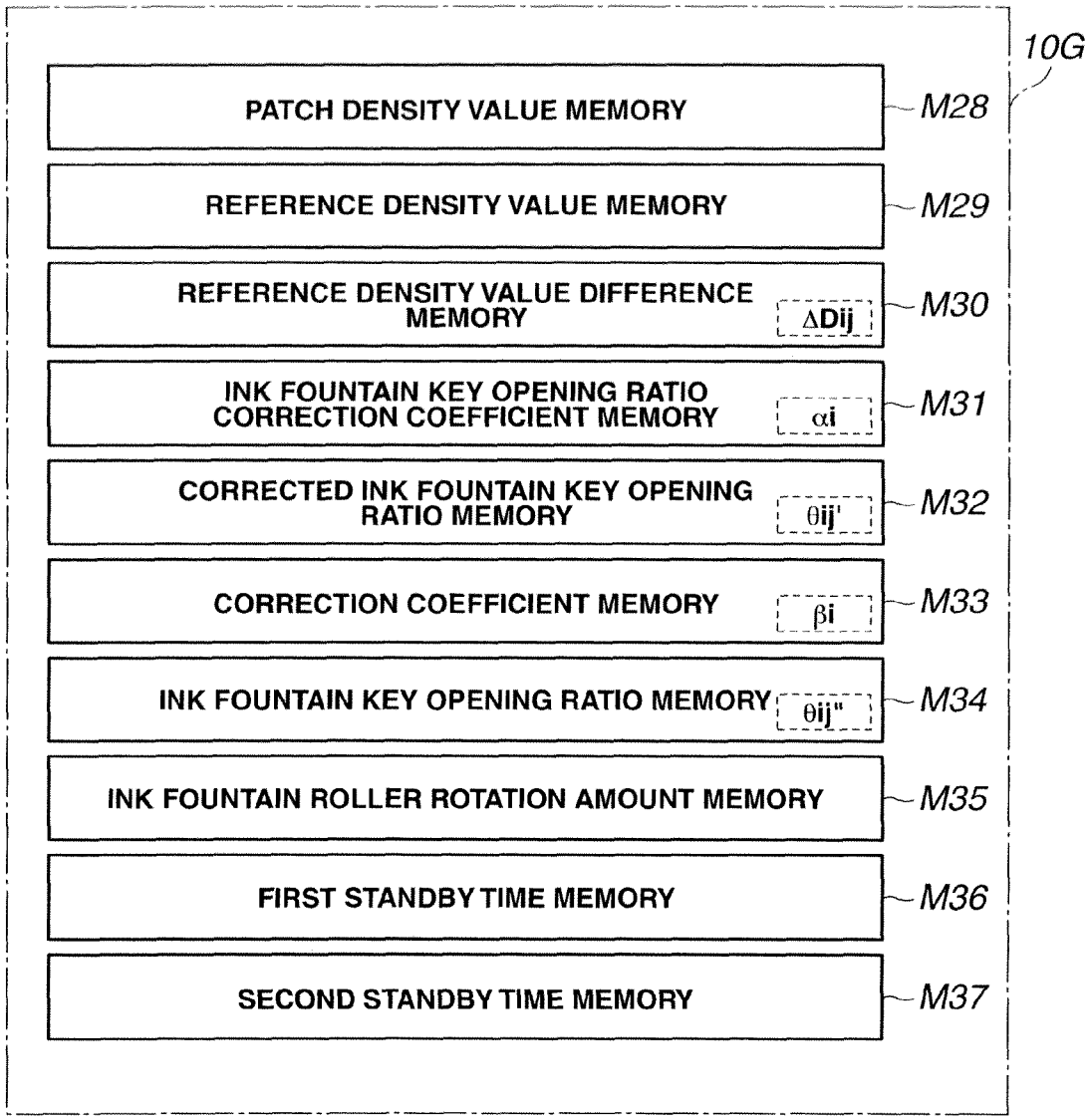

The memory 10G includes memories M1 to M37, as shown in FIGS. 2A to 2C. The test printing sheet count memory M1 stores the number of test printing sheets. The count value memory M2 stores a count value M (to be described later). The count value memory M3 stores a count value N (to be described later). The preliminary-ink-feeding count memory M4 stores the number of times of preliminary ink feeding (corresponding to the rotational speed of the printing press) of each of the printing units 13-1 to **13-*m*. The printing unit total number memory M5 stores the total number m of printing units of the printing press. The ink fountain roller rotation amount memory M6 stores a rotation amount Sprei (i=1 to m) of the ink fountain roller 3 of each of the printing units 13-1 to 13-*m*** in preliminary ink feeding.

The patch position memory M7 stores the position of each patch of each color in a color bar 9-2 on a test printing sample to be measured by the colorimeter. The ink fountain key total number memory M8 stores the total number n of ink fountain keys 4-1 to **4-*n* of each of the printing units 13-1 to 13-*m*. The image area ratio memory M9 stores an image area ratio (the image area ratio in a zone corresponding to each ink fountain key of each printing plate set in each printing unit) Sij (i=1 to m, j=1 to n) in a range corresponding to each ink fountain key of each of the printing units 13-1 to 13-*m*. The final printing sheet count memory M10** stores the number of final printing sheets.

The ink fountain roller rotation amount memory M11 stores the rotation amount of the ink fountain roller 3 in step 1 of pre-inking 1 (details of step 1 of pre-inking 1 will be described later). The ink fountain key opening ratio memory M12 stores the opening ratios of the ink fountain keys 4-1 to **4-*n* in step 1 of pre-inking 1. The set speed 2 memory M13 stores set speed 2 (high speed) of the printing press. The rotary encoder conversion output memory M14 stores the conversion output from the rotary encoder 10T via the F/V converter 10U and A/D converter 10V. The rotational speed memory M15 stores the current rotational speed of the printing press. The count value memory M16 stores the count value of the counter 10X for counting the rotational speed of the printing press. The ink-feeding count memory M17 stores the number of times of ink feeding (corresponding to the rotational speed of the printing press) in step 1 of pre-inking 1**.

The set speed 1 memory M18 stores set speed 1 (low speed) of the printing press. The color memory M19 stores the colors of the printing units 13-1 to **13-*m*. The ink fountain roller reference rotation amount memory M20 stores a reference rotation amount Sstdi (i=1 to m) of the ink fountain roller 3 for each color. The ink fountain roller rotation amount memory M21 stores a rotation amount Spi (i=1 to m) of the ink fountain roller 3 of each of the printing units 13-1 to 13-*m*. The conversion table memory M22 stores a conversion table of the image area ratio vs. ink fountain key opening ratio for each color, which represents the relationship between the image area ratio and the opening ratio of each of the ink feed devices 14-1 to 14-*m* for each color. The ink fountain key opening ratio memory M23 stores an opening ratio θij (i=1 to m, j=1 to n) of each of the ink fountain keys 4-1 to 4-*n* of each of the printing units 13-1 to 13-*m*. The ink-feeding count memory M24 stores the number of times of ink feeding (corresponding to the rotational speed of the printing press) in step 2 of pre-inking 1 (details of step 2** of pre-inking will be described later).

The count value memory M25 stores the count value of the counter 10L for measuring the current position of the colorimeter 10H. The current position memory M26 stores the current position of the colorimeter 10H. The color data memory M27 stores color data obtained by the colorimeter 10H. The patch density value memory M28 stores the density value of each patch of each color in the color bar 9-2 on the test printing sample. The reference density value memory M29 stores the reference density value of each color in the color bar 9-2.

The reference density value difference memory M30 stores a difference (measured density difference) ΔDij (i=1 to m, j=1 to n) between the density value of each patch of each color on the test printing sample and the reference density value of this color. The ink fountain key opening ratio correction coefficient memory M31 stores a correction coefficient αi (i=1 to m) of the opening ratio of each of the ink fountain keys 4-1 to **4-*n* of each color. The corrected ink fountain key opening ratio memory M32 stores a corrected opening ratio θij' (i=1 to m, j=1 to n) of each of the ink fountain keys 4-1 to 4-*n* of each of the printing units 13-1 to 13-*m*. The correction coefficient memory M33 stores a correction coefficient βi (i=1 to m) based on the rotation amount of the ink fountain roller 3 of each of the printing units 13-1 to 13-*m*. The memory M34 stores an opening ratio θij" (i=1 to m, j=1 to n) of each ink fountain key of each of the printing units 13-1 to 13-*m* in preliminary ink feeding. The ink fountain roller rotation amount memory M35 stores the rotation amount of the ink fountain roller 3 of each of the printing units 13-1 to 13-*m* before preliminary ink feeding. The first standby time memory M36 stores the count value for a first standby time. The second standby time memory M37** stores the count value for a second standby time.

Figure 3:
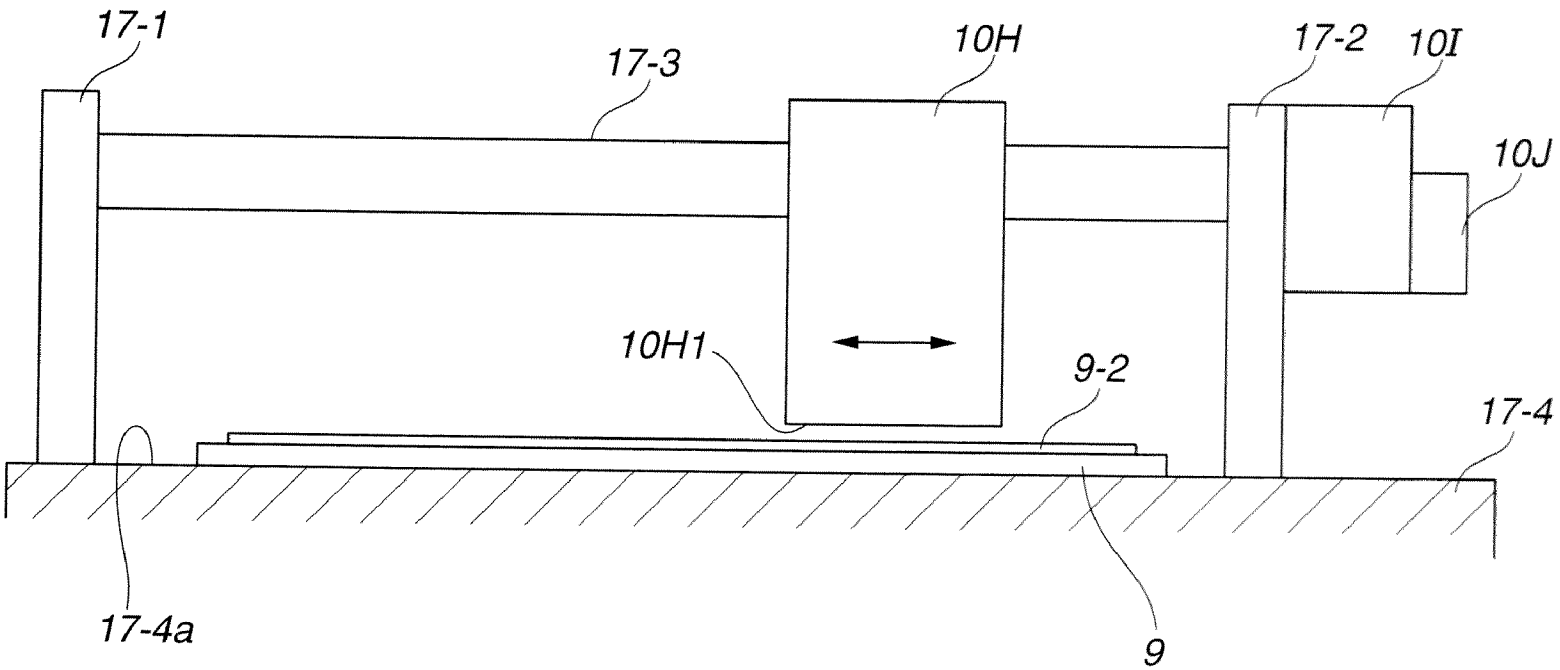
FIG. 3 is a view showing the installation state of a colorimeter.

The colorimeter 10H is fixed to a ball screw (feed screw) 17-3 disposed between columns 17-1 and 17-2, as shown in FIG. 3. The ball screw 17-3 is forwardly/reversely rotated by the motor 10I. Upon forwardly/reversely rotating the ball screw 17-3, the colorimeter 10H moves between the columns 17-1 and 17-2 while being guided by the ball screw 17-3. A head portion 10H1 of the colorimeter 10H faces a surface **17-4*a* of a measurement table 17-4**, on which a measurement object is placed.

Schematic Operation in First Embodiment

Before a description of a detailed operation in the first embodiment, its overview will be described for the sake of a better understanding thereof.

(1) Each data is input.

(2) The pre-inking 1 switch SW1 is turned on to perform operations in steps 1 and 2 of pre-inking. A minimum ink film thickness distribution required during printing is formed on the ink roller group 6 of the printing unit of each color. An ink film thickness distribution corresponding to an image on a printing plate of each color is superimposed on the minimum ink film thickness distribution required during printing.

(3) The test printing switch SW2 is turned on to perform test printing.

(4) A test printing sample is set on the measurement table 17-4, and the re-test printing switch SW3 is turned on. Thus, after preliminary ink feeding takes place, test printing takes place again (re-test printing takes place).

(5) Re-test printing in (4) is repeated until a satisfactory printing product is obtained.

(6) When a satisfactory printing product is obtained, the final printing switch SW4 is turned on to perform final printing.

Note that since steps 1 and 2 of pre-inking 1 are described in Japanese Patent Laid-Open No. 10-016193 (patent reference 3) proposed by the inventor of the present invention, the contents disclosed in patent reference 3 are incorporated in this specification.

Detailed Operation in First Embodiment

A detailed operation in the first embodiment will be described with reference to flowcharts shown in FIGS. 4A to 4Z and 5A to 5Q.

[Data Input]

Figure 4A:
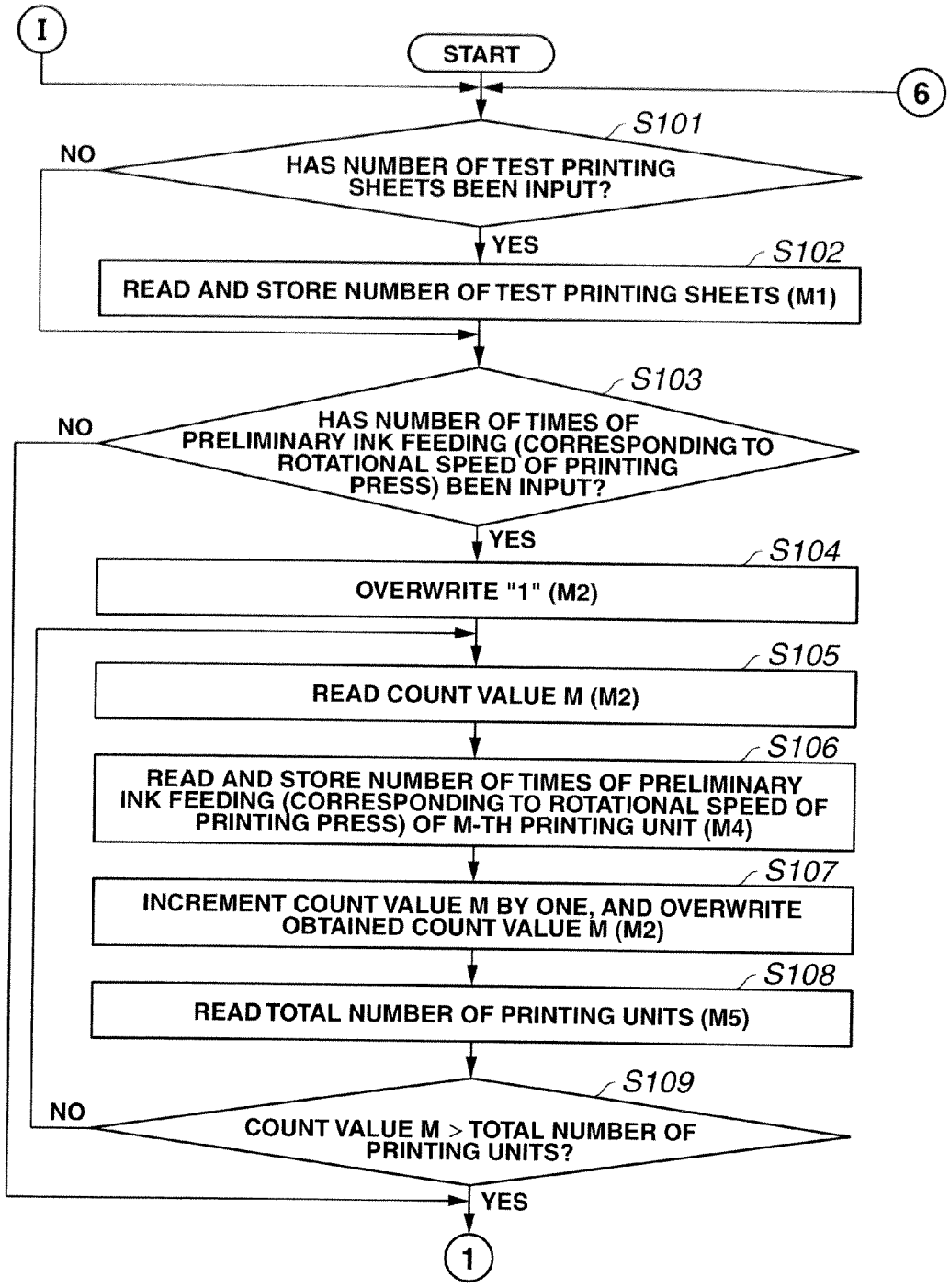
FIGS. 4A to 4Z are flowcharts showing the processing operation of a CPU 10A shown in FIG. 1.
Figure 4B:
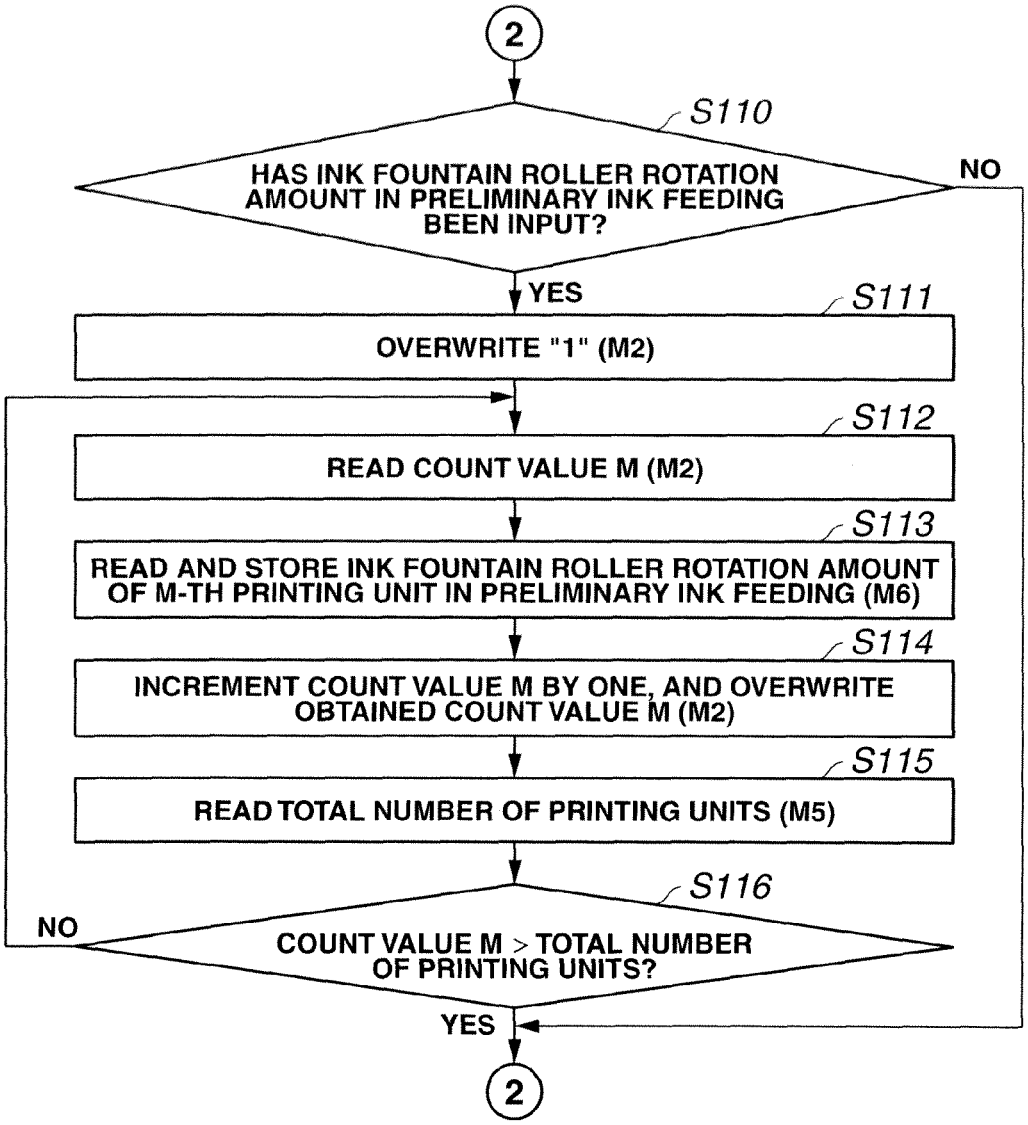
Figure 4C:
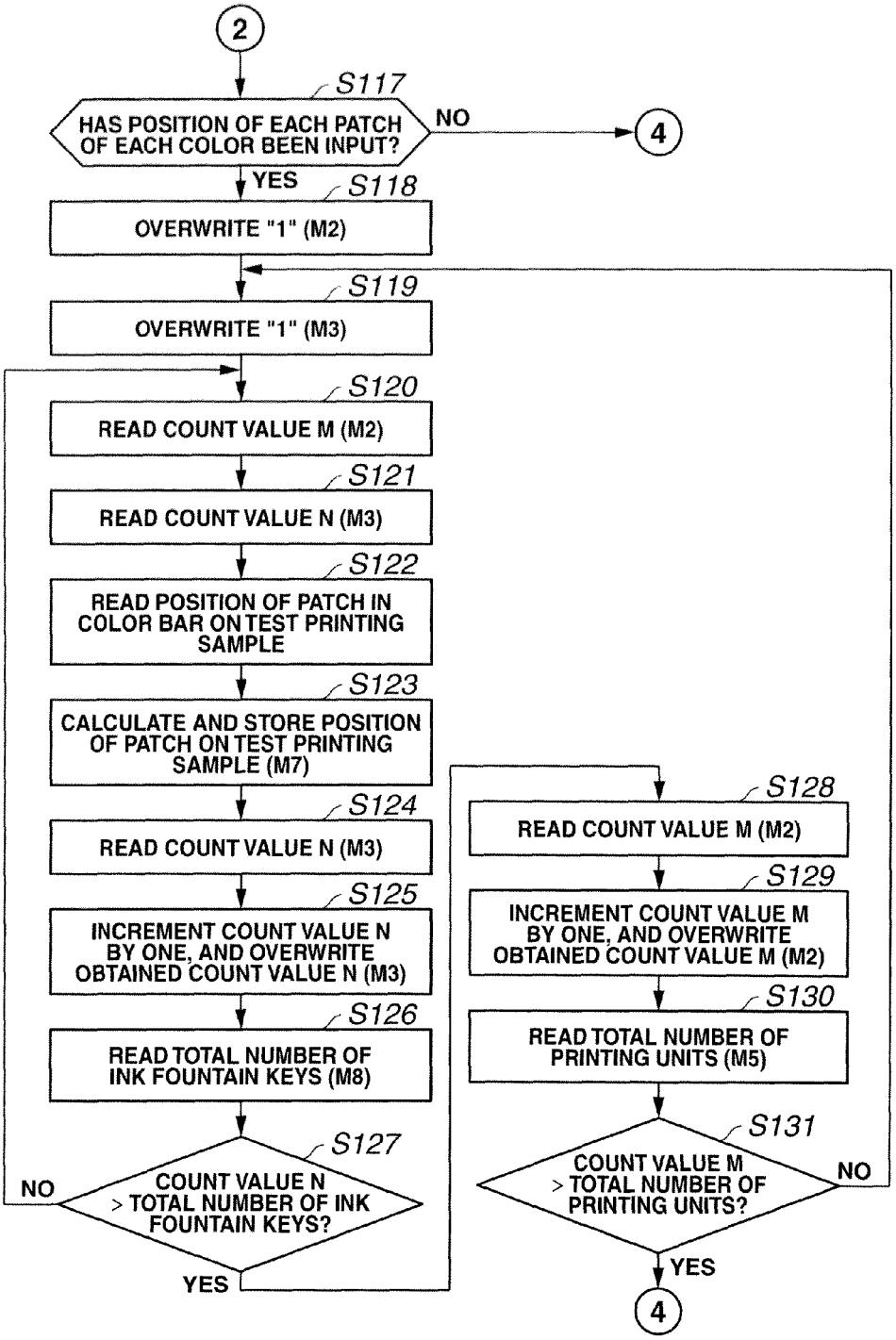
Figure 4D:
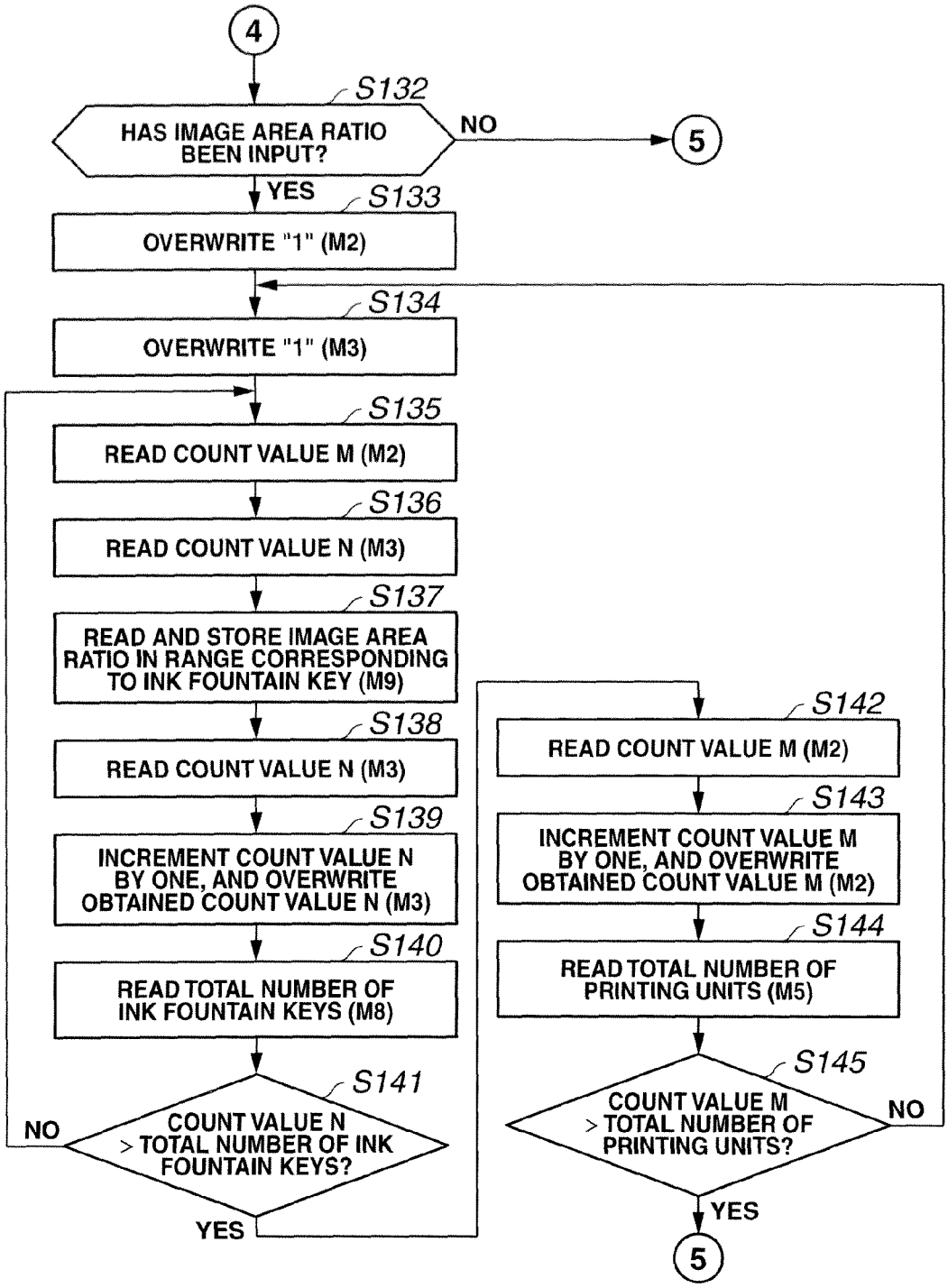

The operator inputs the number of test printing sheets prior to the start of printing (step S101). The operator also inputs the number of times of preliminary ink feeding of each printing unit, the ink fountain roller rotation amount of each printing unit in preliminary ink feeding, the position of each patch of each color in a color bar on a test printing sample, the image area ratio in a range corresponding to each ink fountain key of each printing unit, and the number of final printing sheets (FIG. 4A: step S103; FIG. 4B: step S110; FIG. 4C: step S117; FIG. 4D: step S132; and FIG. 4E: step S146).

In this case, the number of test printing sheets is input via the test printing sheet count setting device SI1. The number of times of preliminary ink feeding of each printing unit is input via each of the preliminary-ink-feeding count setting devices $SI3_1$ to $SI3_m$. The ink fountain roller rotation amount of each printing unit in preliminary ink feeding is input via each of the setting devices $SI4_1$ to $SI4_m$ for the ink fountain roller rotation amounts in preliminary ink feeding. The position of each patch of each color on the test printing sample is input via the input device 10D. The image area ratio in a range corresponding to each ink fountain key of each printing unit is input via the input device 10D. The number of final printing sheets is input via the final printing sheet count setting device SI2.

The CPU 10A stores, in the memory M1, the number of test printing sheets, which is input via the test printing sheet count setting device SI1 (step S102). The CPU 10A stores, in the memory M4, the number of times of preliminary ink feeding (corresponding to the rotational speed of the printing press) of each printing unit, which is input via each of the preliminary-ink-feeding count setting devices $SI3_1$ to $SI3_m$ (steps S104 to S109). The CPU 10A stores, in the memory M6, the ink fountain roller rotation amount of each printing unit in preliminary ink feeding, which is input via each of the setting devices $SI4_1$ to $SI4_m$ for the ink fountain roller rotation amounts in preliminary ink feeding (steps S111 to S116).

Step S103: As described above.

Step S104: "1" is overwritten (M2).

Step S105: The count value M is read (M2).

Step S106: The number of times of preliminary ink feeding (corresponding to the rotational speed of the printing press) of the M-th printing unit 13-*m* is read from the M-th preliminary-ink-feeding count setting device $SI3_m$, and stored at an address location for the M-th printing unit 13-*m* (M4).

Step S107: The count value M is incremented by one and overwritten (M2).

Step S108: The total number of printing units of the printing press is read (M5).

Step S109: It is determined whether the count value M is larger than the total number of printing units of the printing press.

Step S110: As described above.

Steps S111 and S112: The same processes as in steps S104 and S105, respectively, are performed.

Step S113: The ink fountain roller rotation amount of the M-th printing unit 13-*m* in preliminary ink feeding is read from the M-th setting device $SI4_m$ for the ink fountain roller rotation amount in preliminary ink feeding, and stored at an address location for the M-th printing unit 13-*m* (M6).

Steps S114 to S116: The same processes as in steps S107 to S109, respectively, are performed.

Also, the CPU 10A calculates, the position of each patch of each color in the color bar on the test printing sample to be measured by the colorimeter 10H, i.e., the position (measurement position) of each patch of each color for use in density measurement in the color bar, based on the position of this patch of this color in the color bar on the test printing sample, which is input via the input device 10D, and stores the calculated measurement position in the memory M7 (steps S118 to S131).

Step S117: As described above.

Step S118: "1" is overwritten (M2).

Step S119: "1" is overwritten (M3).

Step S120: The count value M is read (M2).

Step S121: The count value N is read (M3).

Step S122: The position of the patch in the color bar on the test printing sample is read from the input device.

Step S123: The position of the patch on the test printing sample is calculated by the colorimeter based on the input position of the patch in the color bar on the test printing sample, and stored at an address location for the N-th patch of the M-th color (M7).

Step S124: The count value N is read (M3).

Step S125: The count value N is incremented by one and overwritten (M3).

Step S126: The total number of ink fountain keys of each printing unit is read (M8).

Step S127: It is determined whether the count value N is larger than the total number of ink fountain keys of each printing unit.

Step S128: The count value M is read (M2).

Steps S129 to S131: The same processes as in steps S107 to S109, respectively, are performed.

Also, the CPU 10A stores, in the memory M9, an image area ratio Sij (i=1 to m, j=1 to n) in a range corresponding to each ink fountain key of each printing unit, which is input via the input device 10D (FIG. 9: steps S133 to S145).

Step S132: As described above.

Steps S133 to S136: The same processes as in steps S118 to S121, respectively, are performed (a description thereof will not be given, and the same applies to the following description).

Step S137: The image area ratio in a range corresponding to the ink fountain key is read from the input device 10D, and stored at an address location for the N-th ink fountain key of the M-th printing unit 13-*m* (M9).

Steps S138 to S141: The same processes as in steps S124 to S127, respectively, are performed.

Steps S142 to S145: The same processes as in steps S128 to S145, respectively, are performed.

Step S146 (FIG. 4E): As described above.

Figure 4E:
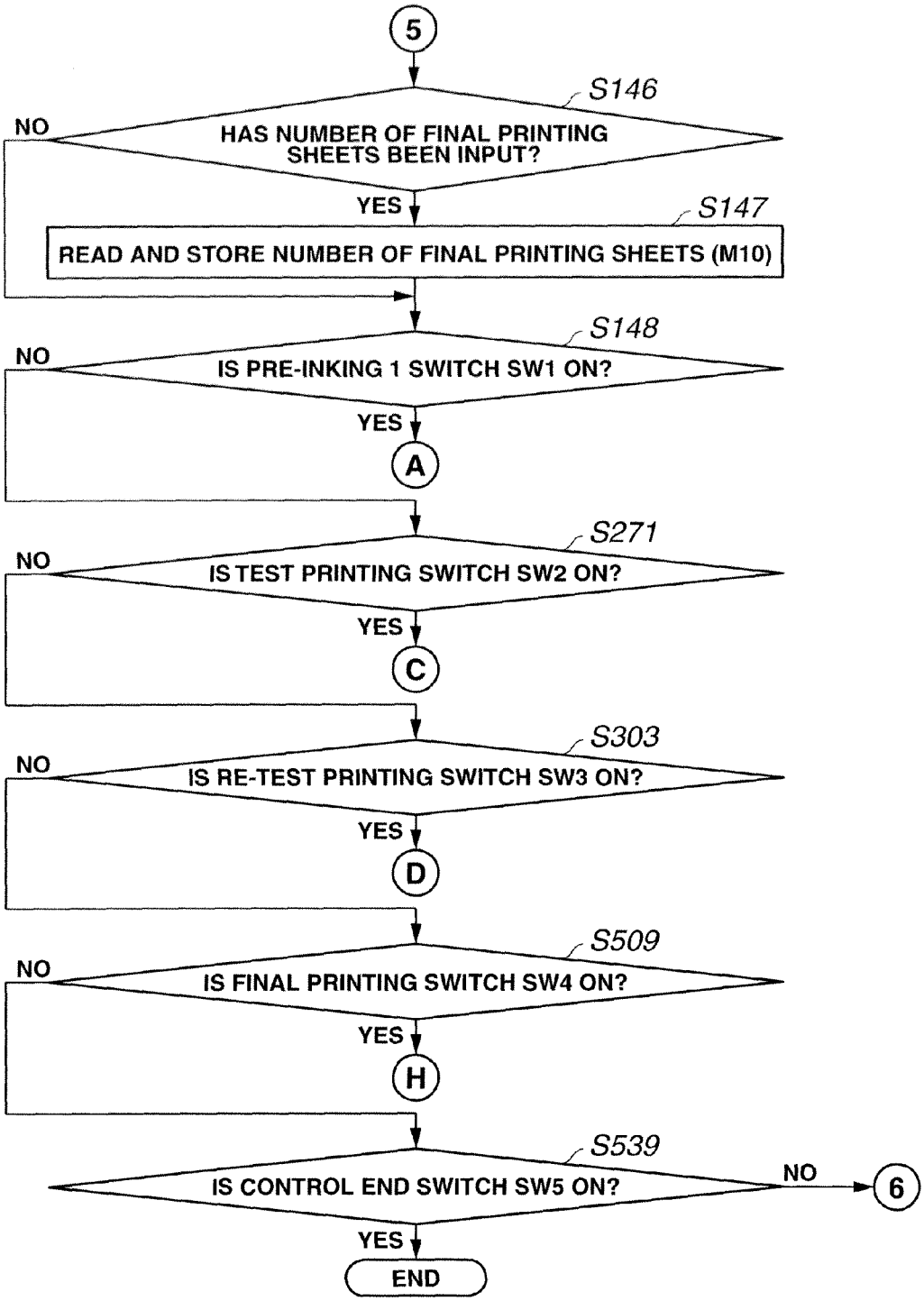
Figure 4F:
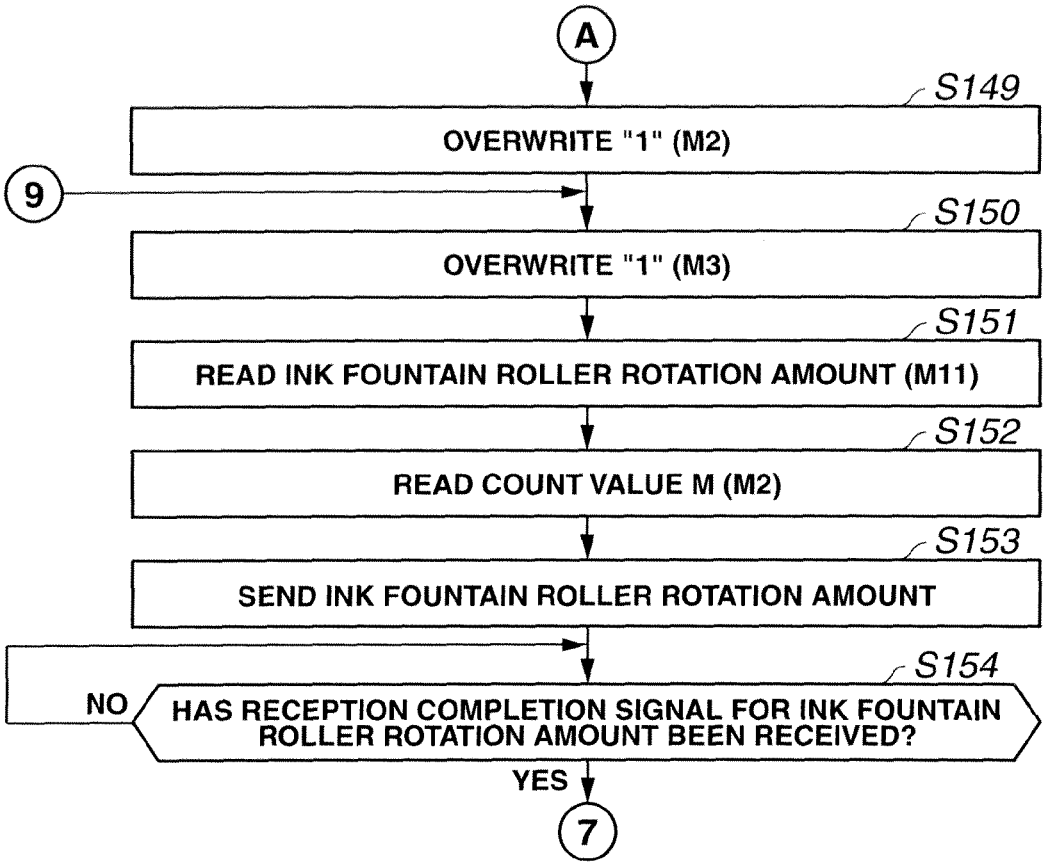
Figure 4G:
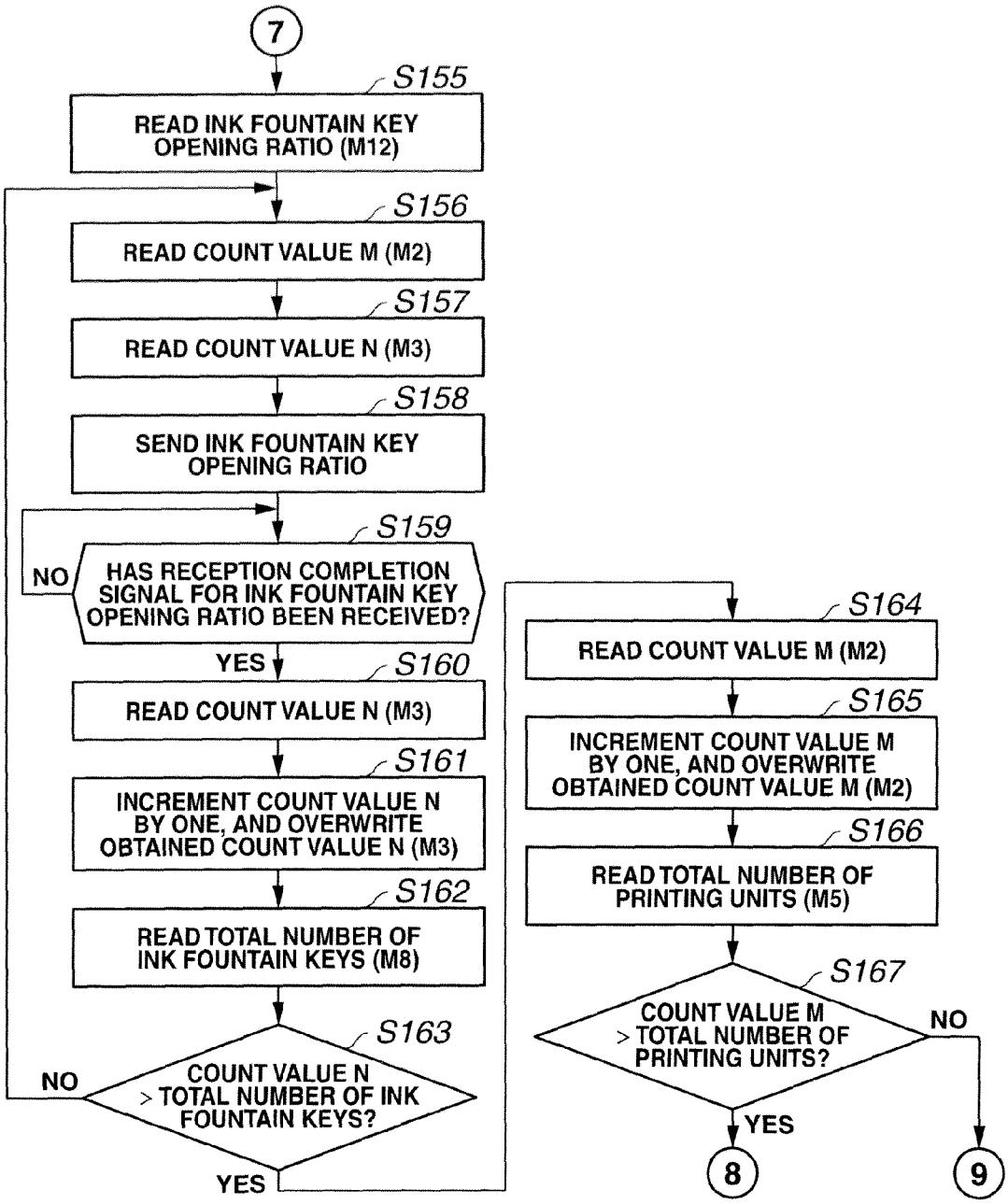
Figure 4H:
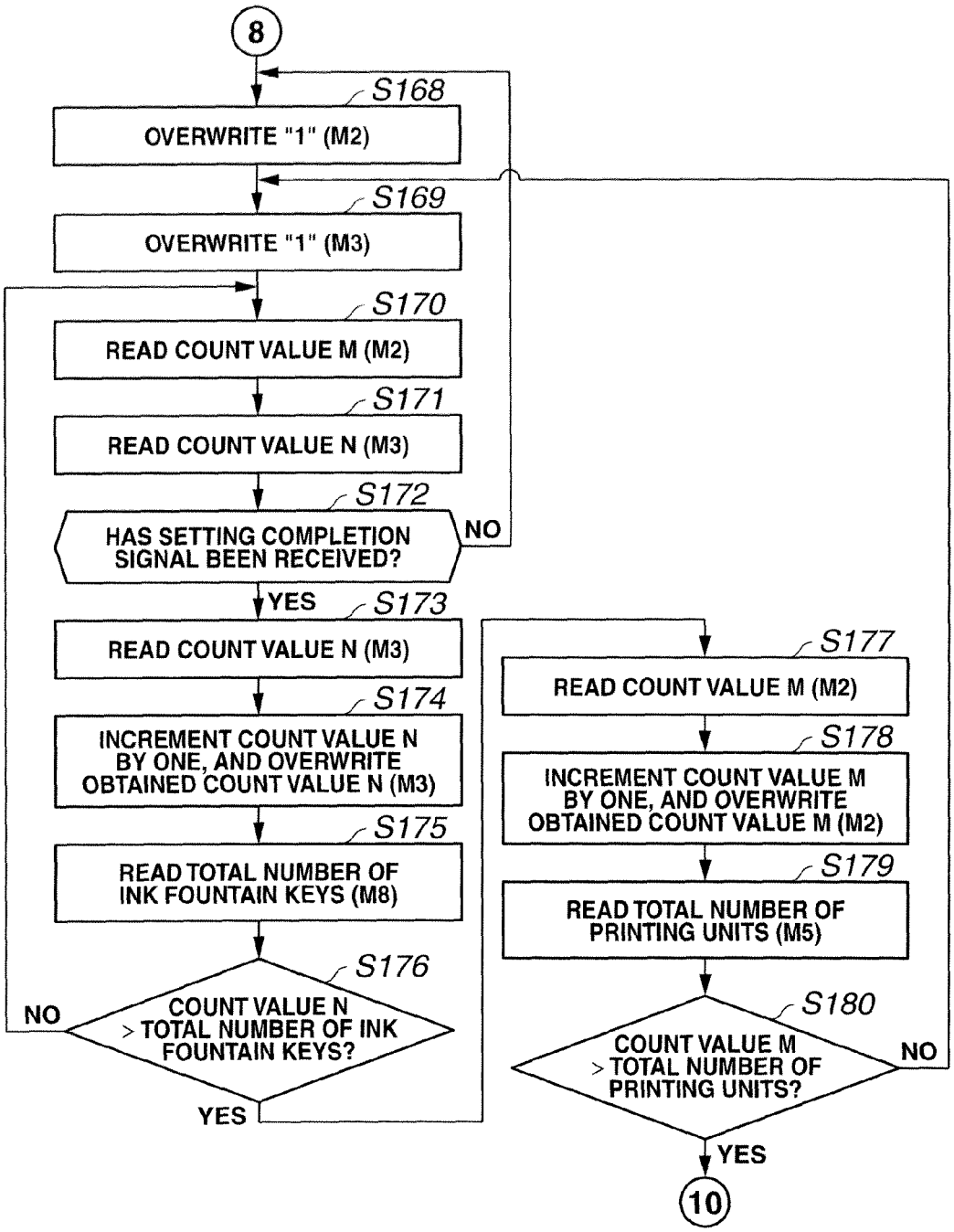
Figure 4I:
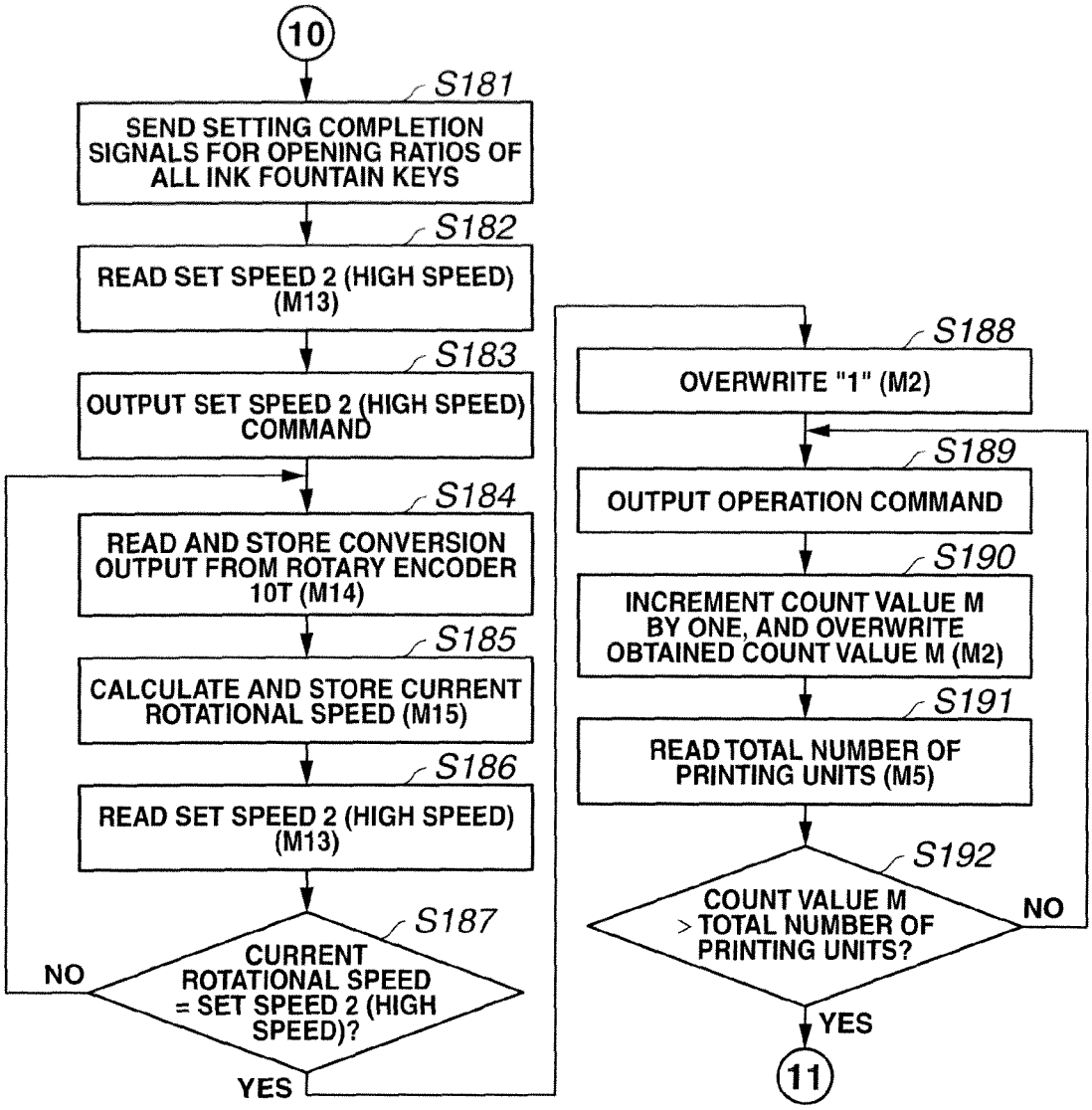
Figure 4J:
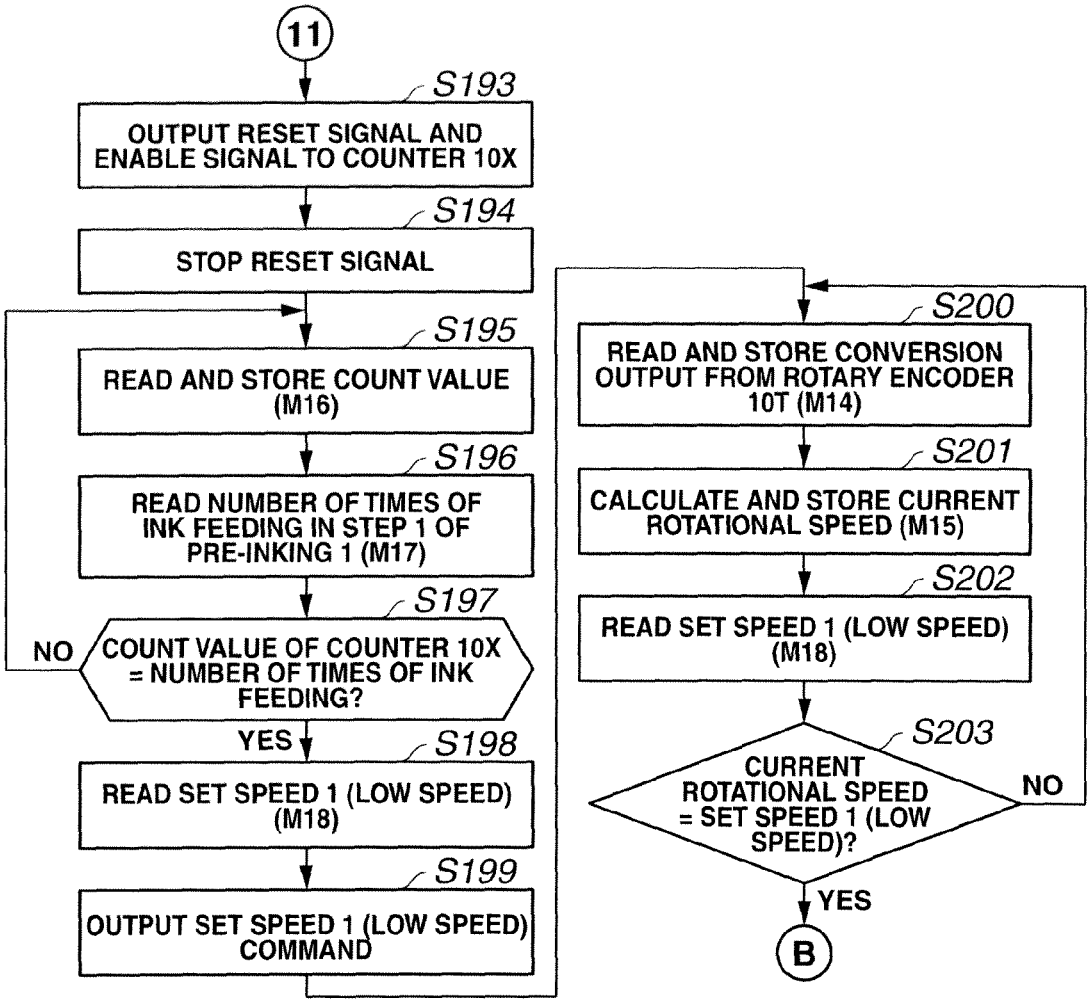
Figure 4K:
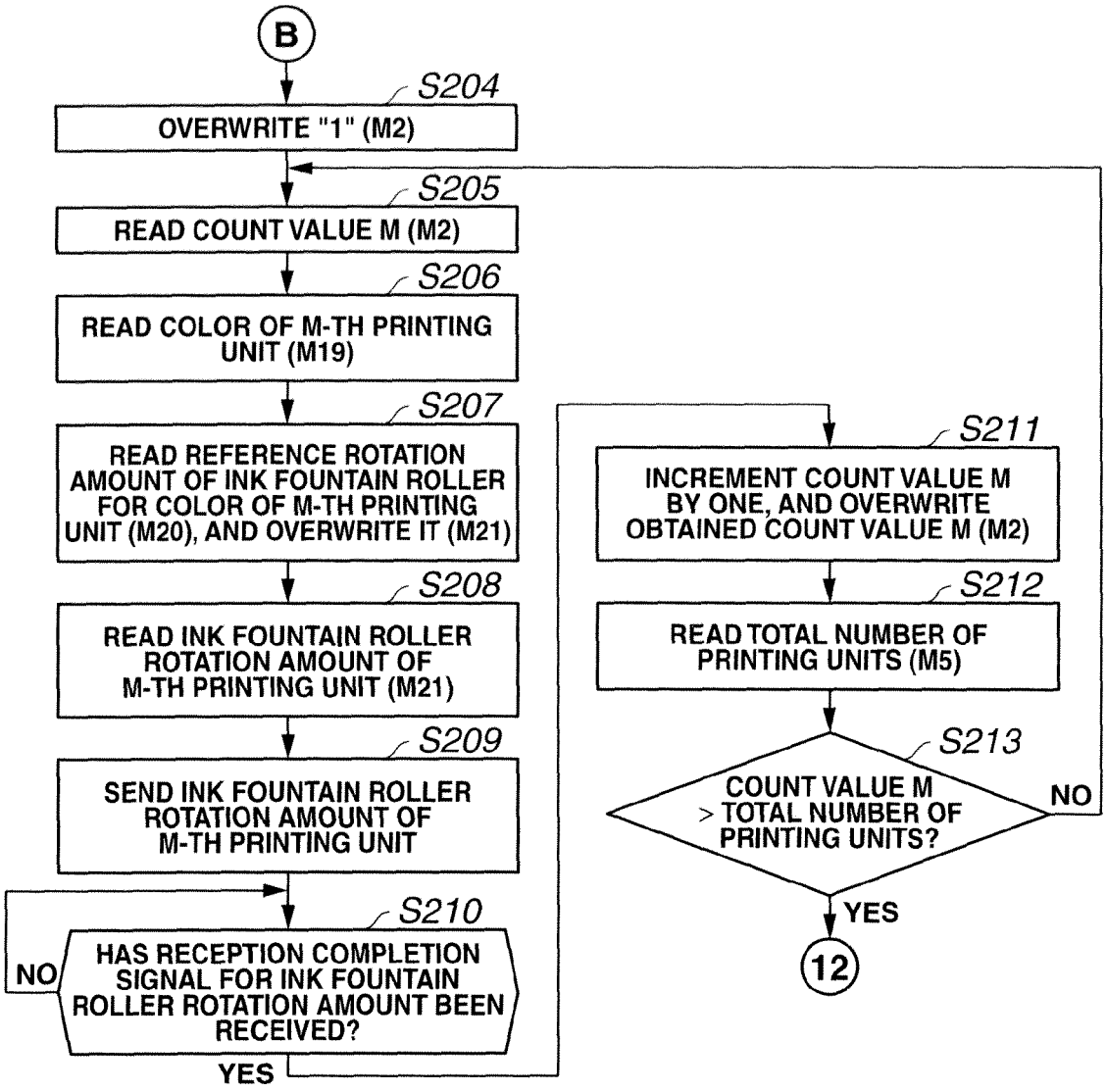
Figure 4L:
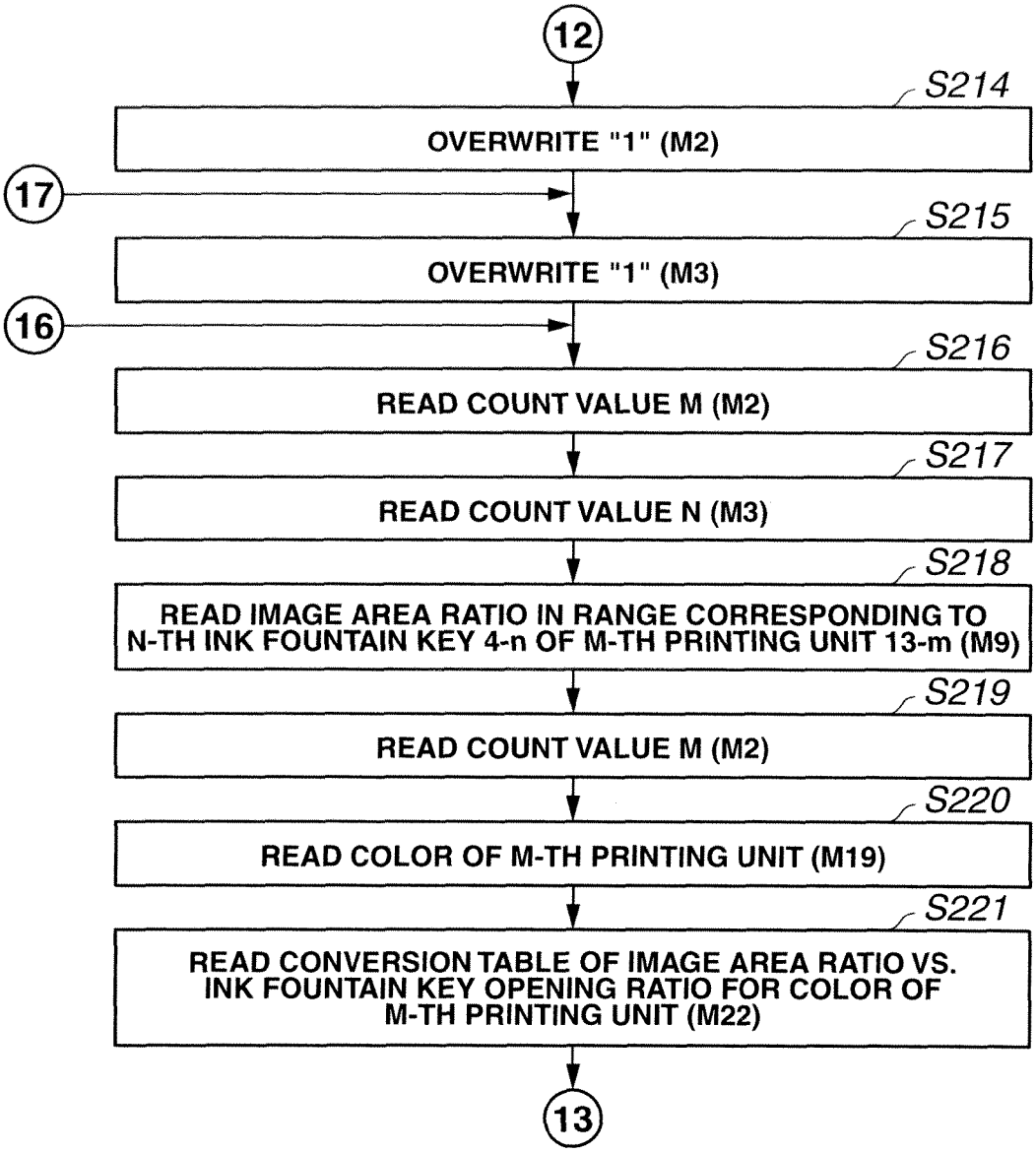
Figure 4M:
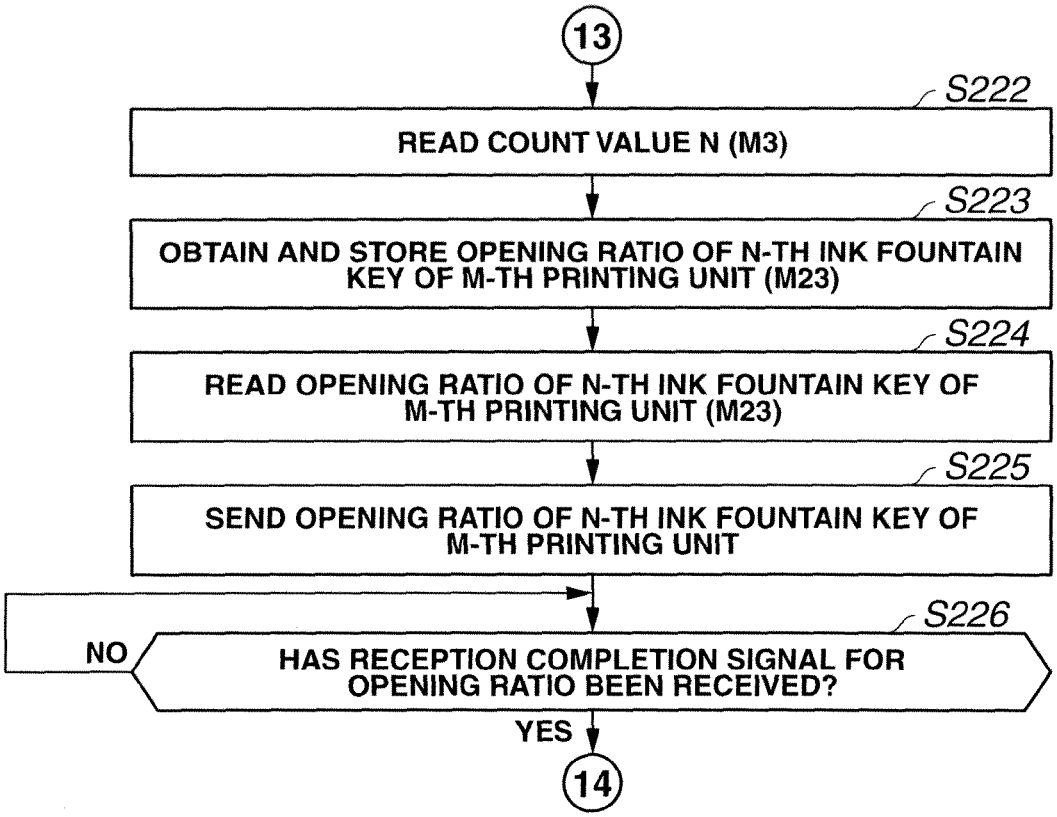
Figure 4N:
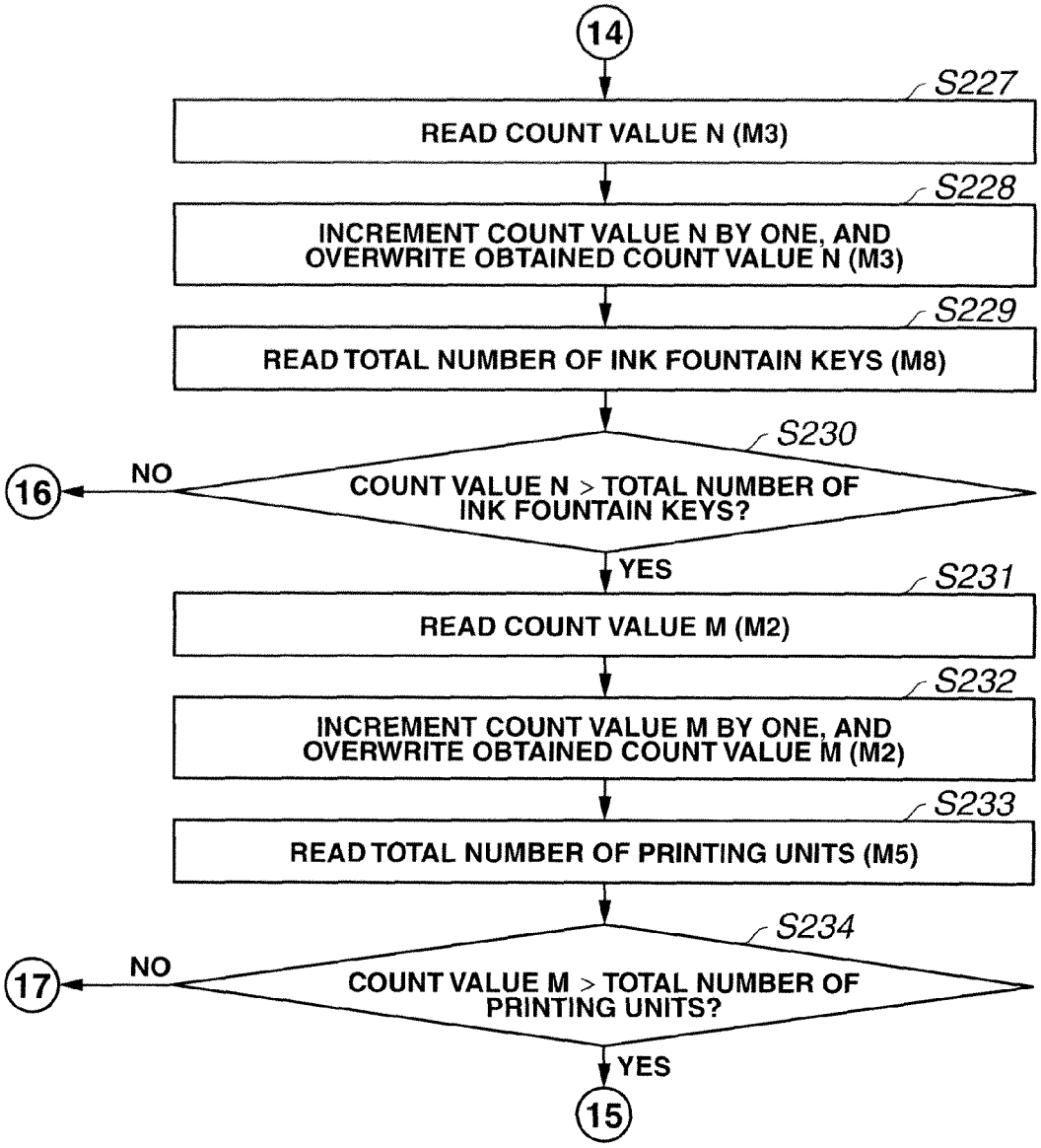
Figure 40:
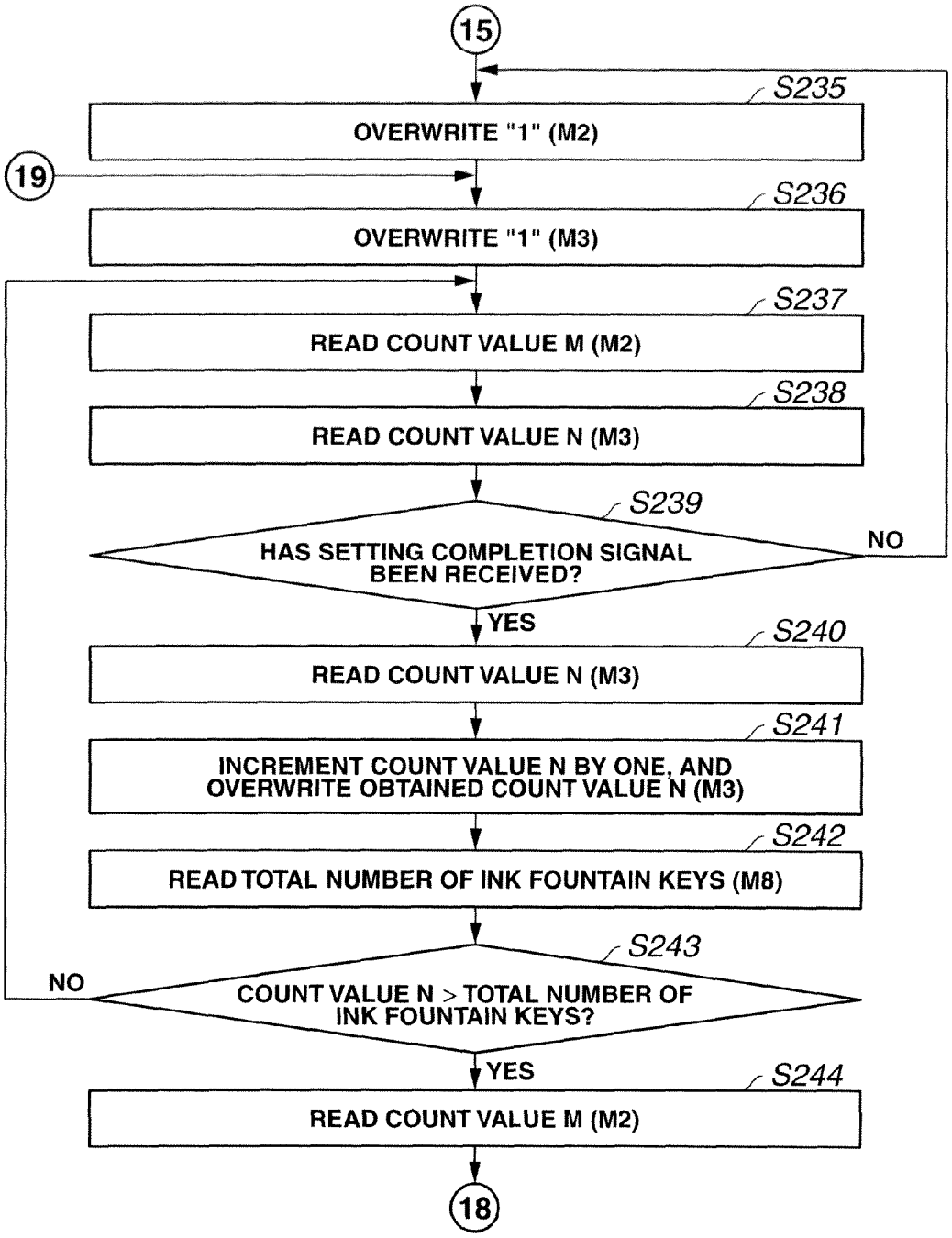
Figure 4P:
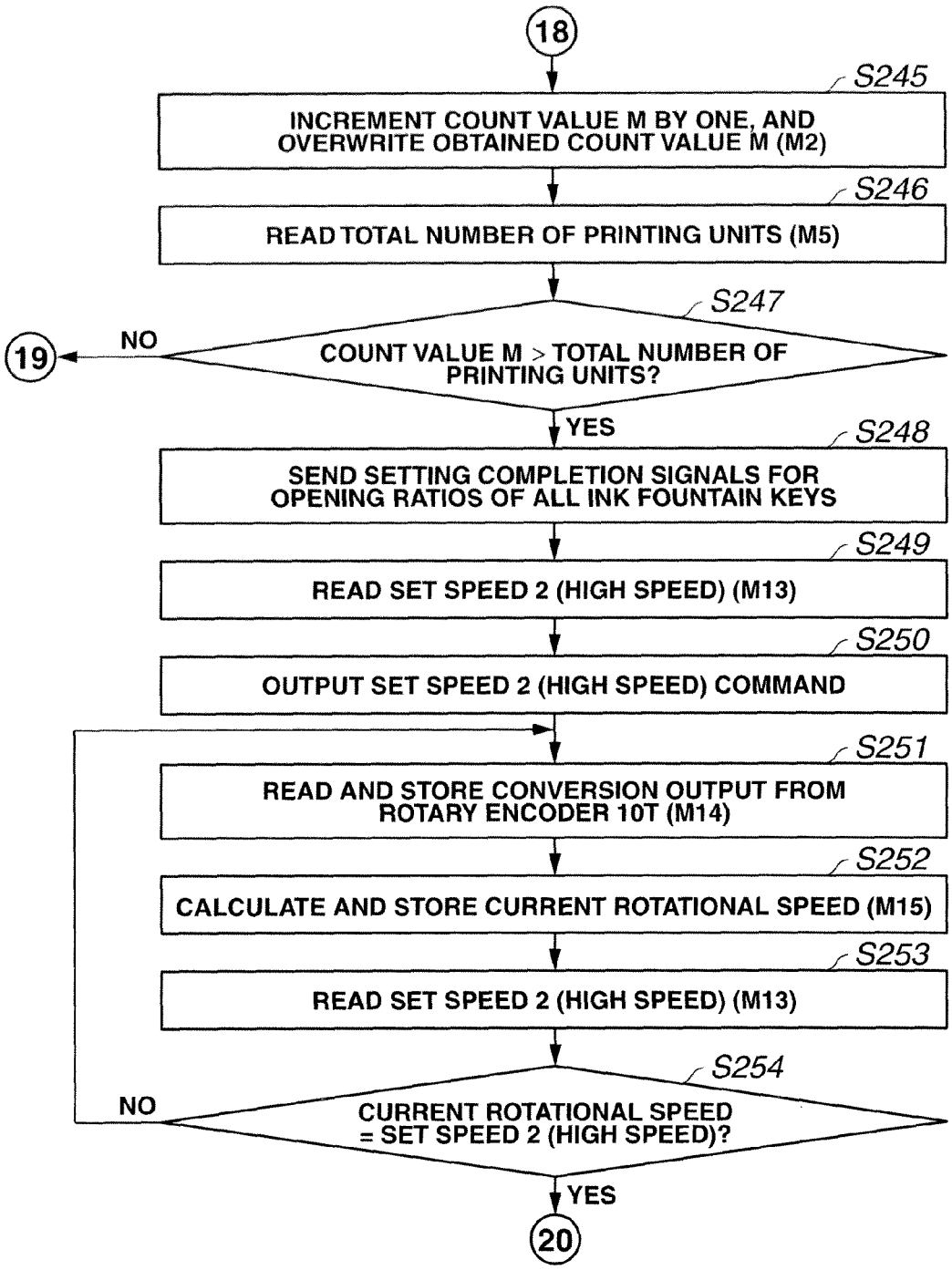
Figure 4Q:
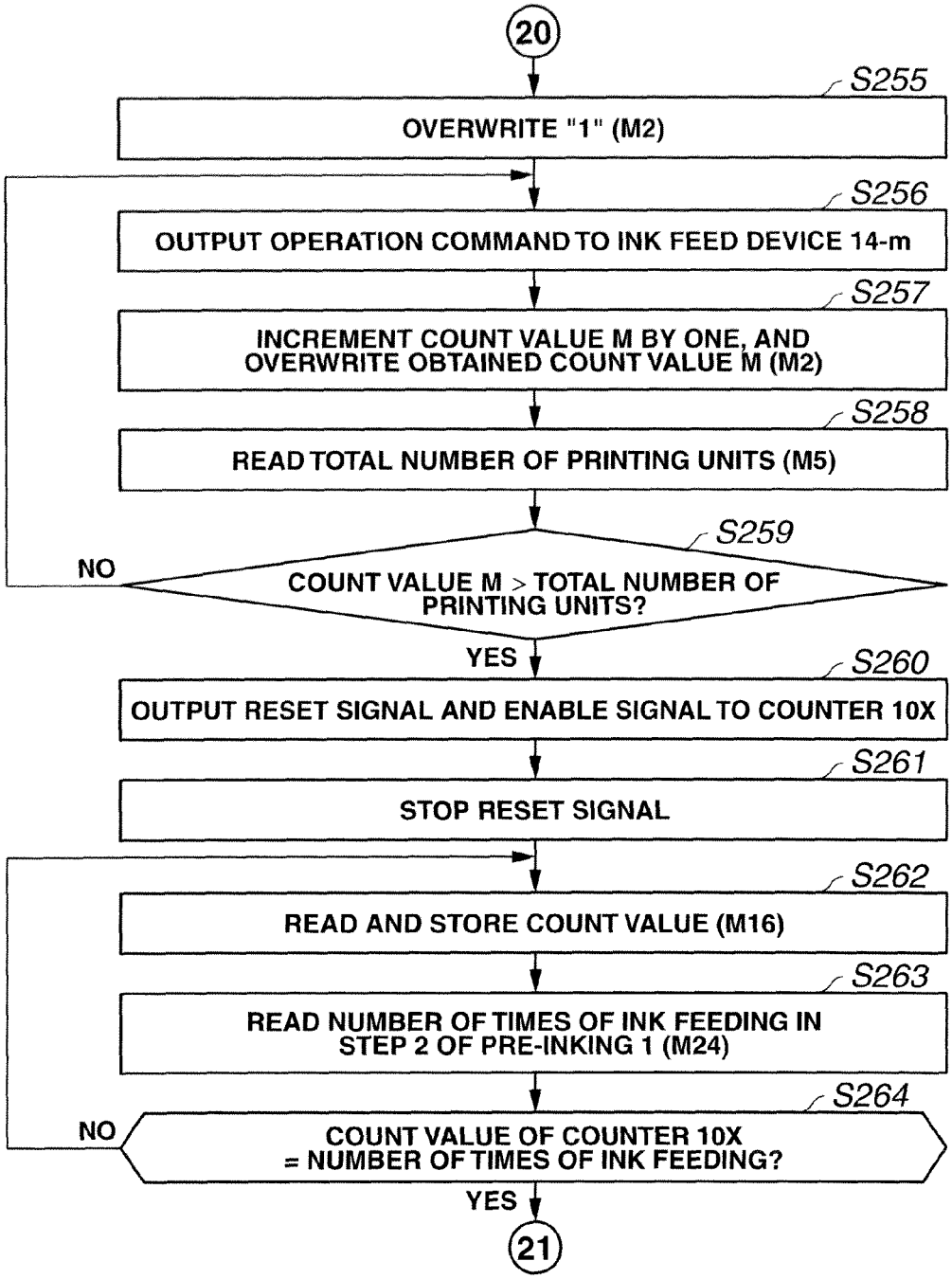
Figure 4R:
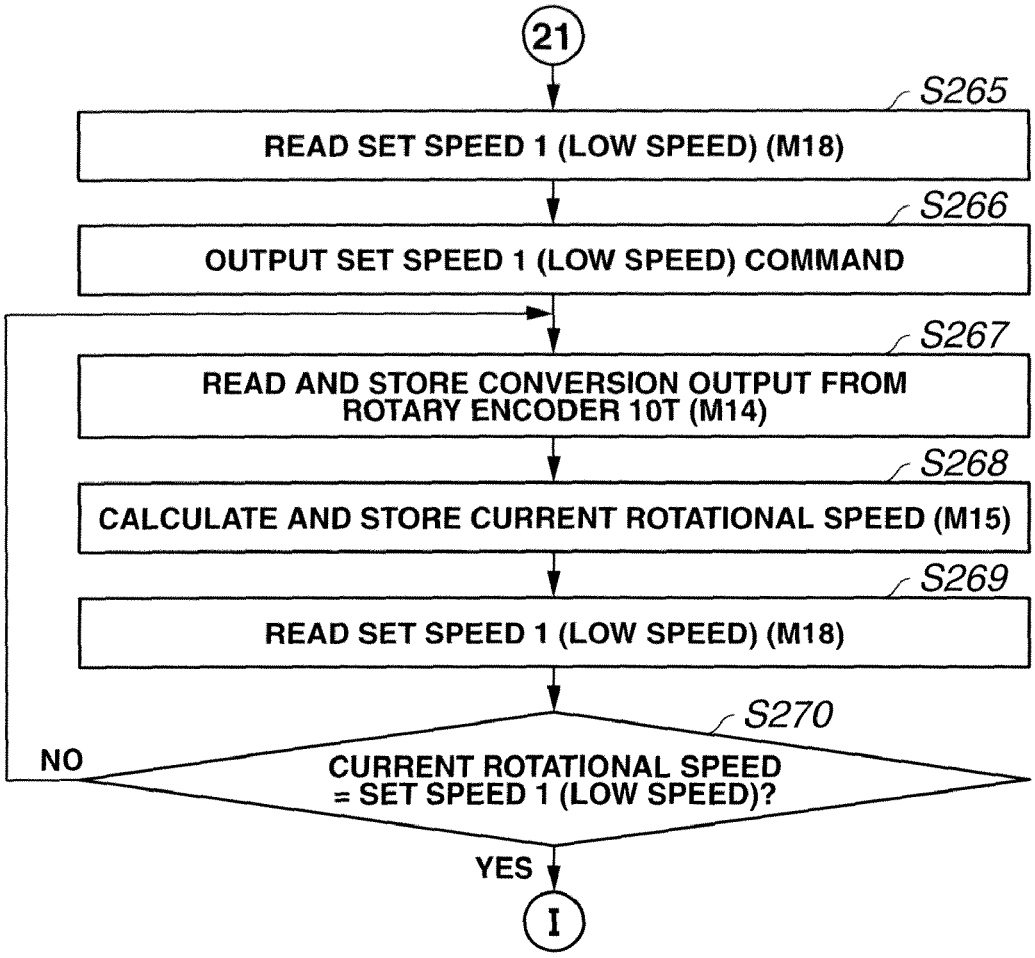

The CPU 10A stores, in the memory M10, the number of final printing sheets, which is input via the final printing sheet count setting device SI2 (FIG. 4E: step S147).

Note that in this embodiment, the image area ratio is measured for each zone on the printing plate of each color using an "image area ratio measuring device" as disclosed in Japanese Patent Laid-Open No. 58-201008 (patent reference 4) or 58-201010 (patent reference 5) proposed by the inventor of the present invention, and is written in a transportable memory. The image area ratio in a range corresponding to each ink fountain key of each printing unit is input by setting the transportable memory, in which the image area ratio is written, in the input device 10D.

Note also that the CPU 10A and the "image area ratio measuring device" may be connected online to each other so that the image area ratio in each zone on the printing plate of each color is directly obtained from the "image area ratio measuring device".

[Pre-Inking 1: Step 1]

The operator turns on the pre-inking 1 switch SW1. Upon turning on the pre-inking 1 switch SW1 (YES in step S148 of FIG. 4E), the CPU 10A starts a process in step 1 of pre-inking 1 first. FIGS. 4F to 4J show a process in step 1 of pre-inking 1.

In the process in step 1 of pre-inking 1, the CPU 10A reads out the ink fountain roller rotation amount in step 1 of pre-inking 1 from the memory M11, and sends it to the ink fountain roller control device 15 for each printing unit (steps S149 to S154). Also, the CPU 10A reads out the ink fountain key opening ratio in step 1 of pre-inking 1 from the memory M12, and sends it to each ink fountain key control device 16 for each printing unit (steps S155 to S167).

Steps S149 and S150: The same processes as in steps S118 and S119, respectively, are performed.

Step S151: The ink fountain roller rotation amount in step 1 of pre-inking is read (M11).

Step S152: The count value M is read (M2).

Step S153: The ink fountain roller rotation amount in step 1 of pre-inking 1 is sent to the ink fountain roller control device 15-*m* for the M-th printing unit 13-*m*.

Step S154: It is determined whether a reception completion signal for the ink fountain roller rotation amount has been received from the ink fountain roller control device 15-*m* for the M-th printing unit 13-*m*.

Step S155: The ink fountain key opening ratio in step 1 of pre-inking 1 is read (M12).

Steps S156 and S157: The same processes as in steps S120 and S121, respectively, are performed.

Step S158: The ink fountain key opening ratio in step 1 of pre-inking 1 is sent to the N-th ink fountain key control device 16-*n* for the M-th printing unit 13-*m*.

Step S159: It is determined whether a reception completion signal for the opening ratio of the N-th ink fountain key of the M-th printing unit 13-*m* has been received from the N-th ink fountain key control device 16-*n* for the M-th printing unit 13-*m*.

Steps S160 to S163: The same processes as in steps S124 to S127, respectively, are performed.

Steps S164 to S167: The same processes as in steps S128 to S131, respectively, are performed.

Thus, the opening ratio of each of the ink fountain keys 4-1 to 4-*n* is set as the opening ratio in step 1 of pre-inking 1 in each printing unit.

The CPU 10A confirms whether setting completion signals have been received from the ink fountain key control devices 16-1 to 16-*n* for each printing unit (steps S168 to S180). That is, the CPU 10A confirms whether each ink fountain key of each printing unit has been set at the ink fountain key opening ratio in step 1 of pre-inking 1. After YES is determined in the confirmation, the CPU 10A sends setting completion signals for the opening ratios of all the ink fountain keys 4-1 to 4-*n* to all the ink fountain key control devices 16 (step S181).

Steps S168 to S171: The same processes as in steps S168 to S121, respectively, are performed.

Step S172: It is determined whether a setting completion signal has been received from the N-th ink fountain key control device 16-*n* for the M-th printing unit 13-*m*.

Steps S173 to S180: The same processes as in steps S160 to S167, respectively, are performed.

The CPU 10A reads out set speed 2 of the printing press from the memory M13 (step S182), and sends it to the drive motor driver 10S of the printing press (step S183). The CPU 10A reads the voltage output from the F/V converter 10U (step S184), and calculates the current rotational speed of the printing press based on the voltage output from the F/V converter 10U (step S185). The CPU 10A reads out set speed 2 from the memory M13 (step S186), and compares read set speed 2 and the calculated rotational speed of the printing press (step S187). The rotational speed of the printing press is set to set speed 2 (high speed) by repeating operations in steps S184 to S187.

The CPU 10A issues an operation command to the ink feed device 14 of each printing unit (steps S188 to S192). The CPU 10A sends a reset signal and an enable signal to the counter 10X for counting the rotational speed of the printing press (step S193) to start the count operation of the counter 10X (step S194).

Step S188: "1" is overwritten (M2).

Step S189: An operation command is output to the ink feed device 14 of the M-th printing unit 13-*m*.

Steps S190 to S192: The same processes as in steps S165 to S167, respectively, are performed.

The CPU 10A compares the count value of the counter 10X and the number of times of ink feeding (corresponding to the rotational speed of the printing press) in step 1 of pre-inking 1, which is stored in the memory M17 (steps S195 to S197). If these two values coincide with each other, the CPU 10A determines that the ink feed device 14 of each printing unit has performed ink feeding in step 1 of pre-inking 1, and sets the rotational speed of the printing press to set speed 1 (low speed) (steps S193 to S203) to end the operation in step 1 of pre-inking 1.

Step S195: The count value is read from the counter 10X and stored (M16).

Step S196: The number of times of ink feeding (corresponding to the rotational speed of the printing press) in step 1 of pre-inking 1 is read (M17).

Step S197: It is determined whether the count value of the counter 10X is equal to the number of times of ink feeding in step 1 of pre-inking 1.

Step S198: Set speed 1 (low speed) of the printing press is read (M18).

Step S199: A command for set speed 1 (low speed) of the printing press is output to the drive motor driver 10S.

Step S200: The conversion output from the rotary encoder 10T is read and stored (M14).

Step S201: The current rotational speed of the printing press is calculated based on the conversion output from the rotary encoder 10T, and stored (M15).

Step S202: Set speed 1 (low speed) of the printing press is read (M18).

Step S203: It is determined whether the current rotational speed of printing press is equal to set speed 1 (low speed) of the printing press.

By the operation in step 1 of pre-inking 1, a minimum ink film thickness distribution required during printing is formed on the ink roller group 6 of each printing unit.

[Pre-inking 1: Step 2]

Next, the CPU 10A starts a process in step 2 of pre-inking 1. FIGS. 4K to 4R show a process in step 2 of pre-inking 1.

In the process in step 2 of pre-inking 1, the CPU 10A reads out the reference rotation amount Sstdi (i=1 to m) of the ink fountain roller for the color of each printing unit from the memory M20, and sends it to the ink fountain roller control device 15 for each printing unit (steps S204 to S213). At this time, the CPU 10A writes the reference rotation amount Sstdi (i=1 to m) of the ink fountain roller for the color of each printing unit, which is read out from the memory M20, in the memory M21 as the current rotation amount Spi (i=1 to m) of the ink fountain roller of each printing unit (step S207).

Steps S204 and S205: The same processes as in steps S104 and S105, respectively, are performed.

Step S206: The color of the M-th printing unit 13-*m* is read from a location for the M-th printing unit 13-*m* (M19).

Step S207: As described above.

Step S208: The ink fountain roller rotation amount of the M-th printing unit 13-*m* is read from an address location for the M-th printing unit 13-*m* (M21).

Step S209: The ink fountain roller rotation amount of the M-th printing unit 13-*m* is sent to the ink fountain roller control device 15-*m* for the M-th printing unit 13-*m*.

Step S210: It is determined whether a reception completion signal for the ink fountain roller rotation amount has been received from the ink fountain roller control device 15-*m* for the M-th printing unit 13-*m*.

Steps S211 to S213: The same processes as in steps S107 to S109, respectively, are performed.

The CPU 10A reads out the image area ratio Sij (i=1 to m, j=1 to n) in a range corresponding to each ink fountain key of each printing unit from the memory M9. The CPU 10A obtains the opening ratio θij (i=1 to m, j=1 to n) of each ink fountain key of each printing unit based on the image area ratio Sij (i=1 to m, j=1 to n) in a range corresponding to each ink fountain key of each printing unit, using the conversion table of the image area ratio vs. ink fountain key opening ratio for the color of each printing unit stored in the memory M22. The CPU 10A sets the obtained opening ratio θij in the memory M23 as the opening ratio of each ink fountain key of each printing unit in step 2 of pre-inking 1, and sends it to each ink fountain key control device 16 for each printing unit (steps S214 to S234).

Steps S214 to S217: The same processes as in steps S118 to S121, respectively, are performed.

Step S218: The image area ratio in a range corresponding to the N-th ink fountain key of the M-th printing unit 13-*m* is read from the address location for the N-th ink fountain key of the M-th printing unit 13-*m* (M9).

Steps S219 and S220: The same processes as in steps S205 and S206, respectively, are performed.

Step S221: A conversion table of the image area ratio vs. the ink fountain key opening ratio of the M-th printing unit is read from an address location for the color of the M-th printing unit 13-*m* (M22).

Step S222: The count value N is read (M3).

Step S223: The opening ratio of the N-th ink fountain key of the M-th printing unit 13-*m* is obtained based on the image area ratio in a range corresponding to the N-th ink fountain key of the M-th printing unit 13-*m* using the conversion table of the image area ratio vs. the ink fountain key opening ratio for the color of the M-th printing unit 13-*m*, and stored at an address location for the N-th ink fountain key of the M-th printing unit 13-*m* (M23).

Step S224: The opening ratio of the N-th ink fountain key is read from the address location for the N-th ink fountain key of the M-th printing unit 13-*m* (M23).

Step S225: The opening ratio of the N-th ink fountain key of the M-th printing unit 13-*m* is sent to the N-th ink fountain key control device 16-*n* for the M-th printing unit 13-*m*.

Step S226: It is determined whether a reception completion signal for the opening ratio of the N-th ink fountain key of the M-th printing unit 13-*m* has been received from the N-th ink fountain key control device 16-*n* for the M-th printing unit 13-*m*.

Steps S227 to S234: The same processes as in steps S160 to S167, respectively, are performed.

Thus, the opening ratio of each of the ink fountain keys 4-1 to 4-*n* is set as the opening ratio in step 2 of pre-inking 1 in each printing unit.

The CPU 10A confirms whether setting completion signals have been received from the ink fountain key control devices 16 for each printing unit (steps S235 to S247). That is, the CPU 10A confirms whether each ink fountain key of each printing unit has been set at the ink fountain key opening ratio in step 2 of pre-inking 1. After YES is determined in the confirmation, the CPU 10A sends setting completion signals for the opening ratios of all the ink fountain keys 4-1 to 4-*n* to all the ink fountain key control devices 16 (step S248).

Steps S235 to S247: The same processes as in steps S168 to S180, respectively, are performed.

The CPU 10A reads out set speed 2 of the printing press from the memory M13 (step S249), and sets the rotational speed of the printing press to set speed (high speed) (steps S250 to S254). The CPU 10A issues an operation command to the ink feed device 14 of each printing unit (steps S255 to S259), and sends a reset signal and an enable signal to the counter 10X for counting the rotational speed of the printing press (step S260). Thus, the counter 10X starts its count operation (step S261).

Steps S250 to S259: The same processes as in steps S183 to S192, respectively, are performed.

The CPU 10A compares the count value of the counter 10X and the number of times of ink feeding (corresponding to the rotational speed of the printing press) in step 2 of pre-inking 1, which is stored in the memory M24 (steps S262 to S264). If these two values coincide with each other, the CPU 10A determines that the ink feed device 14 of each printing unit has performed ink feeding in step 2 of pre-inking 1, and sets the rotational speed of the printing press to set speed 1 (low speed) (steps S256 to S270) to end the operation in step 2 of pre-inking 1.

Step S262: The count value is read from the counter 10X and stored (M16).

Step S263: The number of times of ink feeding (corresponding to the rotational speed of the printing press) in step 2 of pre-inking 1 is read (M24).

Step S264: It is determined whether the count value of the counter 10X is equal to the number of times of ink feeding in step 2 of pre-inking 1.

Steps S265 to S270: The same processes as in steps S198 to S203, respectively, are performed.

By the operation in step 2 of pre-inking 1, an ink film thickness distribution corresponding to an image on a printing plate of each color is superimposed on the minimum ink film thickness distribution required during printing, which is formed on the ink roller group 6 of each printing unit.

[Test Printing]

Figure 4S:
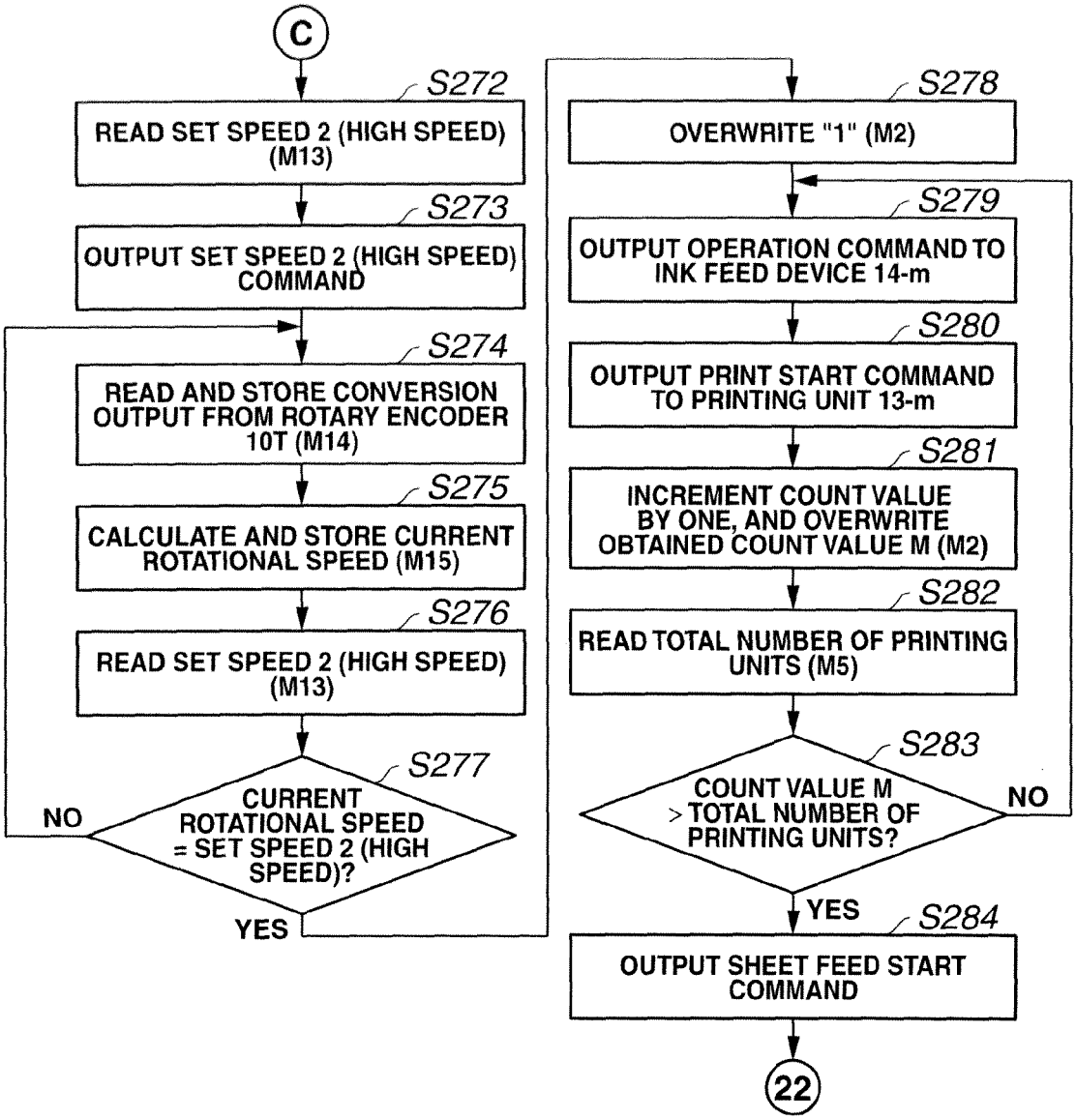
Figure 4T:
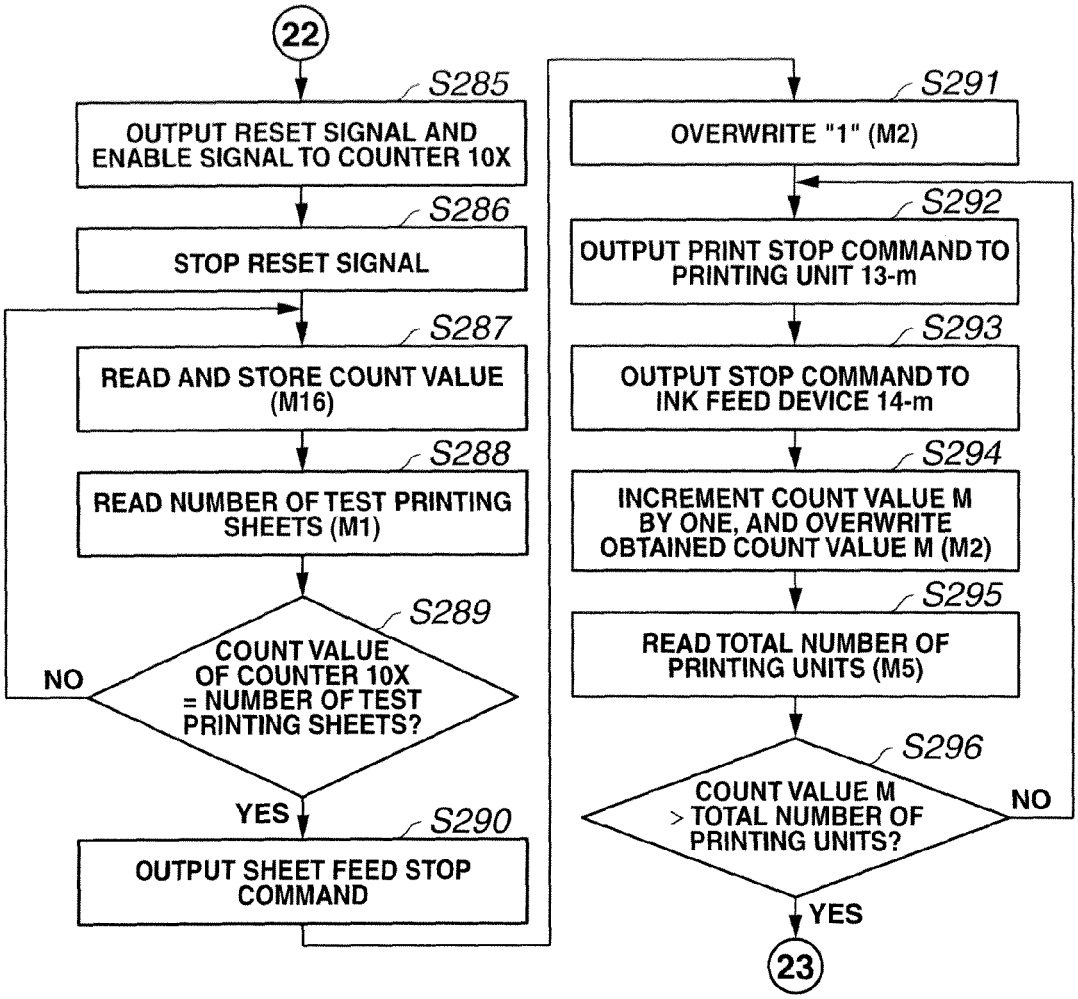
Figure 4U:
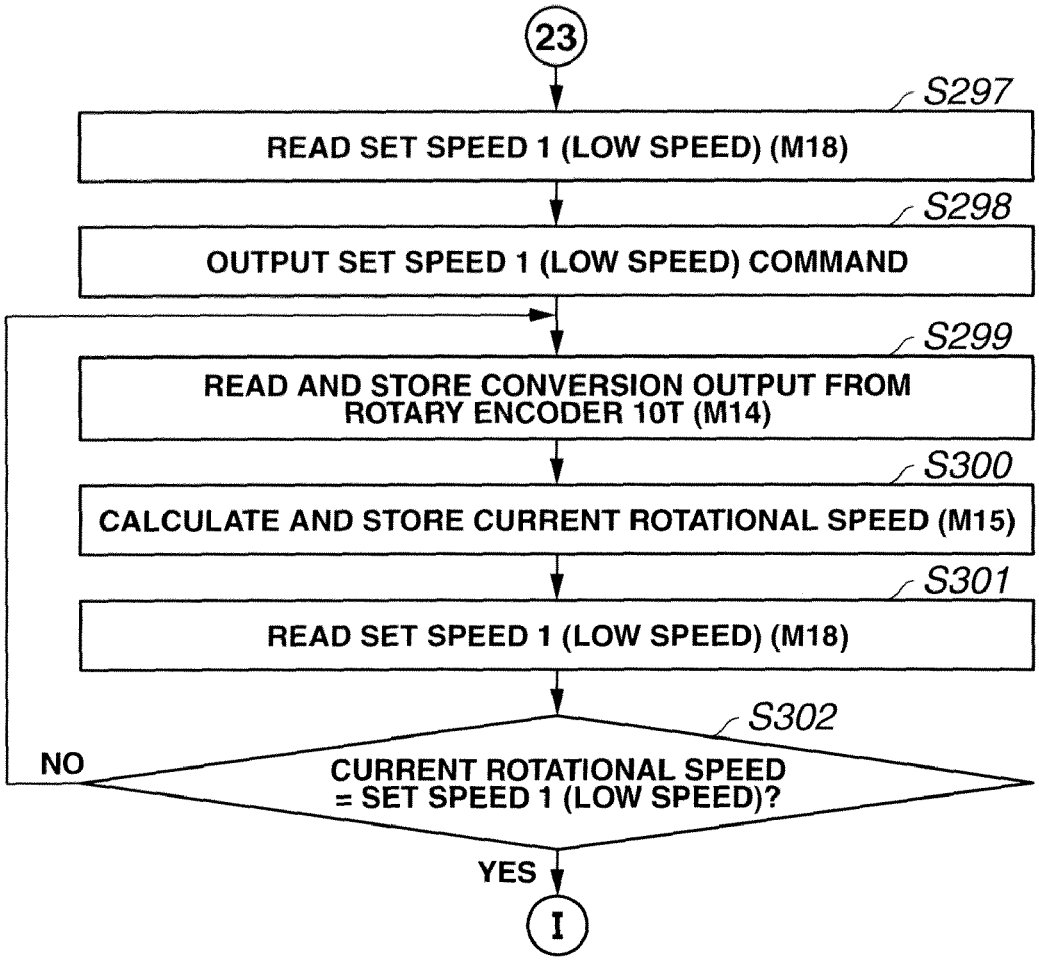
Figure 4V:
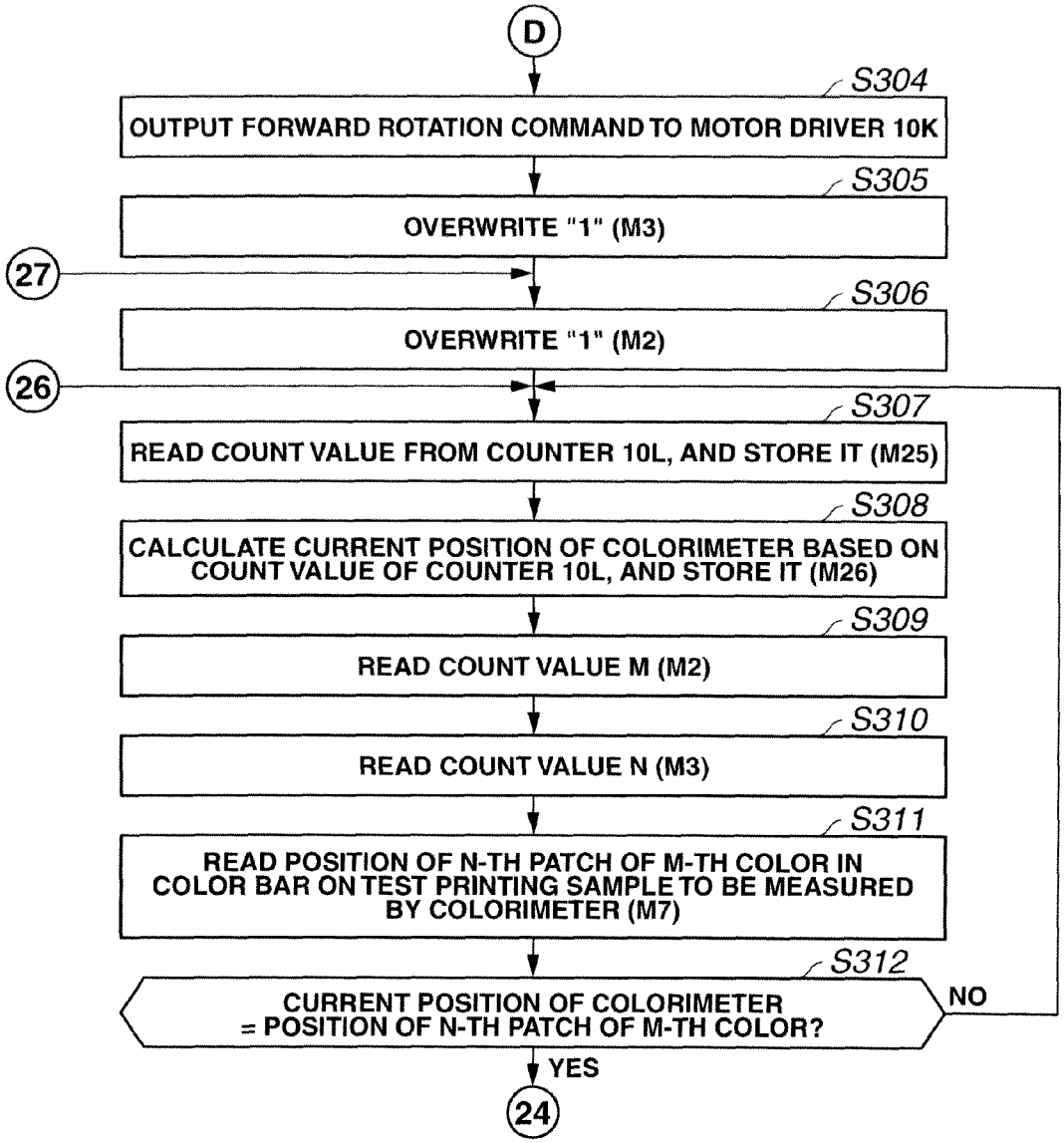
Figure 4W:
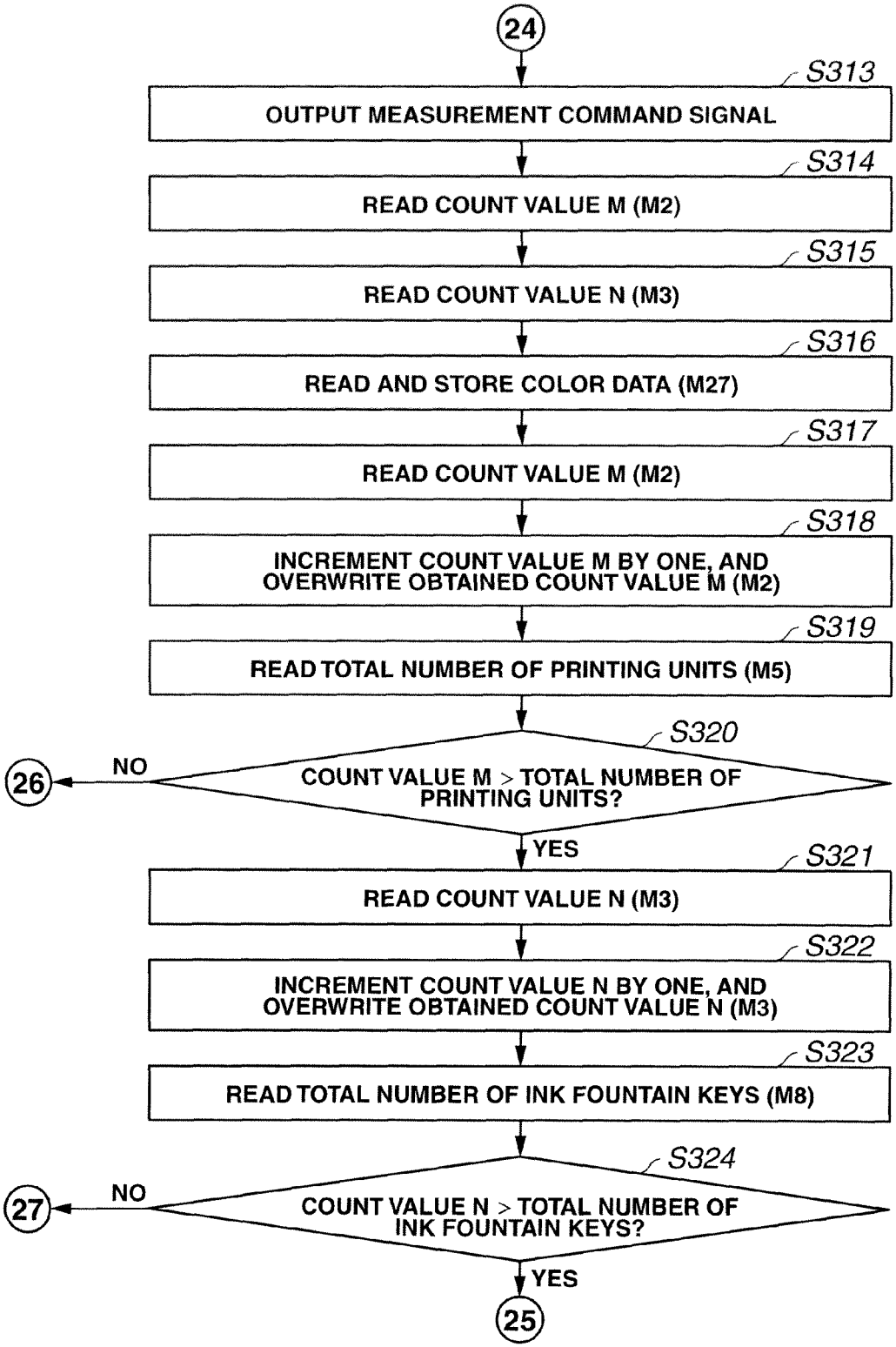
Figure 4X:
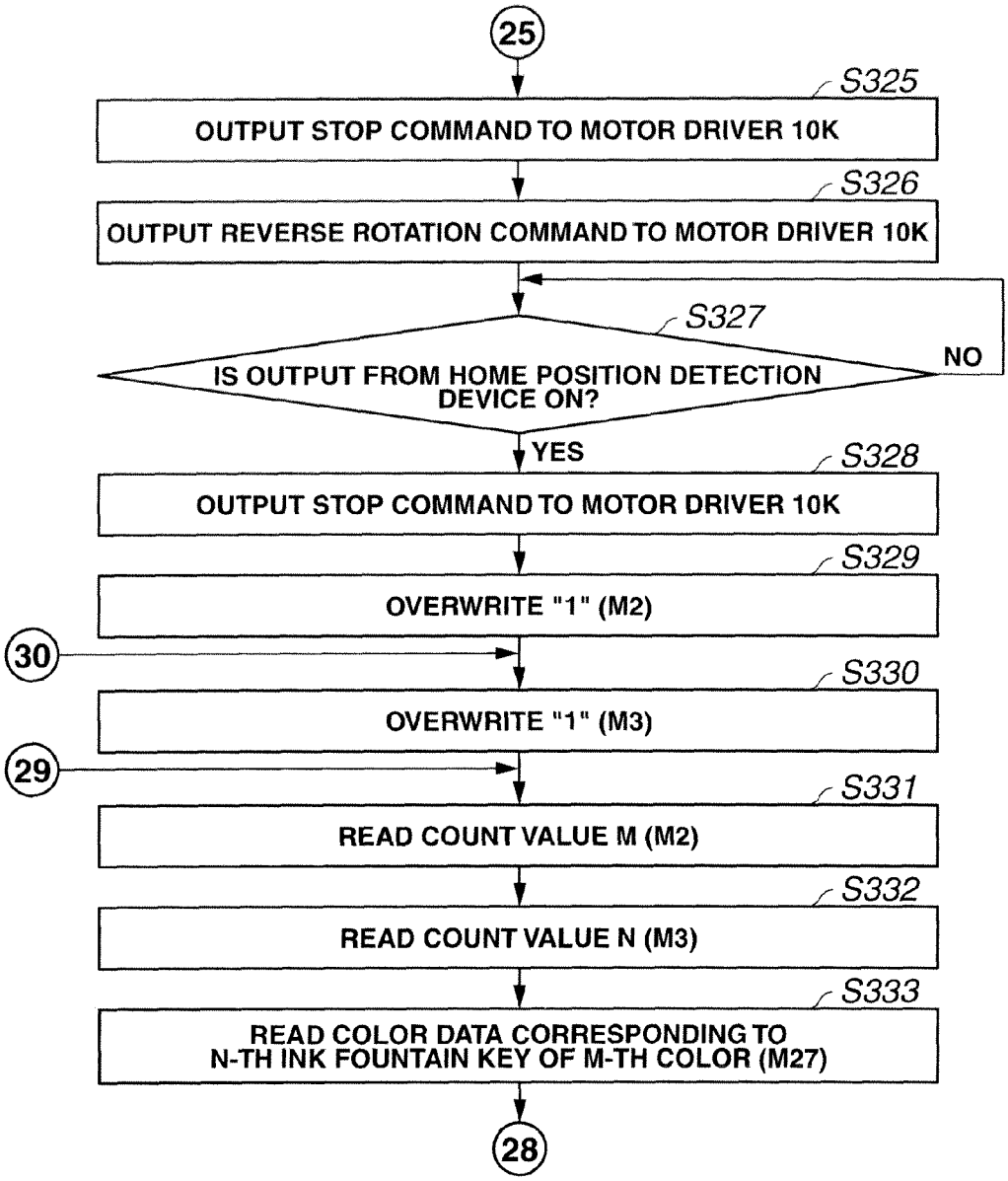
Figure 4Y:
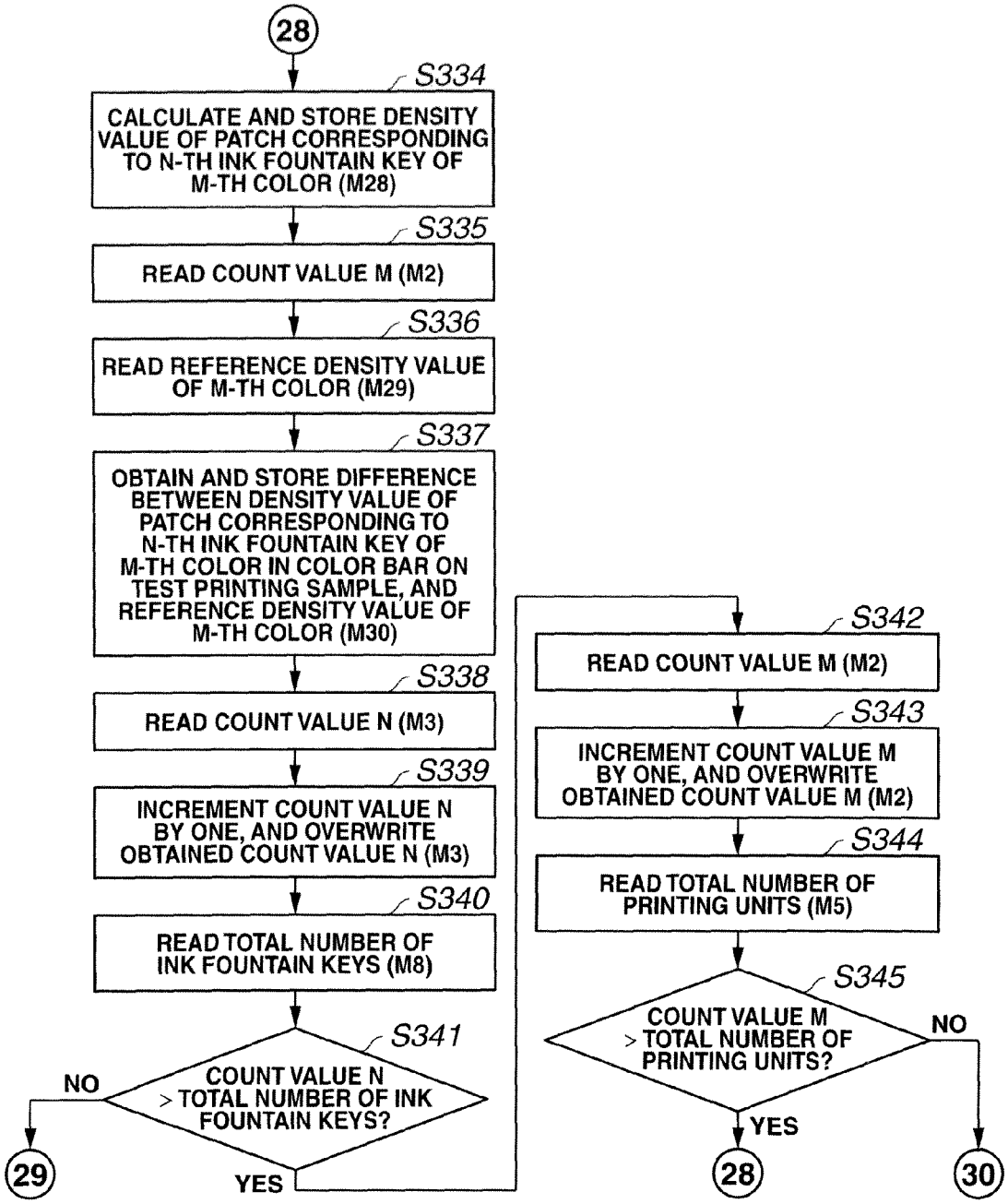
Figure 4Z:
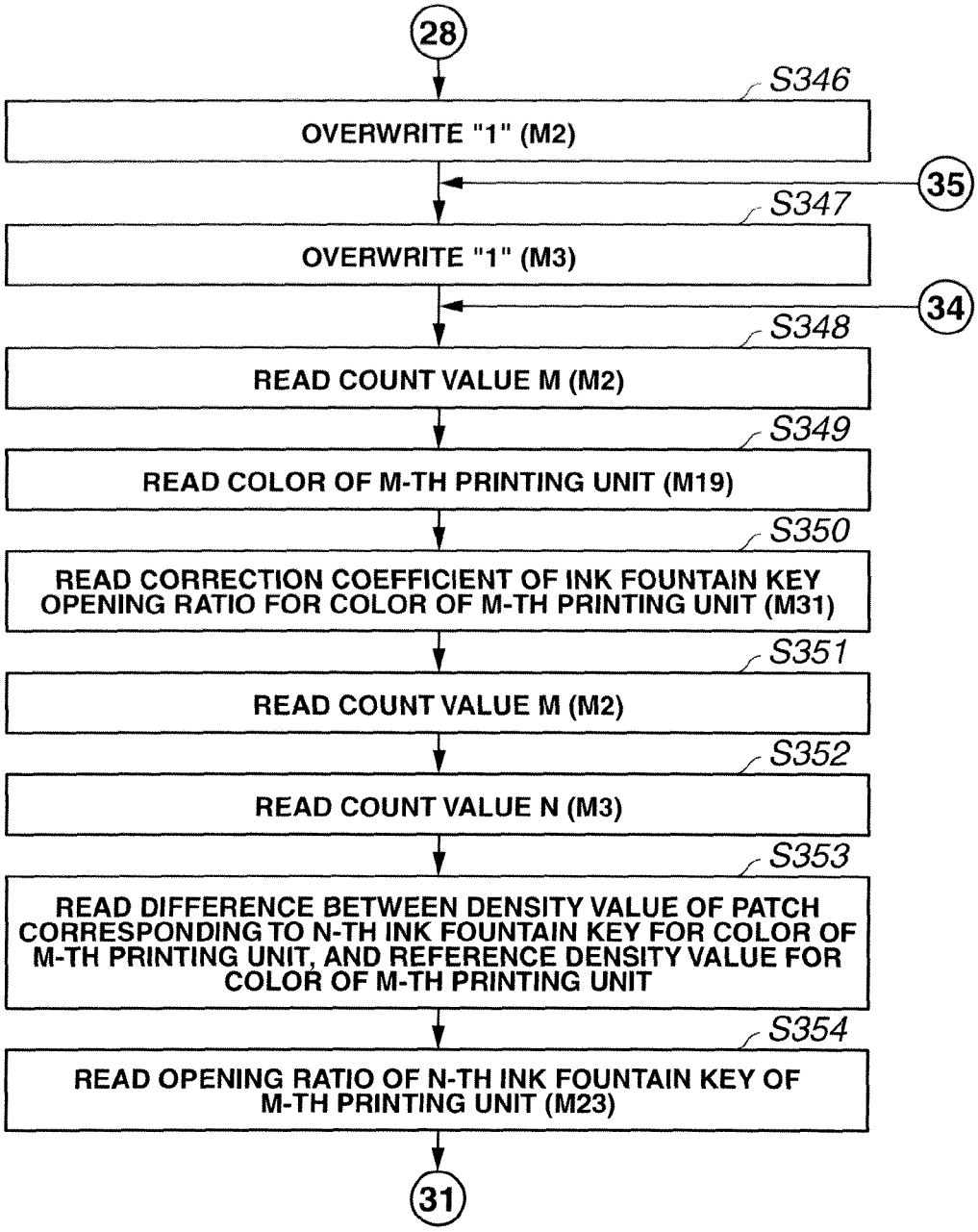

The operator turns on the test printing switch SW2. Upon turning on the test printing switch SW2 (YES in step S271 of FIG. 4E), the CPU 10A starts a test printing process. FIGS. 4S to 4U show a test printing process.

In the test printing process, the CPU 10A reads out set speed 2 of the printing press from the memory M13 (step S272), and sets the rotational speed of the printing press to set speed 2 (high speed) (steps S272 to S277). The CPU 10A issues an operation command to the ink feed device 14 of each printing unit, and a print start command to each printing unit 13 (steps S278 to S283). The CPU 10A also issues a sheet feed start command to the sheet feeding device 10Y (step S284).

Steps S272 to S279 and S281 to S283: The same processes as in steps S182 to S192, respectively, are performed.

Step S280: A print start command is output to the M-th printing unit 13-*m*.

The CPU 10A sends a reset signal and an enable signal to the counter 10X for counting the rotational speed of the printing press (step S285) to start the count operation of the counter 10X (step S286). Thus, test printing starts upon setting the count value of the counter 10X to zero.

The CPU 10A reads out the number of test printing sheets from the memory M1 (step S288). If the count value (the number of printing sheets) of the counter 10X becomes equal to the number of test printing sheets read out from the memory M1 (YES in step S289), the CPU 10A issues a sheet feed stop command to the sheet feeding device 10Y (step S290). The CPU 10A also issues a print stop command to each printing unit 13, and a stop command to the ink feed device 14 of each printing unit (steps S291 to S296) to set the rotational speed of the printing press to set speed 1 (low speed) (steps S297 to S302).

Step S291: "1" is overwritten (M2).

Step S292: A print stop command is output to the M-th printing unit 13-*m*.

Step S293: A stop command is output to the ink feed device 14-*m* of the M-th printing unit 13-*m*.

Steps S294 to S296: The same processes as in steps S107 to S109, respectively, are performed.

Steps S297 to S302: The same processes as in steps S198 to S203, respectively, are performed.

Thus, test printing is performed for the set number of sheets after an ink film thickness distribution corresponding to an image on a printing plate of each color is formed on the ink roller group 6 of each printing unit.

[Re-Test Printing]

The operator selects one of the finished printing products, and sets it on the measurement table 17-4 (FIG. 5) as a test printing sample 9. In this setting state, the color bar 9-2 on the test printing sample 9 is positioned on the lower surface of the head portion 10H1 of the colorimeter 10H.

In this state, the operator turns on the re-test printing switch SW3. Upon turning on the re-test printing switch SW3 (YES in step S303 of FIG. 4E), the CPU 10A starts a re-test printing process. FIGS. 4V to 5O show a re-test printing process.

[Color Data Extraction]

In the re-test printing process, the CPU 10A forwardly rotates the motor 10I (step S304). Upon forwardly rotating the motor 10I, the ball screw 17-3, in turn, forwardly rotates, so the colorimeter 10H moves from the home position where it contacts the column 17-1 toward the column 17-2 while being guided by the ball screw 17-3.

The CPU 10A reads the count value of the counter 10L, and calculates the current position of the colorimeter 10H based on the read count value. When the current position reaches the first measurement position stored in the memory M7, the CPU 10A extracts color data on a patch 9*a* at the measurement position using the colorimeter 10H, and stores the extracted color data in the memory M27 (steps S305 to S316).

Steps S305 and S306: The same processes as in steps S118 and S119, respectively, are performed.

Step S307: The count value is read from the counter 10L and stored (M25).

Step S308: The current position of the colorimeter is calculated based on the count value of the counter 10L, and stored (M26).

Steps S309 and S310: The same processes as in steps S120 and S121, respectively, are performed.

Step S311: The position of the N-th patch of the M-th color in the color bar on the test printing sample to be measured by the colorimeter is read from the address location for the N-th patch of the M-th color (M7).

Step S312: It is determined whether the current position of the colorimeter is equal to the position of the N-th patch of the M-th color in the color bar on the test printing sample to be measured by the colorimeter.

Step S313: A measurement command signal is output to the colorimeter.

Steps S314 and S315: The same processes as in steps S120 and S121, respectively, are performed.

Step S316: Color data is read from the colorimeter, and stored at an address location for the N-th ink fountain key of the M-th color (M27).

In the same way as above, every time the current position reaches a measurement position stored in the memory M7, the CPU 10A extracts color data on the patch 9*a* at the measurement position using the colorimeter 10H, and stores the extracted color data in the memory M27 (steps S306 to S324).

Steps S317 to S320: The same processes as in steps S128 to S131, respectively, are performed.

Steps S321 to S324: The same processes as in steps S124 to S127, respectively, are performed.

That is, the CPU 10A performs automatic scanning control of the colorimeter 10H to sequentially extract color data on each patch 9*a* of each color in the color bar 9-2 on the test printing sample 9, and stores the extracted color data in the memory M27.

When the CPU 10A completes the extraction of color data on all the patches 9*a* in the color bar 9-2 on the test printing sample 9 (step S324), it stops the forward rotation of the motor 10I (step S325). The CPU 10A reversely rotates the motor 10I (step S326) to return the colorimeter 10H to its home position (YES in step S327), and then stops the reverse rotation of the motor 10I (step S328).

[Density Difference Calculation]

The CPU 10A calculates the density value of each patch 9*a* of each color based on the color data on this patch 9*a* of this color stored in the color data memory M27, and stores it in the memory M28 as a measured density value (steps S329 to S334). The CPU 10A reads out the reference density value of each color from the memory M29, subtracts the measured density value of this patch 9*a* of this color from the reference density value of this color, and stores the difference in the memory M30 as a measured density difference ΔDij (i=1 to m, j=1 to n) of this patch 9*a* of this color on the test printing sample 9 (steps S335 to S345).

Steps S329 to S332: The same processes as in steps S118 to S121, respectively, are performed.

Step S333: Color data corresponding to the N-th ink fountain key of the M-th color is read from the address location for the N-th ink fountain key of the M-th color (M27).

Step S334: The density value of a patch corresponding to the N-th ink fountain key of the M-th color in the color bar on the test printing sample is calculated based on the color data corresponding to the N-th ink fountain key of the M-th color, and stored at an address location for the N-th ink fountain key of the M-th color (M28).

Step S335: The count value M is read (M2).

Step S336: The reference density value of the M-th color is read from an address location for the M-th color (M29).

Step S337: The reference density value of the M-th color is subtracted from the density value of a patch corresponding to the N-th ink fountain key of the M-th color in the color bar on the test printing sample to obtain the difference between the density value of the patch corresponding to the N-th ink fountain key of the M-th color in the color bar on the test printing sample, and the reference density value of the M-th color, and the obtained difference is stored at an address location for the N-th ink fountain key of the M-th color (M30).

Steps S338 to S345: The same processes as in steps S160 to S167, respectively, are performed.

Note that in this embodiment, a spectrometer is employed as the colorimeter 10H, so the density value of each color is obtained by multiplying the transmittance, for each wavelength, of a filter used to measure a solid patch of the color using a densitometer by the value output from the spectrometer for each wavelength, and adding up these products.

[Calculation of Corrected Opening Ratio of Ink Fountain Key (Opening Ratio of Ink Fountain Key at Time of Printing after Preliminary Ink Feeding)]

When the CPU 10A completes the calculation of the measured density difference ΔDij (i=1 to m, j=1 to n) of each patch 9*a* of each color on the test printing sample 9 (YES in step S345), it calculates the corrected opening ratio of each ink fountain key of each printing unit (the opening ratio of each ink fountain key of each printing unit at the time of printing after preliminary ink feeding) θij' (i=1 to m, j=1 to n) (steps S346 to S355).

Steps S346 and S347: The same processes as in steps S118 and S119, respectively, are performed.

Steps S348 and S349: The same processes as in steps S205 and S206, respectively, are performed.

Step S350: To be described below.

Steps S351 and S352: The same processes as in steps S120 and S121, respectively, are performed.

Steps S353 to S355: To be described below.

The opening ratio θij' of each ink fountain key of each printing unit at the time of printing after preliminary ink feeding is calculated using:

$$\theta ij' = \theta ij - \alpha i \cdot \Delta Dij \cdot \theta ij \quad (1)$$

In the process of calculating the opening ratio θij' of each ink fountain key of each printing unit at the time of printing after preliminary ink feeding, the CPU 10A reads out the correction coefficient αi (i=1 to m) of the ink fountain key opening ratio for the color of each printing unit from the memory M31 (step S350), reads out the measured density difference ΔDij (i=1 to m, j=1 to n) of the patch 9*a* for the color of each printing unit on the test printing sample 9 from the memory M30 (step S353), reads out the current opening ratio θij (i=1 tom, j=1 to n) of each ink fountain key of each printing unit from the memory M23 (step S354), and calculates the corrected opening ratio θij' (i=1 to m, j=1 to n) of each ink fountain key of each printing unit using the above-mentioned equation (1) and stores the calculated opening ratio θij' (i=1 to m, j=1 to n) in the memory M32 as the opening ratio of each ink fountain key of each printing unit at the time of printing after preliminary ink feeding (step S355).

[Calculation of Ink Fountain Key Opening Ratio in Preliminary Ink Feeding]

After the above-mentioned calculation of the opening ratio θij' (i=1 to m, j=1 to n) of each ink fountain key of each printing unit at the time of printing after preliminary ink feeding, the CPU 10A calculates the opening ratio θij" (i=1 to m, j=1 to n) of each ink fountain key of each printing unit in preliminary ink feeding (steps S356 to S369).

Steps S356 and S357: The same processes as in steps S204 and S205, respectively, are performed.

Steps S358 to S361: To be described below.

Steps S362 to S369: The same processes as in steps S160 to S167, respectively, are performed.

The opening ratio θij" of each ink fountain key of each printing unit in preliminary ink feeding is calculated using:

$$\theta ij'' = \alpha i \times \Delta Dij \times \theta ij \times \beta i \quad (2)$$

In the process of calculating the opening ratio θij" of each ink fountain key of each printing unit in preliminary ink feeding, the CPU 10A reads out the reference rotation amount Sstdi (i=1 to m) of the ink fountain roller for the color of each printing unit from the memory M20 (step S358). The CPU 10A reads out the current rotation amount Spi (i=1 to m) of the ink fountain roller of each printing unit from the memory M21 (step S359). The CPU 10A obtains the correction coefficient βi (i=1 to m) based on the ink fountain roller rotation amount of each printing unit by dividing the current rotation amount Spi of the ink fountain roller of each printing unit by the reference rotation amount Sstdi of the ink fountain roller for the color of each printing unit, and stores the quotient in the memory M33 (step S360). The CPU 10A calculates, the opening ratio θij" (i=1 to m, j=1 to n) of each ink fountain key of each printing unit in preliminary ink feeding, using the above-mentioned equation (2) based on the obtained correction coefficient βi (i=1 to m), based on the ink fountain roller rotation amount of each printing unit; the correction coefficient αi (i=1 to m) of the ink fountain key opening ratio for the color of each printing unit, stored in the memory M31; the measured density difference ΔDij (i=1 to m, j=1 to n) of the patch 9*a* for the color of each printing unit on the test printing sample 9, stored in the memory M30; and the current opening ratio θij (i=1 to m, j=1 to n) of each ink fountain key of each printing unit, stored in the memory M23, and stores the calculated opening ratio θij" in the memory M34 (step S361).

[Correction to Opening Ratio in Preliminary Ink Feeding]

After the above-mentioned calculation of the opening ratio θij' (i=1 to m, j=1 to n) of each ink fountain key of each printing unit at the time of printing after preliminary ink feeding, and the opening ratio θij" (i=1 to m, j=1 to n) of each ink fountain key of each printing unit in preliminary ink feeding (YES in step S369), the CPU 10A sets the rotational speed of the printing press to set speed 1 (low speed) (steps S370 to S375). The CPU 10A corrects the opening ratio of each ink fountain key of each printing unit to the opening ratio θij" (i=1 to m, j=1 to n) in preliminary ink feeding (steps S376 to S395).

Steps S370 to S375: The same processes as in steps S198 to S203, respectively, are performed.

Steps S376 and S377: The same processes as in steps S118 and S119, respectively, are performed.

Step S378: The count value M is read (M2).

Steps S379 to S381: To be described below.

Step S382: It is determined whether a reception completion signal for the ink fountain roller rotation amount has been received from the ink fountain roller control device 15-*m* for the M-th printing unit 13-*m*.

Steps S383 and S384: The same processes as in steps S120 and S121, respectively, are performed.

Steps S385 and S386: To be described below.

Step S387: It is determined whether a reception completion signal for the opening ratio of the N-th ink fountain key of the M-th printing unit 13-*m* has been received from the N-th ink fountain key control device 16-*n* for the M-th printing unit 13-*m*.

Steps S388 to S395: The same processes as in steps S160 to S167, respectively, are performed.

In this process, the CPU 10A reads out the current rotation amount Spi (i=1 to m) of the ink fountain roller of each printing unit from the memory M21. The CPU 10A stores the readout current rotation amount Spi (i=1 to m) of the ink fountain roller of each printing unit in the memory M35 as the ink fountain roller rotation amount of each printing unit before preliminary ink feeding (step S379).

The CPU 10A reads out the rotation amount Sprei (i=1 to m) of the ink fountain roller of each printing unit in preliminary ink feeding from the memory M6 (step S380), and sends it to the ink fountain roller control device 15 for each printing unit (step S381).

The CPU 10A reads out the opening ratio θij" (i=1 to m, j=1 to n) of each ink fountain key of each printing unit in preliminary ink feeding from the memory M34 (step S385), and sends it to each ink fountain key control device 16 for each printing unit (step S386).

The CPU 10A confirms whether setting completion signals have been returned from the ink fountain key control devices 16 for each printing unit (steps S396 to S408). That is, the CPU 10A confirms whether each ink fountain key of each printing unit has been set to that in preliminary ink feeding, and sends setting completion signals for the opening ratios of all the ink fountain keys to all the ink fountain key control devices 16 (step S409).

Steps S396 to S399: The same processes as in steps S118 to S121, respectively, are performed.

Step S400: It is determined whether a setting completion signal has been received from the N-th ink fountain key control device 16-*n* for the M-th printing unit 13-*m*.

Steps S401 to S408: The same processes as in steps S160 to S167, respectively, are performed.

The CPU 10A sends a reset signal and an enable signal to the internal clock counter 10Q (step S410) to start the count operation of the internal clock counter 10Q (step S411). The CPU 10A reads out the count value for a first standby time from the memory M36 (step S412), and stands by until the count value of the internal clock counter 10Q reaches the count value for the first standby time (steps S413 and S414).

[Preliminary Ink Feeding]

When the first standby time has elapsed (YES in step S414), the CPU 10A stops the enable signal for the internal clock counter 10Q (step S415), and issues an operation command to the ink feed device 14 of each printing unit (steps S416 to S420). The CPU 10A sends a reset signal and an enable signal to the counter 10X for counting the rotational speed of the printing press (step S421) to start the count operation of the counter 10X (step S422). Thus, the ink ductor roller 5 starts its ink feed operation in each printing unit upon setting the count value of the counter 10X to zero.

Step S416: "1" is overwritten (M2).

Step S417: An operation command is output to the ink feed device 14-*m* of the M-th printing unit 13-*m*.

Steps S418 to S420: The same processes as in steps S107 to S109, respectively, are performed.

That is, the ink ductor roller 5 starts its ink feed operation (preliminary ink feed operation) while printing is suspended, after the ink fountain roller rotation amount is set to that in preliminary ink feeding, and the opening ratios of the ink fountain keys 4-1 to 4-*n* are set to those in preliminary ink feeding.

The CPU 10A reads out the number of times of preliminary ink feeding of each printing unit during the ink feed operation of the ink ductor roller 5 of each printing unit from the memory M4, and compares it with the count value of the counter 10X. The CPU 10A sequentially issues stop commands to the ink feed devices 14 of corresponding colors in ascending order of the number of times of preliminary ink feeding to stop the ink feed operation of the ink ductor rollers 5 (steps S423 to S437).

Step S423: "0" is overwritten (M3).

Step S424: "1" is overwritten (M2).

Step S425: The count value is read from the counter 10X and stored (M16).

Step S426: The number of times of preliminary ink feeding (corresponding to the rotational speed of the printing press) of the M-th printing unit 13-*m* is read from the address location for the M-th printing unit 13-*m* (M4).

Step S427: It is determined whether the count value of the counter 10X is equal to the number of times of preliminary ink feeding of the M-th printing unit 13-*m*.

Step S428: A stop command is output to the ink feed device 14-*m* for the M-th printing unit 13-*m*.

Steps S429 and S430: The same processes as in steps S124 and S125, respectively, are performed.

Steps S431 to S434: The same processes as in steps S164 to S167, respectively, are performed.

Step S435: The count value N is read (M3).

Step S436: The total number of printing units of the printing press is read (M5).

Step S437: It is determined whether the count value N is equal to the total number of printing units of the printing press.

In the preliminary ink feeding, in this embodiment, the opening ratio θij" (i=1 to m, j=1 to n) of each ink fountain key in preliminary ink feeding is obtained by taking account of not only the measured density difference ΔDij (i=1 to m, j=1 to n) of each patch 9*a* on the test printing sample 9 but also the current opening ratio θij (i=1 to m, j=1 to n) of each ink fountain key, as shown in the above-mentioned equation (2).

According to equation (2), a portion with a low image area ratio (a portion with a low ink fountain key opening ratio) changes little in ink supply amount even if density difference is the same. Also, a portion with a high image area ratio (a portion with a high ink fountain key opening ratio) changes significantly in ink supply amount even if density difference is the same. Hence, the amount of ink to be supplied to a range corresponding to each ink fountain key has an appropriate value irrespective of the image area ratio in this range, so a normal printing product can be printed immediately after preliminary ink feeding.

Also, in this embodiment, the correction coefficient βi (i=1 to m) based on the ink fountain roller rotation amount is also used to calculate the opening ratio θij" (i=1 to m, j=1 to n) of each ink fountain key in preliminary ink feeding, as shown in the above-mentioned equation (2). Hence, the opening ratio θij" (i=1 to m, j=1 to n) in preliminary ink feeding of each ink fountain key becomes more precise, so a normal printing product can be more quickly obtained.

Although the correction coefficient βi based on the ink fountain roller rotation amount is used to calculate the opening ratio θij" of each ink fountain key in preliminary ink feeding in this embodiment, it need not always be used.

[Correction to Opening Ratio at Time of Printing after Preliminary Ink Feeding]

When the CPU 10A completes the preliminary ink feeding of all the printing units (YES in step S437), it corrects the opening ratio of each ink fountain key of each printing unit to the opening ratio θij' (i=1 to m, j=1 to n) at the time of printing after preliminary ink feeding (steps S438 to S456).

Steps S438 to S440: The same processes as in steps S118 to S120, respectively, are performed.

Steps S441 and S442: To be described below.

Step S443: It is determined whether the count value of the counter 10X is equal to the number of times of preliminary ink feeding of the M-th printing unit 13-*m*.

Steps S444 and S445: The same processes as in steps S118 and S119, respectively, are performed.

Steps S446 and S447: To be described below.

Step S448: It is determined whether a reception completion signal for the opening ratio of the N-th ink fountain key of the M-th printing unit 13-*m* has been received from the N-th ink fountain key control device 16-*n* for the M-th printing unit 13-*m*.

Steps S449 to S456: The same processes as in steps S160 to S167, respectively, are performed.

In this case, the CPU 10A reads out the ink fountain roller rotation amount of each printing unit before preliminary ink feeding from the memory M35, and overwrites it in the memory M21 (step S441). The CPU 10A transmits the read-out ink fountain roller rotation amount of each printing unit before preliminary ink feeding to the ink fountain roller control device 15 for each printing unit (step S442).

The CPU 10A reads out the opening ratio θij' (i=1 to m, j=1 to n) of each ink fountain key of each printing unit at the time of printing after preliminary ink feeding from the memory M32, and overwrites it in the memory M23 (step S446). The CPU 10A transmits the readout opening ratio θij' (i=1 to m, j=1 to n) of each ink fountain key of each printing unit at the time of printing after preliminary ink feeding to each ink fountain key control device 16 for each printing unit (step S447).

The CPU 10A confirms whether setting completion signals have been received from the ink fountain key control devices 16 for each printing unit (steps S457 to S469). That is, the CPU 10A confirms whether each ink fountain key of each printing unit has been set to that at the time of printing after preliminary ink feeding, and sends setting completion signals for the opening ratios of all the ink fountain keys to all the ink fountain key control devices 16 (step S470).

Steps S457 to S460: The same processes as in steps S118 to S121, respectively, are performed.

Step S461: It is determined whether a setting completion signal has been received from the N-th ink fountain key control device 16-*n* for the M-th printing unit 13-*m*.

Steps S462 to S469: The same processes as in steps S160 to S167, respectively, are performed.

The CPU 10A sends a reset signal and an enable signal to the internal clock counter 10Q (step S471) to start the count operation of the internal clock counter 10Q (step S472). The CPU 10A reads out the count value for a second standby time from the memory M37 (step S473), and stands by until the count value of the internal clock counter 10Q reaches the count value for the second standby time (steps S474 and S475).

[Printing after Preliminary Ink Feeding (Re-test Printing)]

When the second standby time has elapsed (YES in step S475), the CPU 10A stops the enable signal for the internal clock counter 10Q (step S476), and sets the rotational speed of the printing press to set speed 2 (high speed) (steps S478 to S483). The CPU 10A issues an operation command to the ink feed device 14 of each printing unit, and a print start command to each printing unit 13 (steps S484 to S489). The CPU 10A also issues a sheet feed start command to the sheet feeding device 10Y (step S490).

Steps S478 to S485 and S487 to S489: The same processes as in steps S182 to S192, respectively, are performed.

Step S486: A print start command is output to the M-th printing unit 13-*m*.

The CPU 10A sends a reset signal and an enable signal to the counter 10X for counting the rotational speed of the printing press (step S491) to start the count operation of the counter 10X (step S492). Thus, re-test printing starts upon setting the count value of the counter 10X to zero.

Step S493: The count value is read from the counter 10X and stored (M16).

The CPU 10A reads out the number of test printing sheets from the memory M1 (step S494). If the count value (the number of printing sheets) of the counter 10X becomes equal to the number of test printing sheets read from the memory M1 (YES in step S495), the CPU 10A issues a sheet feed stop command to the sheet feeding device 10Y (step S496). The CPU 10A also issues a print stop command to each printing unit 13, and a stop command to the ink feed device 14 of each printing unit (steps S497 to S502) to set the rotational speed of the printing press to set speed 1 (low speed) (steps S503 to S508).

Steps S497 to S502: The same processes as in steps S291 to S296, respectively, are performed.

Steps S503 to S508: The same processes as in steps S198 to S203, respectively, are performed.

Thus, re-test printing is performed for the set number of printing sheets after the ink fountain roller rotation amount of each printing unit is returned to that before preliminary ink feeding, and the opening ratio of each ink fountain key of each printing unit is corrected to that at the time of printing after preliminary ink feeding.

The operator repeats the above-mentioned re-test printing process (steps S303 to S508) until a satisfactory printing product is obtained upon the re-test printing. When a satisfactory printing product is obtained, the final printing switch SW4 is turned on to start final printing.

[Final Printing]

Upon turning on the final printing switch SW4 (YES in step S509 of FIG. 4E), the CPU 10A starts a final printing process. FIGS. 5P and 5Q show a final printing process.

In the final printing process, the CPU 10A reads out set speed 2 of the printing press from the memory M13 (step S510), and sets the rotational speed of the printing press to set speed 2 (high speed) (steps S511 to S515).

Steps S511 to S515: The same processes as in steps S183 to S187, respectively, are performed.

The CPU 10A issues an operation command to the ink feed device 14 of each printing unit, and a print start command to each printing unit 13 (steps S516 to S521). The CPU 10A also issues a sheet feed start command to the sheet feeding device 10Y (step S522).

Steps S516 to S521: The same processes as in steps S183 to S192, respectively, are performed.

The CPU 10A sends a reset signal and an enable signal to the counter 10X for counting the rotational speed of the printing press (step S523) to start the count operation of the counter 10X (step S524). Thus, final printing starts upon setting the count value of the counter 10X to zero.

The CPU 10A reads out the number of final printing sheets from the memory M10 (step S526). If the count value (the number of printing sheets) of the counter 10X becomes equal to the number of final printing sheets read from the memory M10 (YES in step S527), the CPU 10A issues a sheet feed stop command to the sheet feeding device 10Y (step S528). The CPU 10A also issues a print stop command to each printing unit 13, a stop command to the ink feed device 14 of each printing unit (steps S529 to S534), and a stop command to the drive motor driver 10S of the printing press (step S535) to set the rotational speed of the printing press to zero (steps S536 to S538).

Steps S529 to S534: The same processes as in steps S291 to S296, respectively, are performed.

Step S535: As described above.

Steps S536 and S537: The same processes as in steps S184 and S185, respectively, are performed.

Step S538: It is determined whether the current rotational speed of the printing press is equal to zero.

In this manner, final printing is performed for the set number of sheets after a satisfactory printing product is obtained upon re-test printing. On the other hand, the control end switch SW5 is turned on to end all control operations (step S539 in FIG. 4E).

[Ink Fountain Roller Control Devices]

Figure 6:
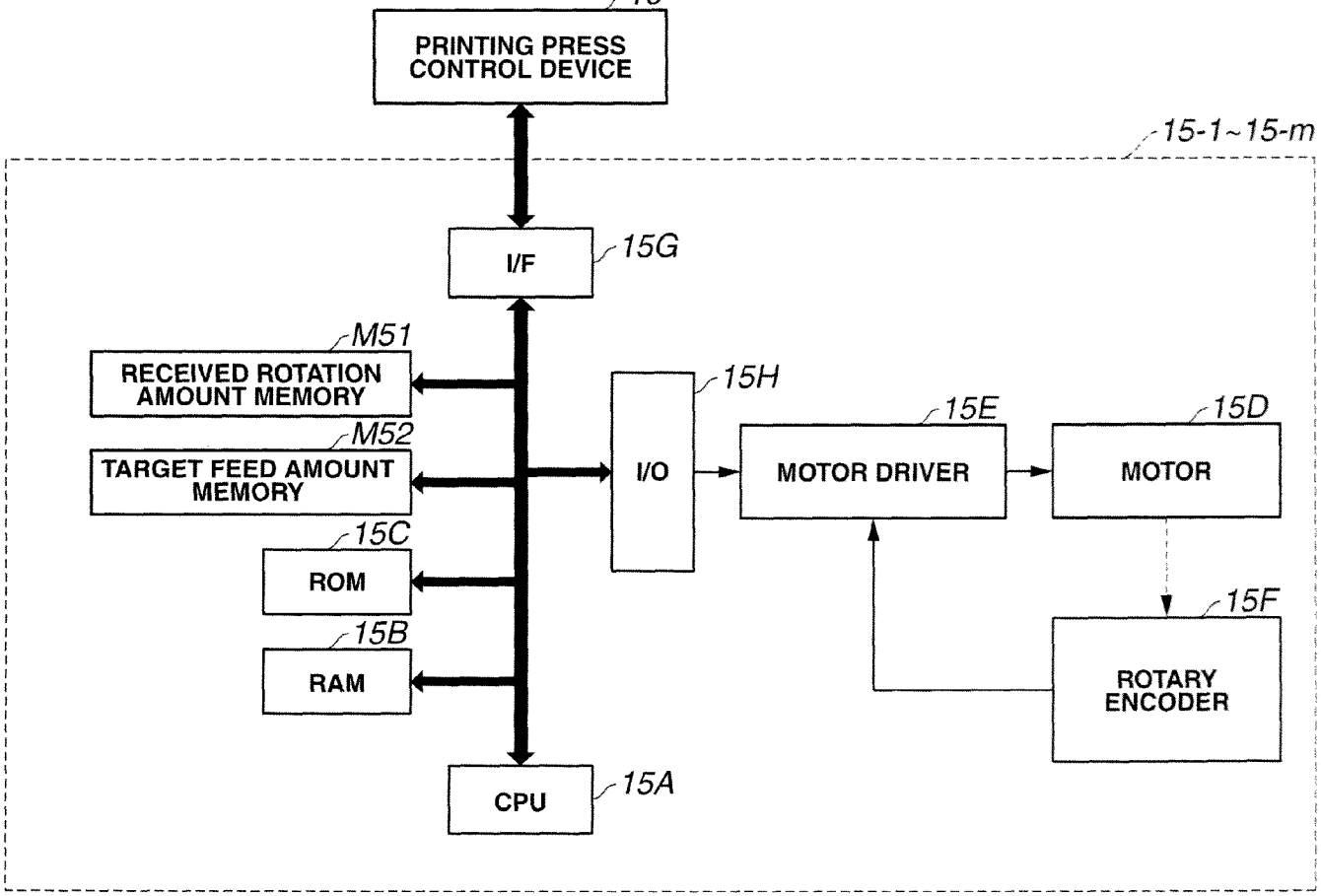
FIG. 6 is a block diagram showing the configuration of ink fountain roller control devices.

Each of the ink fountain roller control devices 15-1 to 15-*m* includes a CPU 15A, a RAM 15B, a ROM 15C, a motor 15D for driving the ink fountain roller 3, a motor driver 15E for driving the ink fountain roller 3, a rotary encoder 15F for the motor 15D for driving the ink fountain roller 3, input/output interfaces (I/O, I/F) 15G and 15H, and memories M51 and M52, as shown in FIG. 6. Each of the control devices 15-1 to 15-*m* is connected to the printing press control device 10 via the interface 15G. The memory M51 stores a received ink fountain roller rotation amount. The memory M52 stores a target ink fountain roller feed amount.

Figure 7:
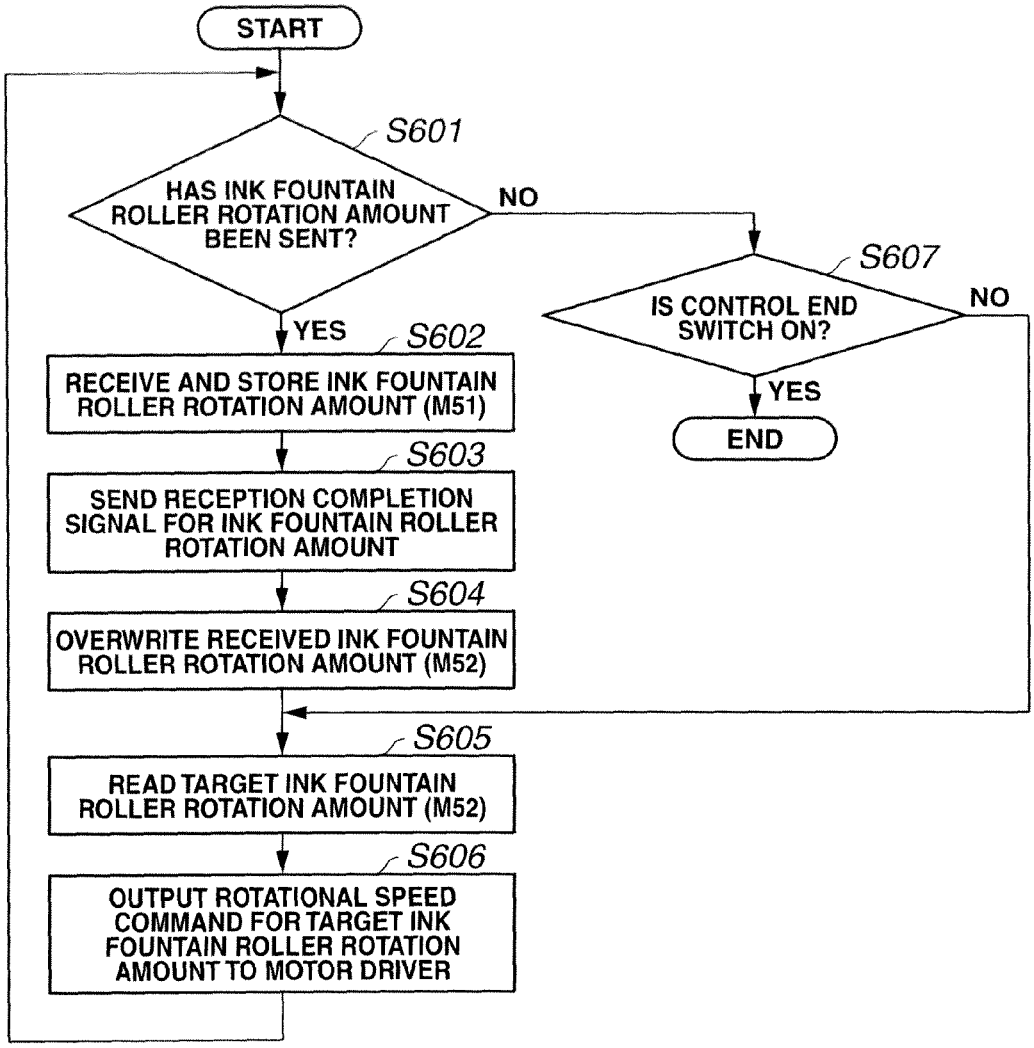
FIG. 7 is a flowchart showing the processing operation of a CPU 15A shown in FIG. 6.
Figure 8:
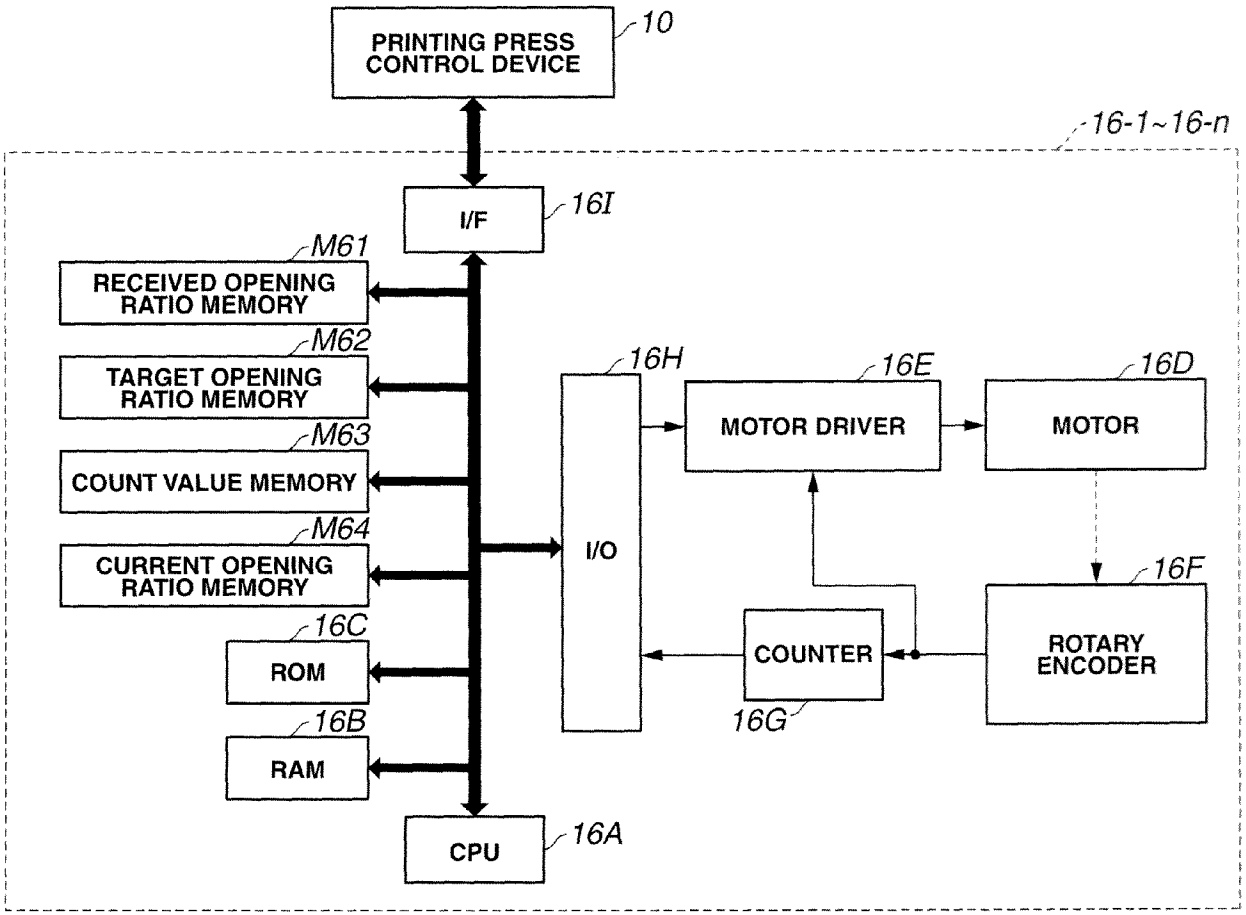
FIG. 8 is a block diagram showing the configuration of ink fountain key control devices.

The operation of each of the control devices 15-1 to 15-*m* configured as above will be described with reference to FIG. 7. If an ink fountain roller rotation amount has been sent from the printing press control device 10 (YES in step S601), the CPU 15A stores the received rotation amount in the memory M51 (step S602). The CPU 15A sends a reception completion signal for the ink fountain roller rotation amount to the printing press control device 10 (step S603). The CPU 15A stores the received ink fountain roller rotation amount in the memory M52 as a target ink fountain roller feed amount (target rotation amount) (step S604). The CPU 15A reads the target rotation amount from the memory M52 (step S605), sends it to the motor driver 15E, and adjusts the rotation amount of the motor 15D to the target rotation amount (step S606).

[Ink Fountain Key Control Devices]

Each ink fountain key control device 16 includes a CPU 16A, a RAM 16B, a ROM 16C, a motor 16D for driving the ink fountain keys 4-1 to 4-*n*, a motor driver 16E for driving the ink fountain keys 4-1 to 4-*n*, a rotary encoder 16F for the motor 16D for driving the ink fountain keys 4-1 to 4-*n*, a counter 16G, input/output interfaces (I/O, I/F) 16H and 16I, and memories M61 to M64. Each ink fountain key control device 16 is connected to the printing press control device 10 via the interface 16I. The memory M61 stores a received ink fountain key opening ratio. The memory M62 stores a target ink fountain key opening ratio. The memory M63 stores the count value of the counter 16G. The memory M64 stores the current ink fountain key opening ratio.

The operation of each ink fountain key control device 16 configured as above will be described with reference to FIGS. 9A to 9D. If an ink fountain key opening ratio has been sent from the printing press control device 10 (YES in step S701), the CPU 16A stores the received opening ratio in the memory M61 (step S702), and sends a reception completion signal for the ink fountain key opening ratio to the printing press control device 10 (step S703). The CPU 16A stores the received opening ratio in the memory M62 as a target opening ratio (step S704).

The CPU 16A reads the count value of the counter 16G (step S705), and obtains the current ink fountain key opening ratio based on the read count value of the counter 16G (step S706). The CPU 16A reads out the target opening ratio from the memory M62 (step S707). If the current ink fountain key opening ratio is equal to the target opening ratio (YES in step S708), the CPU 16A immediately advances the process to step S717, in which it outputs a setting completion signal for the ink fountain key opening ratio to the printing press control device 10.

If the current ink fountain key opening ratio is not equal to the target opening ratio (NO in step S709), the CPU 16A drives the motor 16D until the current ink fountain key opening ratio becomes equal to the target opening ratio (steps S709 to S716). After that, the CPU 16A outputs a setting completion signal for the ink fountain key opening ratio to the printing press control device 10 (step S717).

Step S709: It is determined whether the current ink fountain key opening ratio is lower than the target ink fountain key opening ratio.

Step S710: A forward rotation command is output to the motor driver.

Step S711: A reverse rotation command is output to the motor driver.

Step S712: The count value is read from the counter and stored (M63).

Step S713: The current ink fountain key opening ratio is calculated based on the count value of the counter, and stored (M64).

Step S714: The target ink fountain key opening ratio is read (M62).

Step S715: It is determined whether the current ink fountain key opening ratio is lower than the target ink fountain key opening ratio.

Step S716: A drive stop command is output to the motor driver.

The CPU 16A outputs a setting completion signal for the ink fountain key opening ratio to the printing press control device 10. After that, when the CPU 16A receives a setting completion signal for all the ink fountain key opening ratios from the printing press control device 10 (YES in step S718), it stops its output of a setting completion signal for the ink fountain key opening ratio to the printing press control device 10 (step S719).

Second Embodiment

Figure 5A:
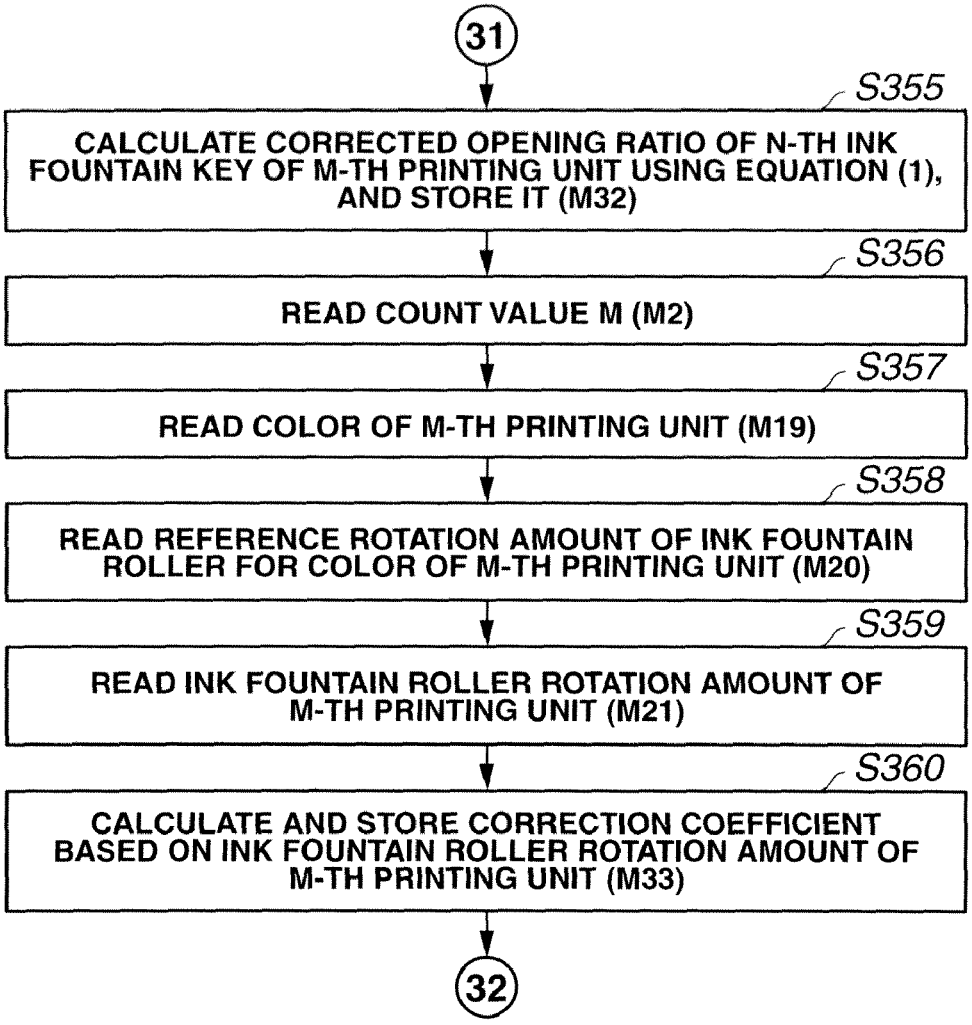
FIGS. 5A to 5Q are flowcharts showing the processing operation of the CPU 10A shown in FIG. 1.

In the above-described first embodiment, the current opening ratio θij of each ink fountain key of each printing unit is used to calculate the opening ratio θij' of each ink fountain key of each printing unit at the time of printing after preliminary ink feeding using equation (1) in step S355 (FIG. 5A). However, image data (image area ratio or image area) in a range corresponding to each ink fountain key of each printing unit may be used in place of the current opening ratio θij of each ink fountain key of each printing unit.

Figure 5B:
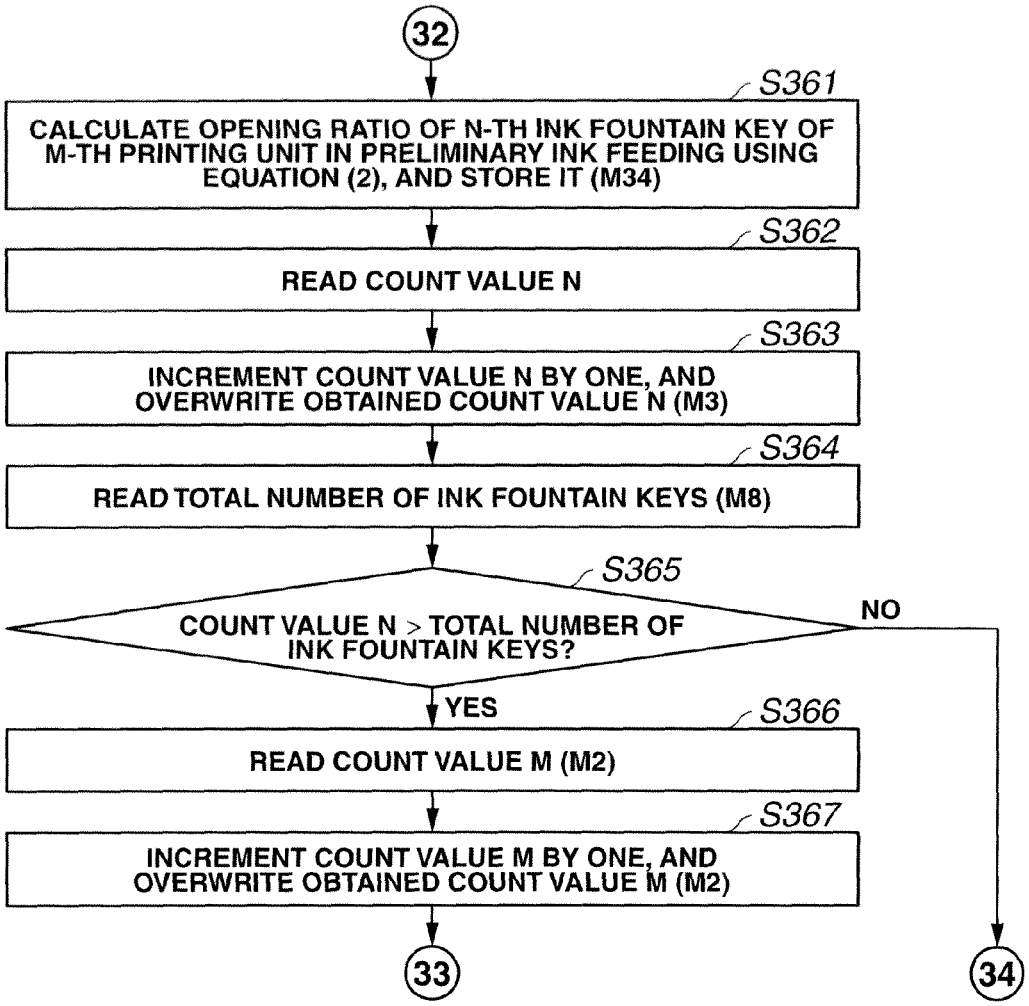
Figure 5C:
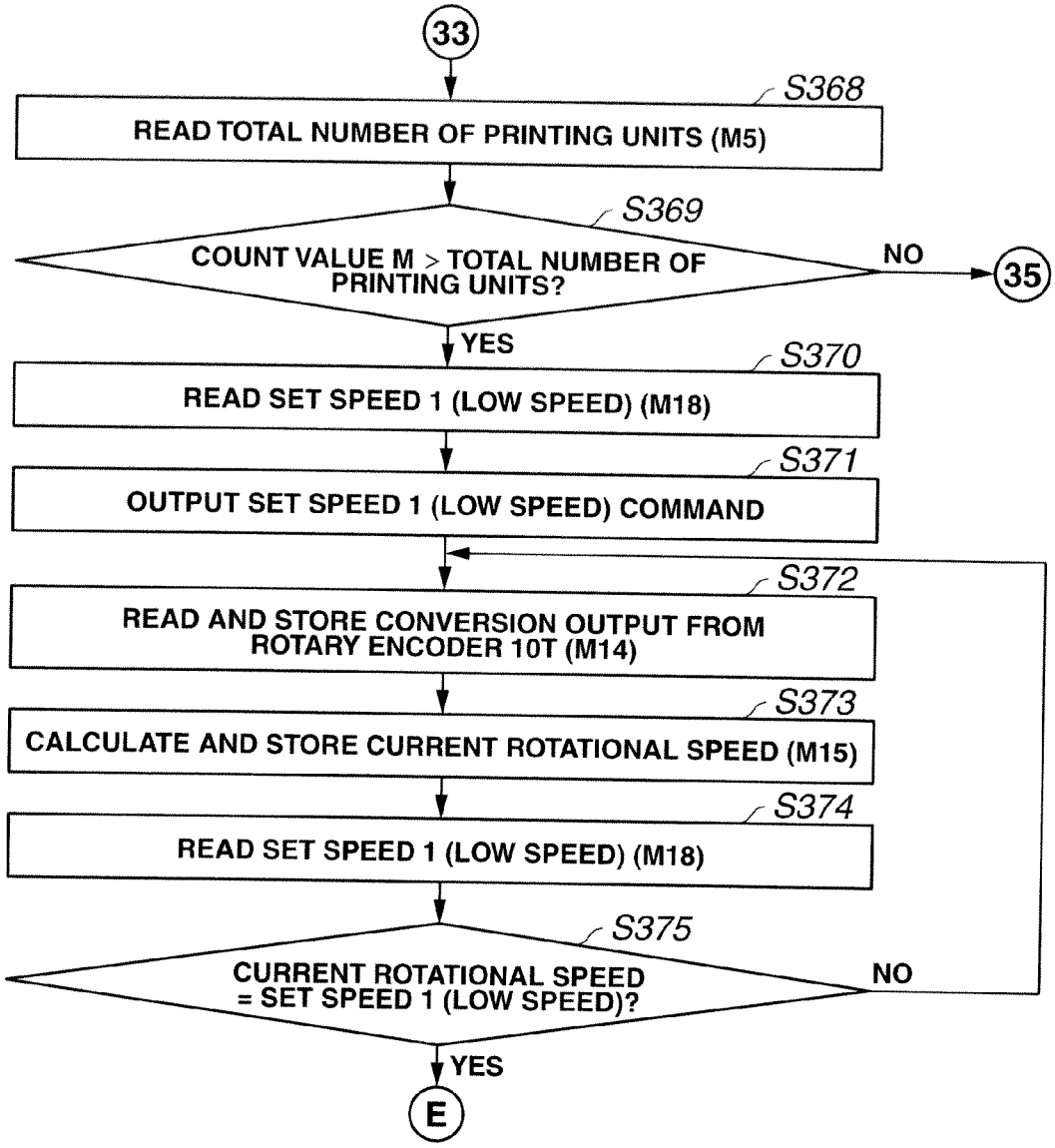
Figure 5D:
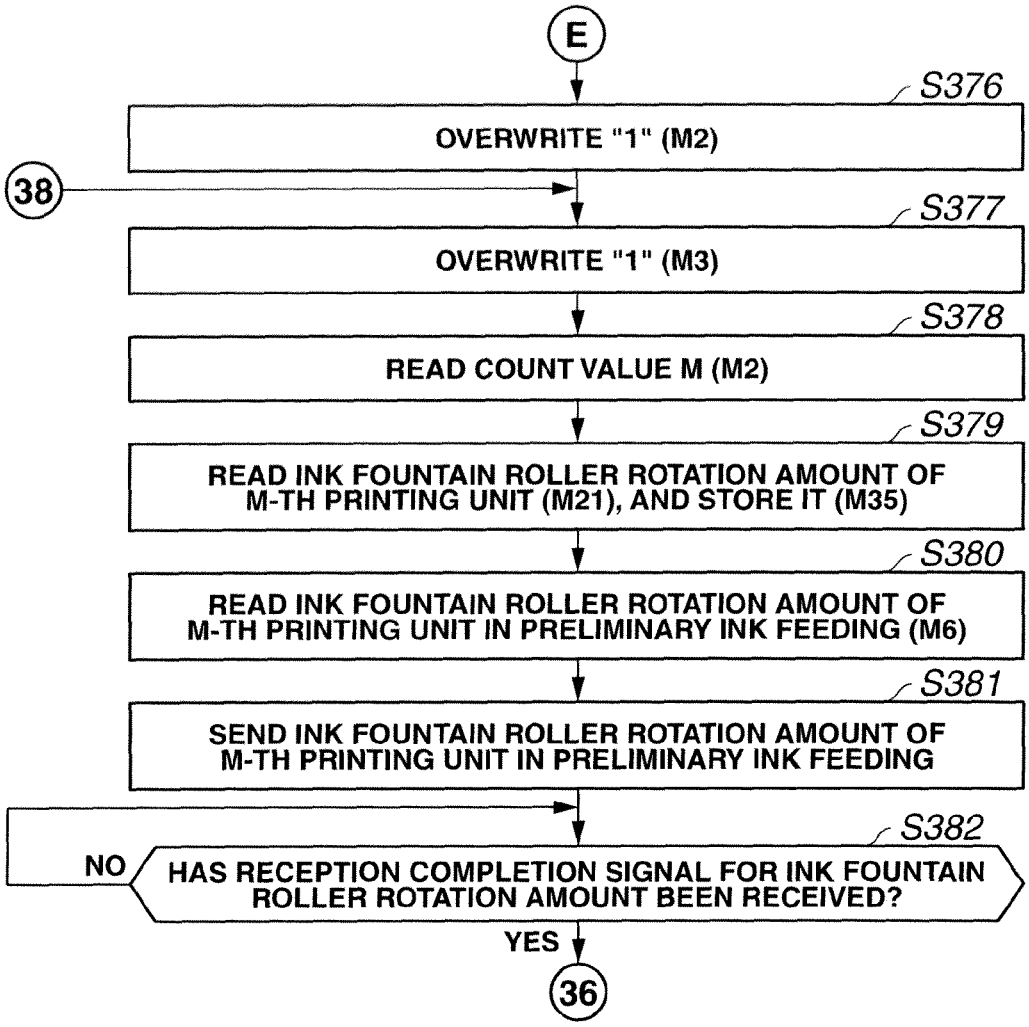
Figure 5E:
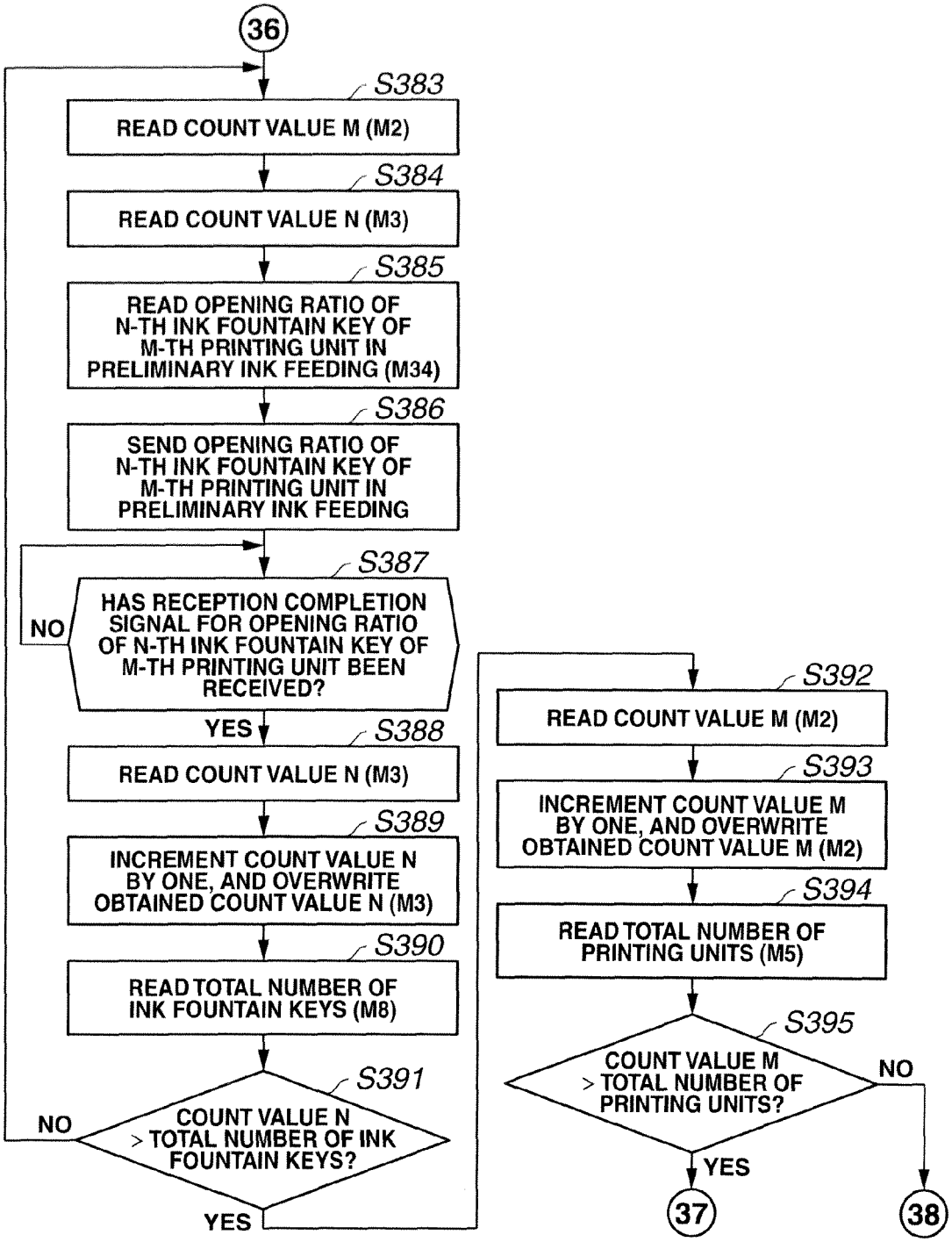
Figure 5F:
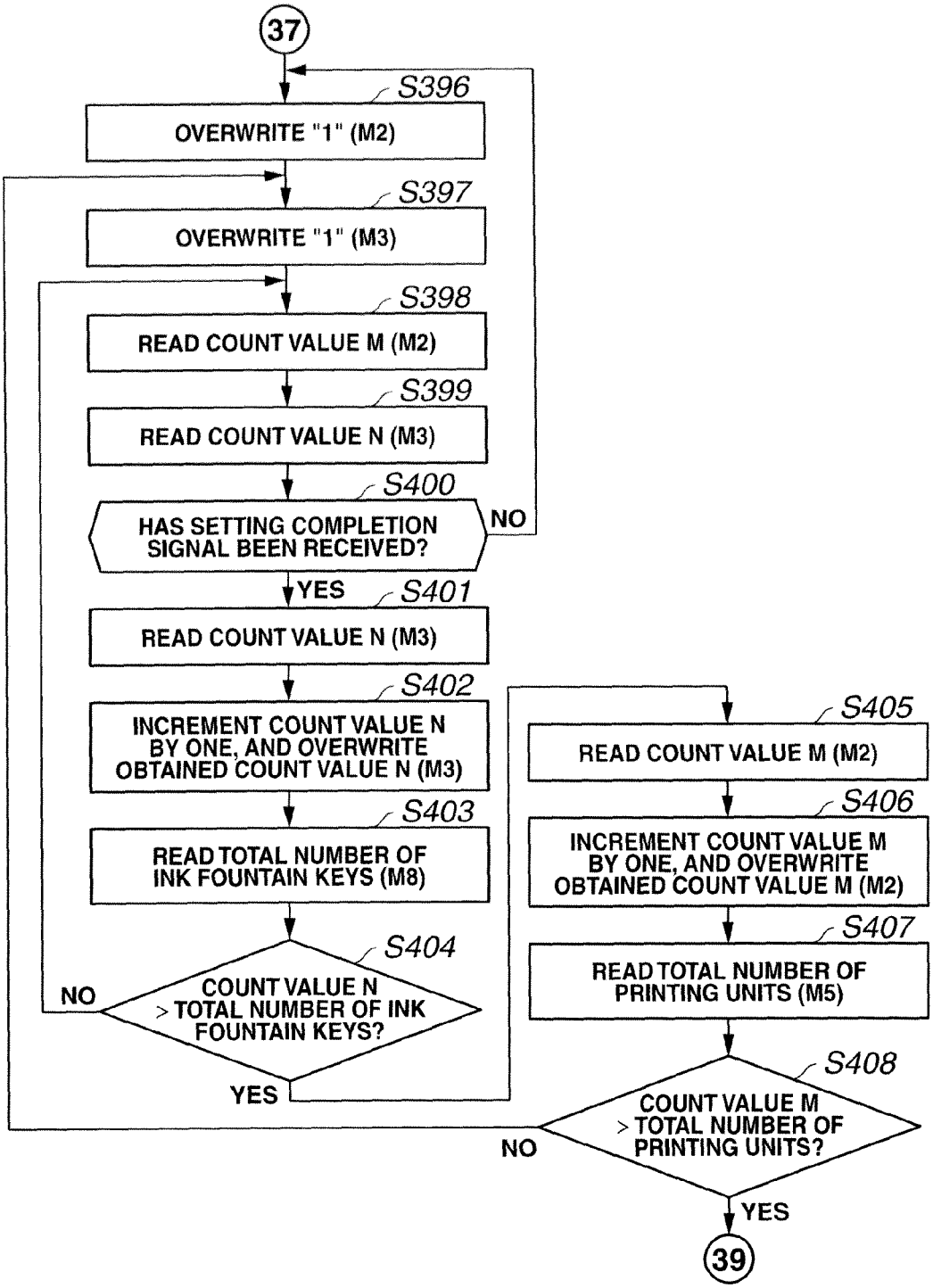
Figure 5G:
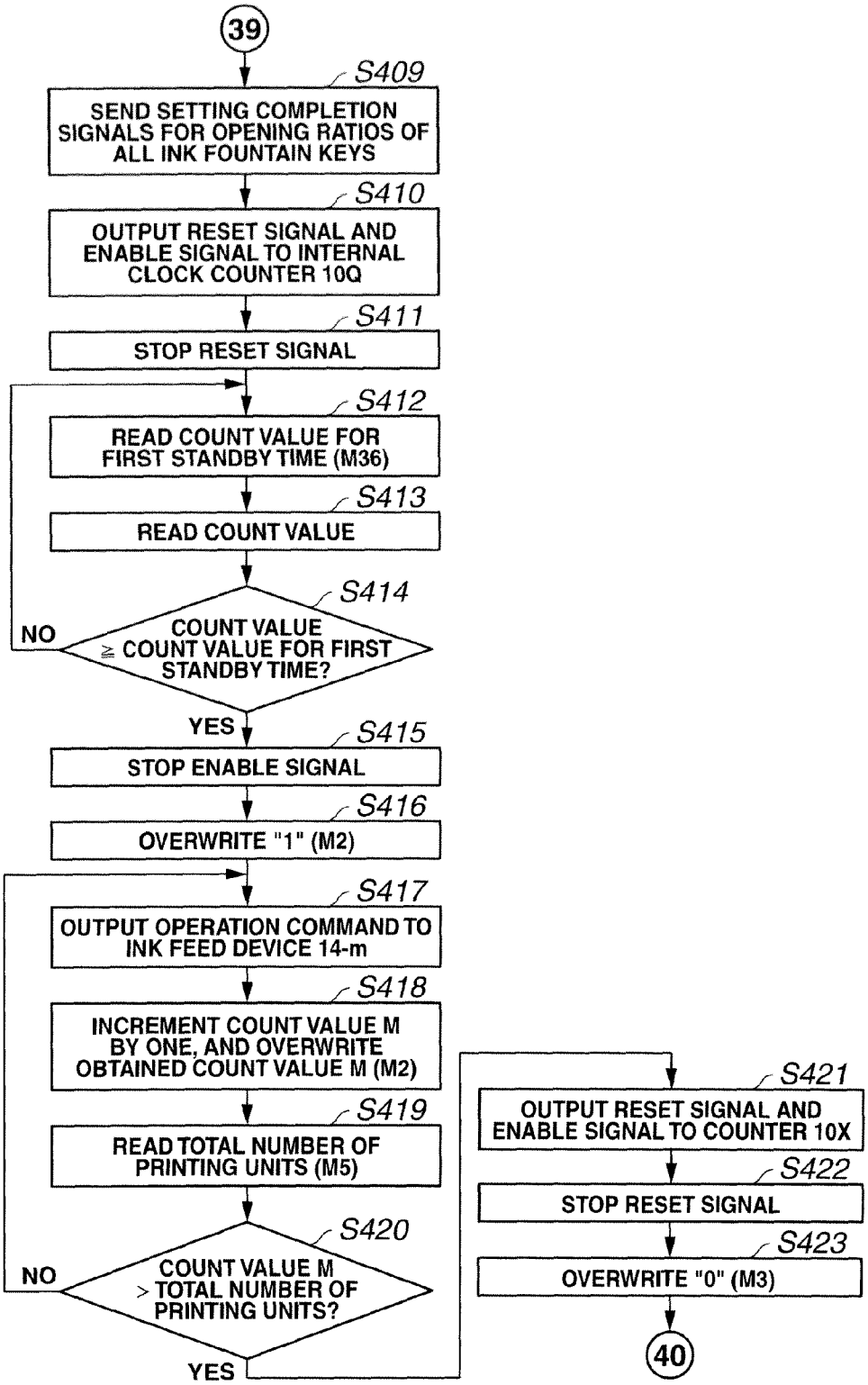

Also, in the first embodiment, the current opening ratio θij of each ink fountain key of each printing unit is used to calculate the opening ratio θij" of each ink fountain key of each printing unit in preliminary ink feeding using equation (2) in step S361 (FIG. 5B). However, image data (image area ratio or image area) in a range corresponding to each ink fountain key of each printing unit may be used in place of the current opening ratio θij of each ink fountain key of each printing unit.

In the second embodiment, the image area ratio in a range corresponding to each ink fountain key of each printing unit is used in place of the current opening ratio θij of each ink fountain key of each printing unit in the first embodiment. Processing operations in the second embodiment, which are different from those of the first embodiment, will be described with reference to FIGS. 9C and 9D. Processes in the second embodiment, other than only those in steps S355' and S361', are the same as in the first embodiment, and a description thereof will not be given.

In the second embodiment, based on a correction coefficient αi (i=1 to m) of the opening ratio of the ink fountain key for the color of each printing unit, a measured density difference ΔDij (i=1 to m, j=1 to n) of each patch 9*a* for the color of each printing unit on a test printing sample 9, and an image area ratio Sij (i=1 to m, j=1 to n) in a range corresponding to each ink fountain key of each printing unit, a CPU 10A' (FIG. 11) obtains an opening ratio θij' (i=1 to m, j=1 to n) of each ink fountain key of each printing unit at the time of printing after preliminary ink feeding using:

$$\theta ij' = Sij - \alpha i \cdot \Delta Dij \cdot Sij \qquad (1)'$$

(step S355').

In the second embodiment as well, based on a correction coefficient βi (i=1 to m) based on the ink fountain roller rotation amount of each printing unit, the correction coefficient αi (i=1 to m) of the opening ratio of the ink fountain key for the color of each printing unit, the measured density difference ΔDij (i=1 to m, j=1 to n) of each patch 9*a* for the color of each printing unit on the test printing sample 9, and the image area ratio Sij (i=1 to m, j=1 to n) in a range corresponding to each ink fountain key of each printing unit, the CPU 10A' calculates, an opening ratio θij" (i=1 to m, j=1 to n) of each ink fountain key of each printing unit in preliminary ink feeding, using:

$$\theta ij''=\alpha i\times\Delta Dij\times Sij\times\beta i \quad (2)'$$

(step S361').

Third Embodiment

In the third embodiment explained next, the image area in a range corresponding to each ink fountain key of each printing unit is used as image data in place of the image area ratio in a range corresponding to each ink fountain key of each printing unit in the second embodiment.

The image area ratio in a range corresponding to each ink fountain key is a value obtained by dividing the image area in the range corresponding to each ink fountain key by the area of the range corresponding to each ink fountain key, so the image area ratio and the image area are proportional to each other. Hence, in the third embodiment in which the image area in a range corresponding to each ink fountain key is used, it is only necessary to multiply the value (the image area ratio in the range corresponding to each ink fountain key) obtained by each of equations (1)' and (2)' by the area of the range corresponding to each ink fountain key.

Figure 10:
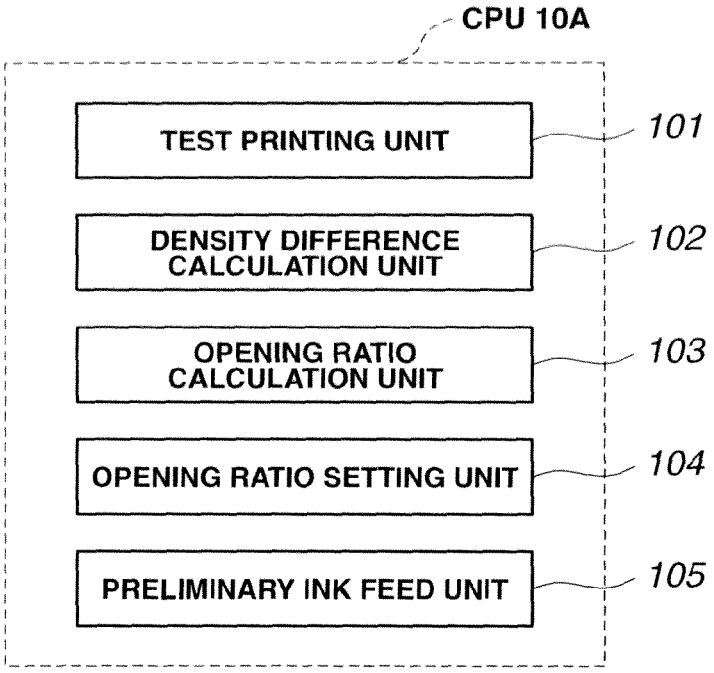
FIG. 10 is a functional block diagram of the CPU according to the first embodiment.

Functional blocks of the CPUs 10A and 10A' in the above-described first and second embodiments, respectively, will be described with reference to FIGS. 10 and 11, respectively. The CPU 10A according to the first embodiment includes a test printing unit 101, density difference calculation unit 102, opening ratio calculation unit 103, opening ratio setting unit 104, and preliminary ink feed unit 105, as shown in FIG. 10. The test printing unit 101 performs test printing of sample sheets the number of which is preset before preliminary ink feeding. The density difference calculation unit 102 obtains the difference between the measured patch density value in each sample having undergone the test printing by the test printing unit 101, and a preset reference density value. The opening ratio calculation unit 103 obtains, the opening ratio of each ink fountain key in preliminary ink feeding, based on the density difference obtained by the density difference calculation unit 102, and the current opening ratio of each ink fountain key. The opening ratio setting unit 104 sets the opening ratio of each ink fountain key to that in preliminary ink feeding, which is obtained by the opening ratio calculation unit 103. The preliminary ink feed unit 105 performs the ink feed operation of the ink ductor roller while printing is suspended, after the opening ratio of each ink fountain key is set to that in preliminary ink feeding by the opening ratio setting unit 104.

Figure 5H:
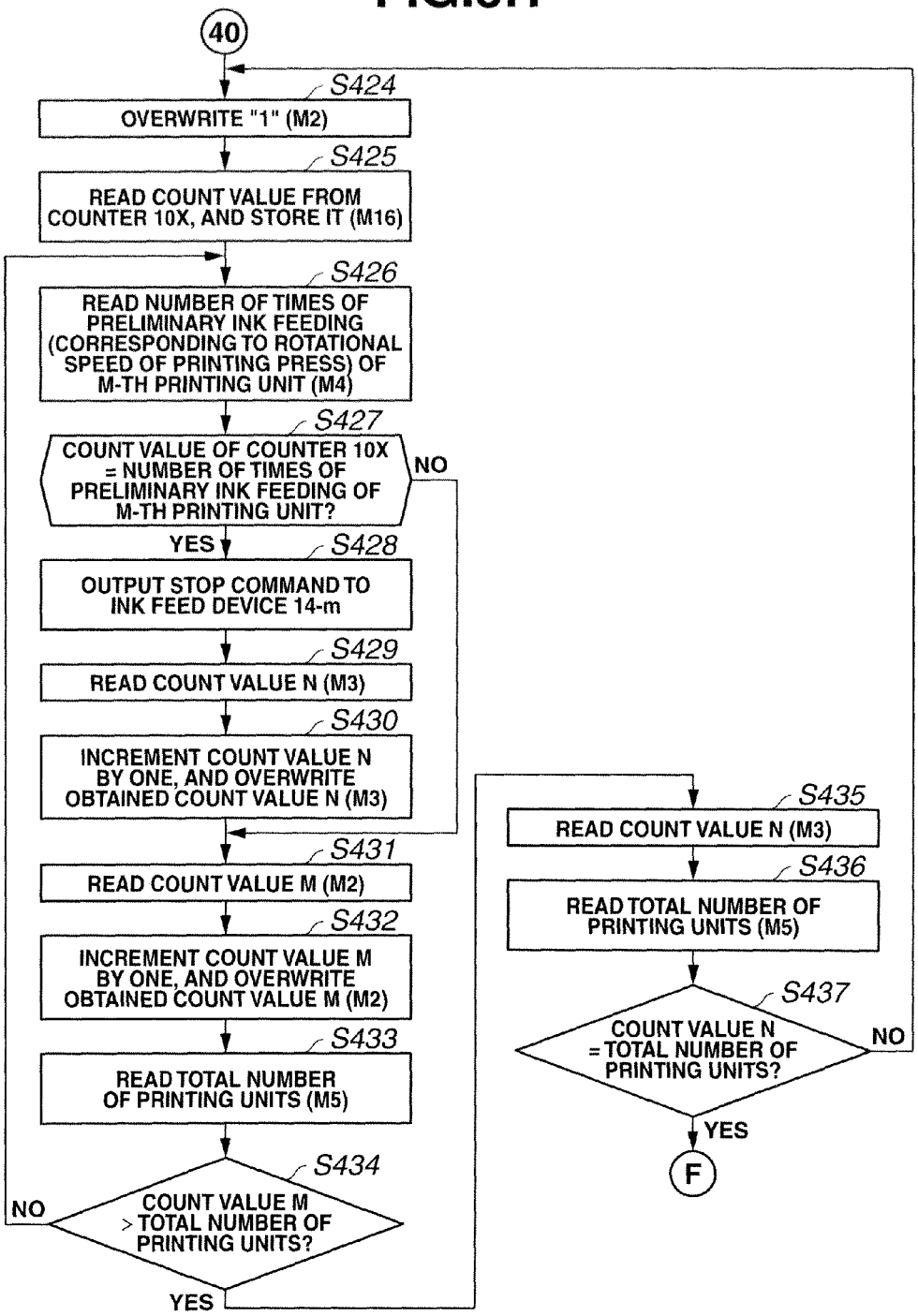
Figure 5I:
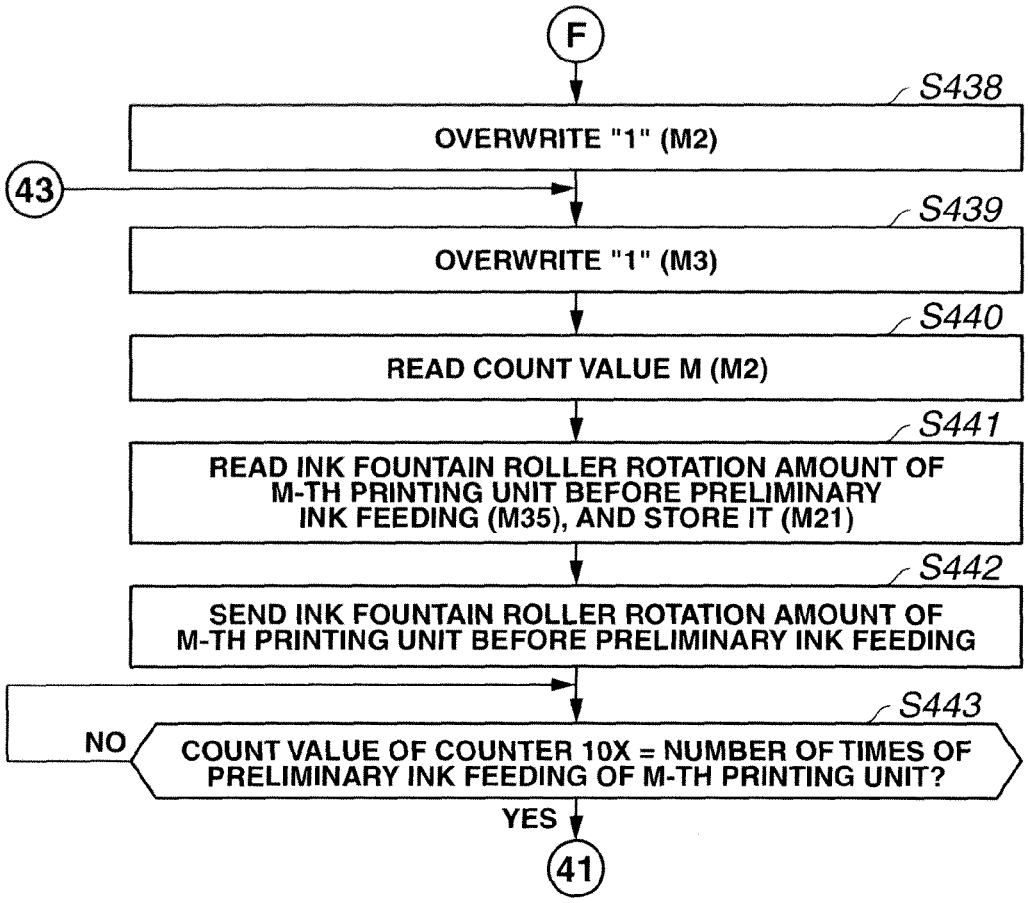
Figure 5J:
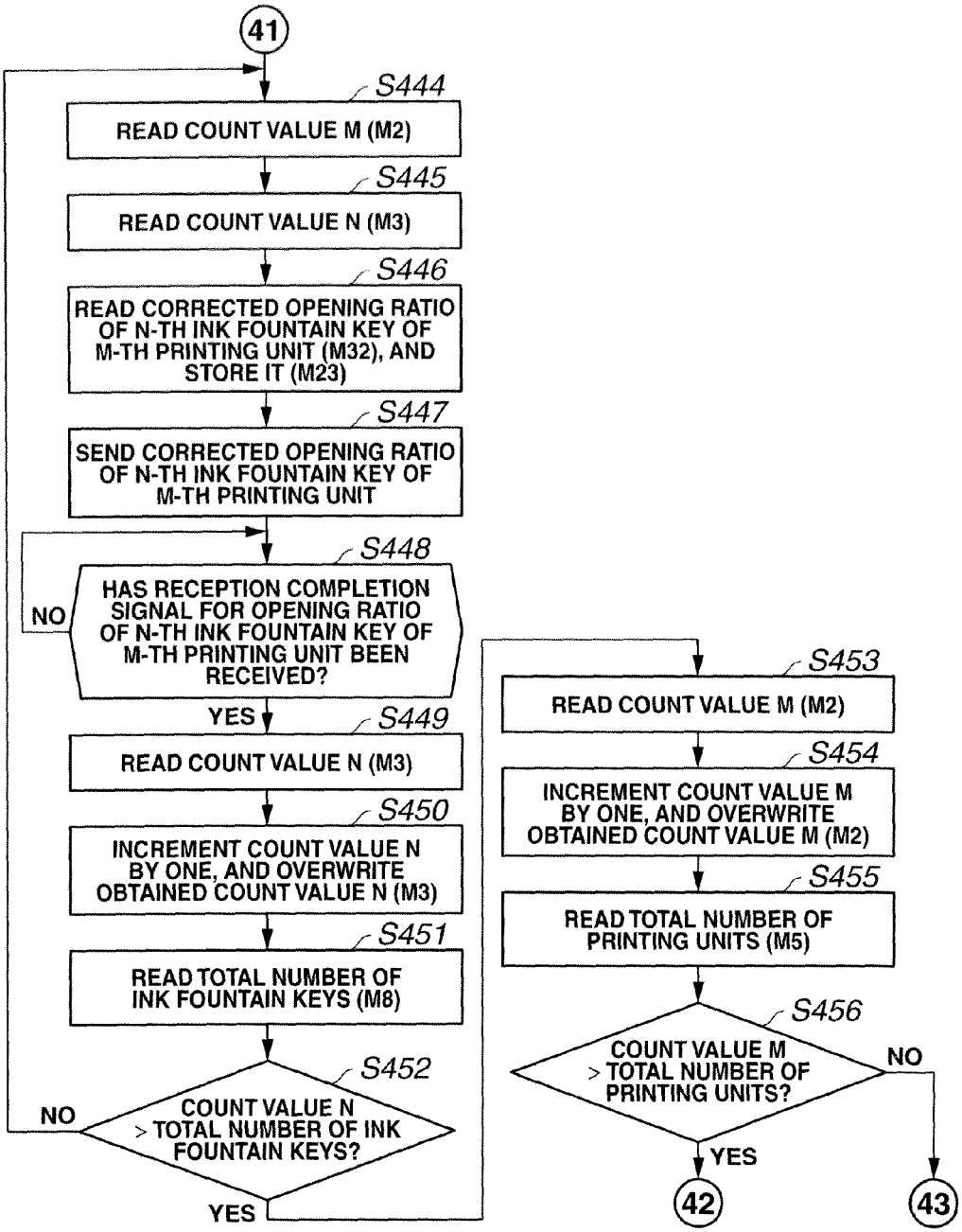
Figure 5K:
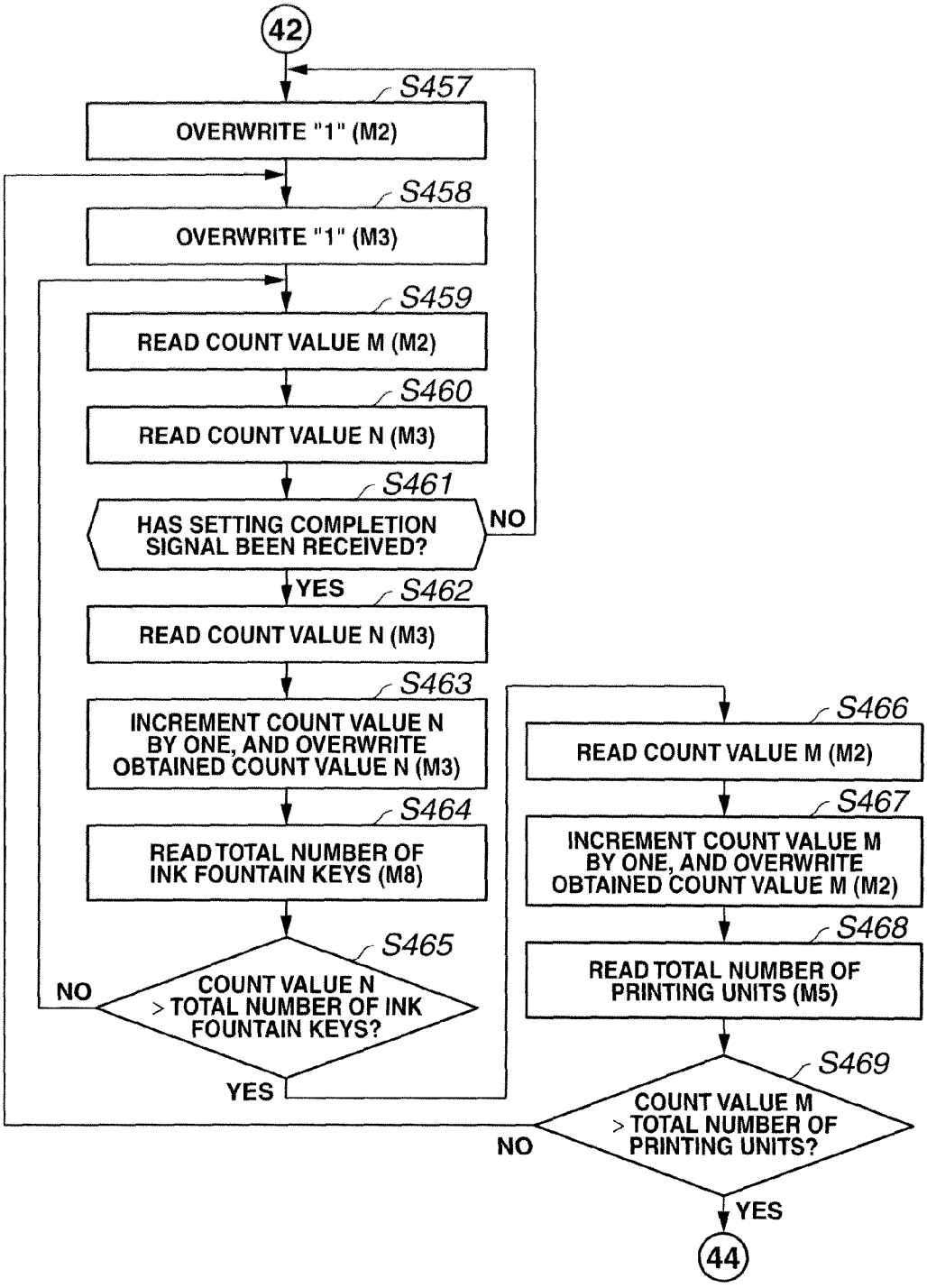
Figure 5L:
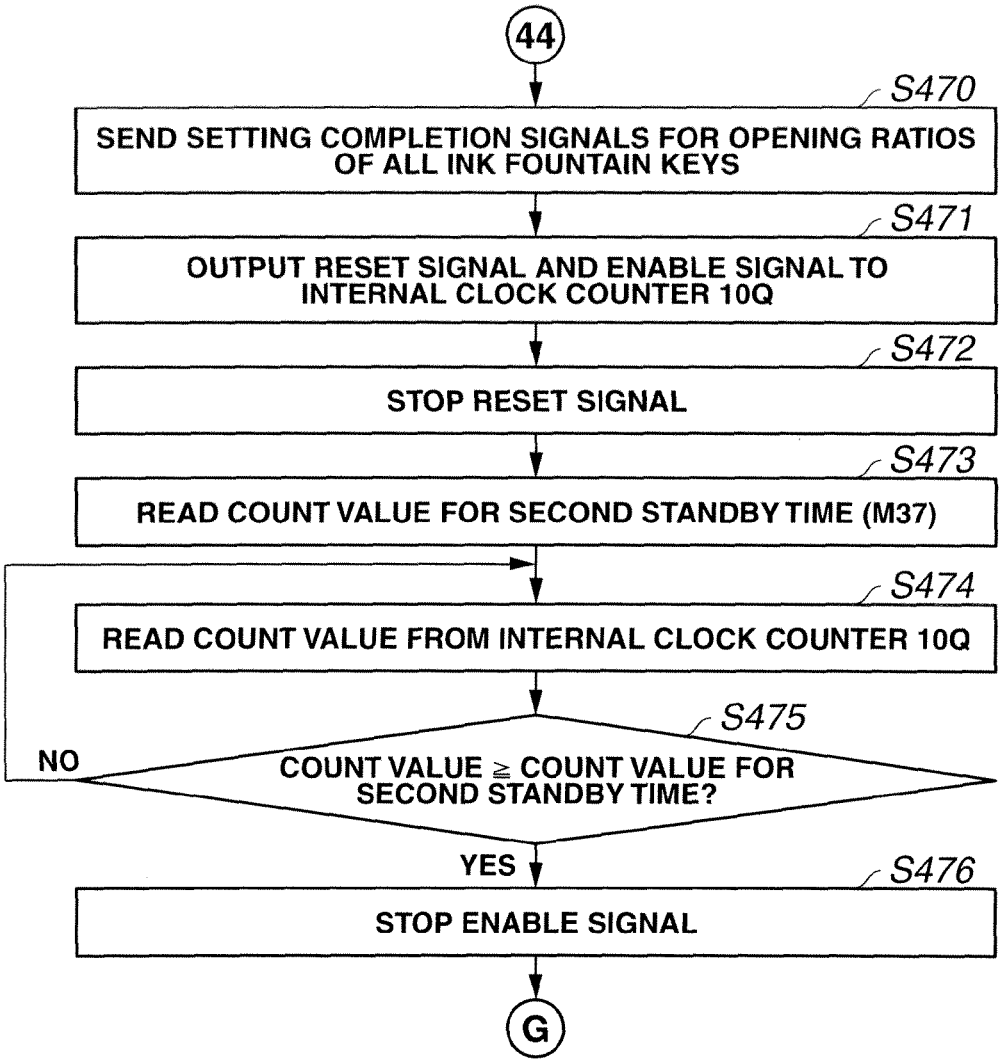
Figure 5M:
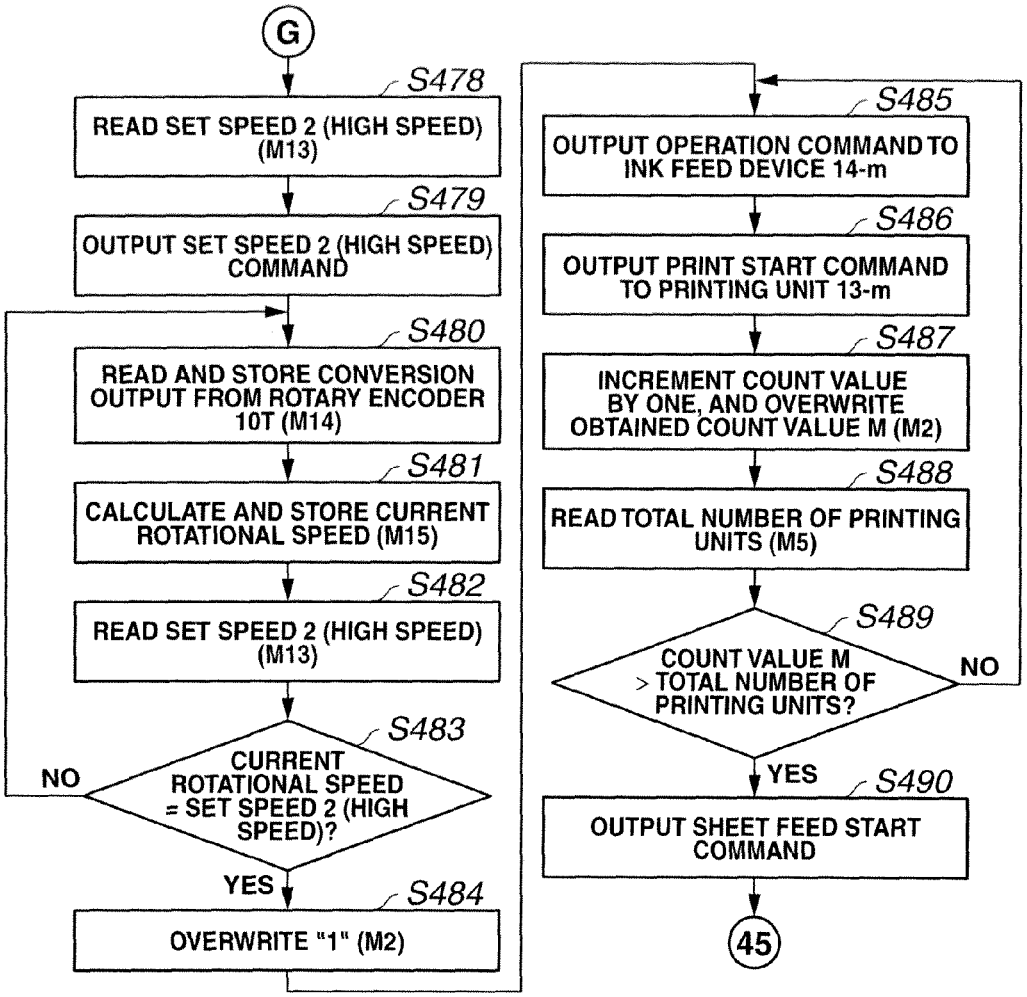
Figure 5N:
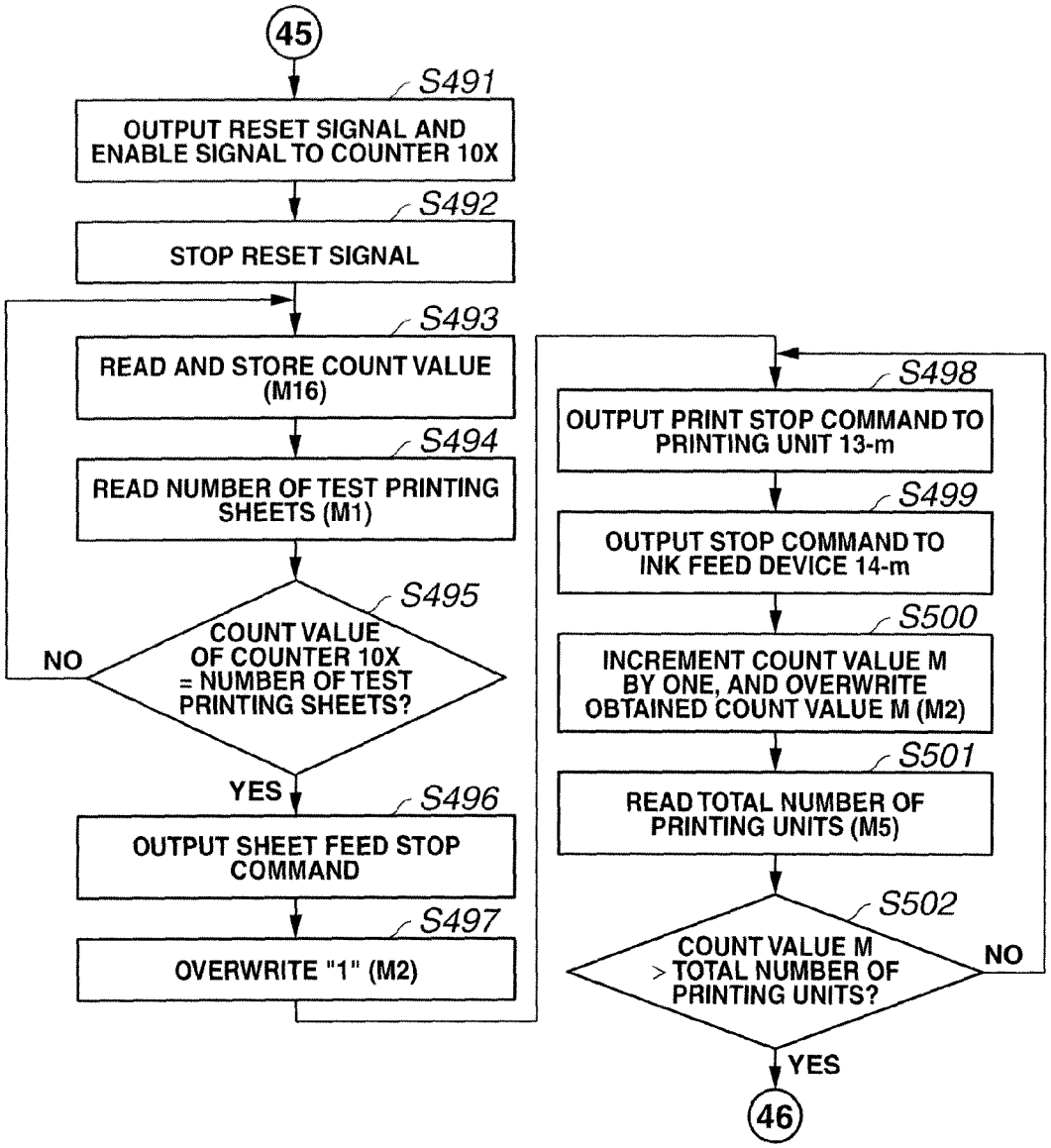
Figure 5O:
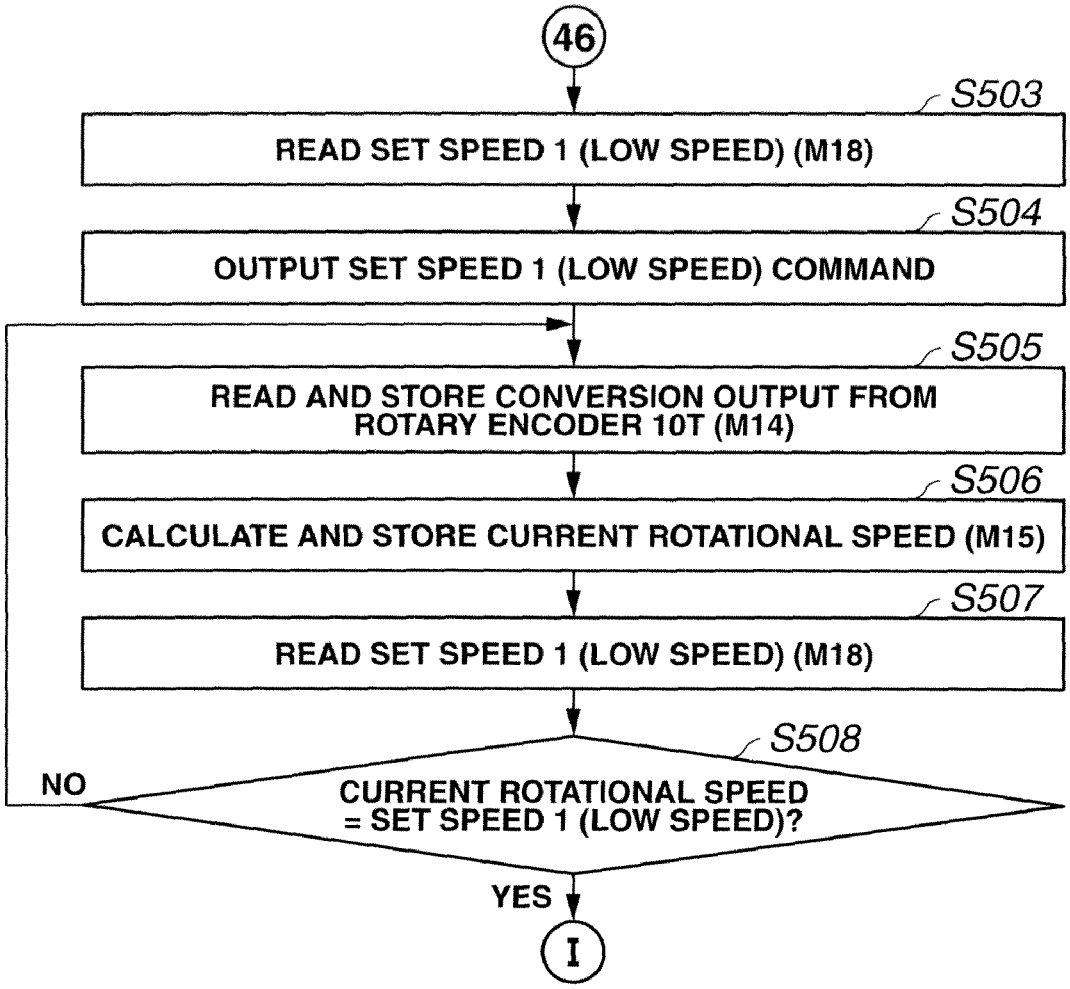
Figure 5P:
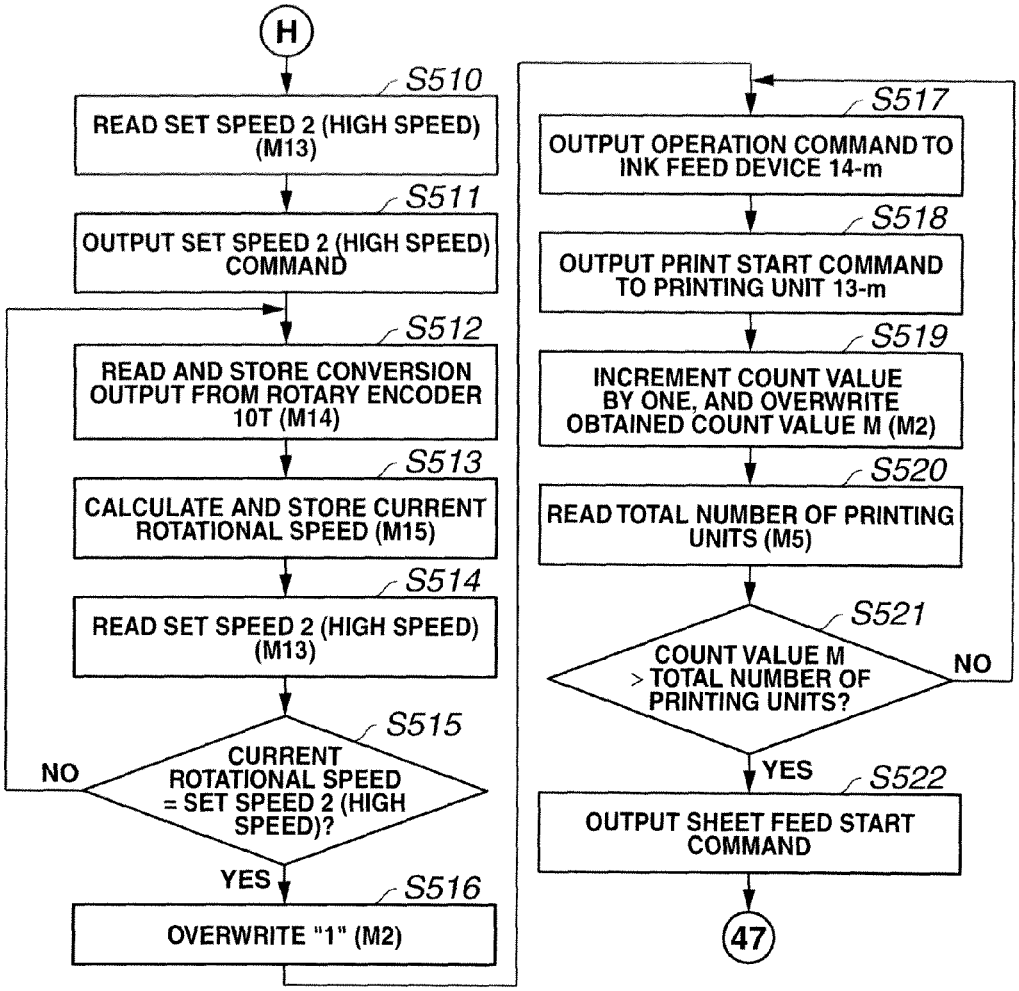
Figure 5Q:
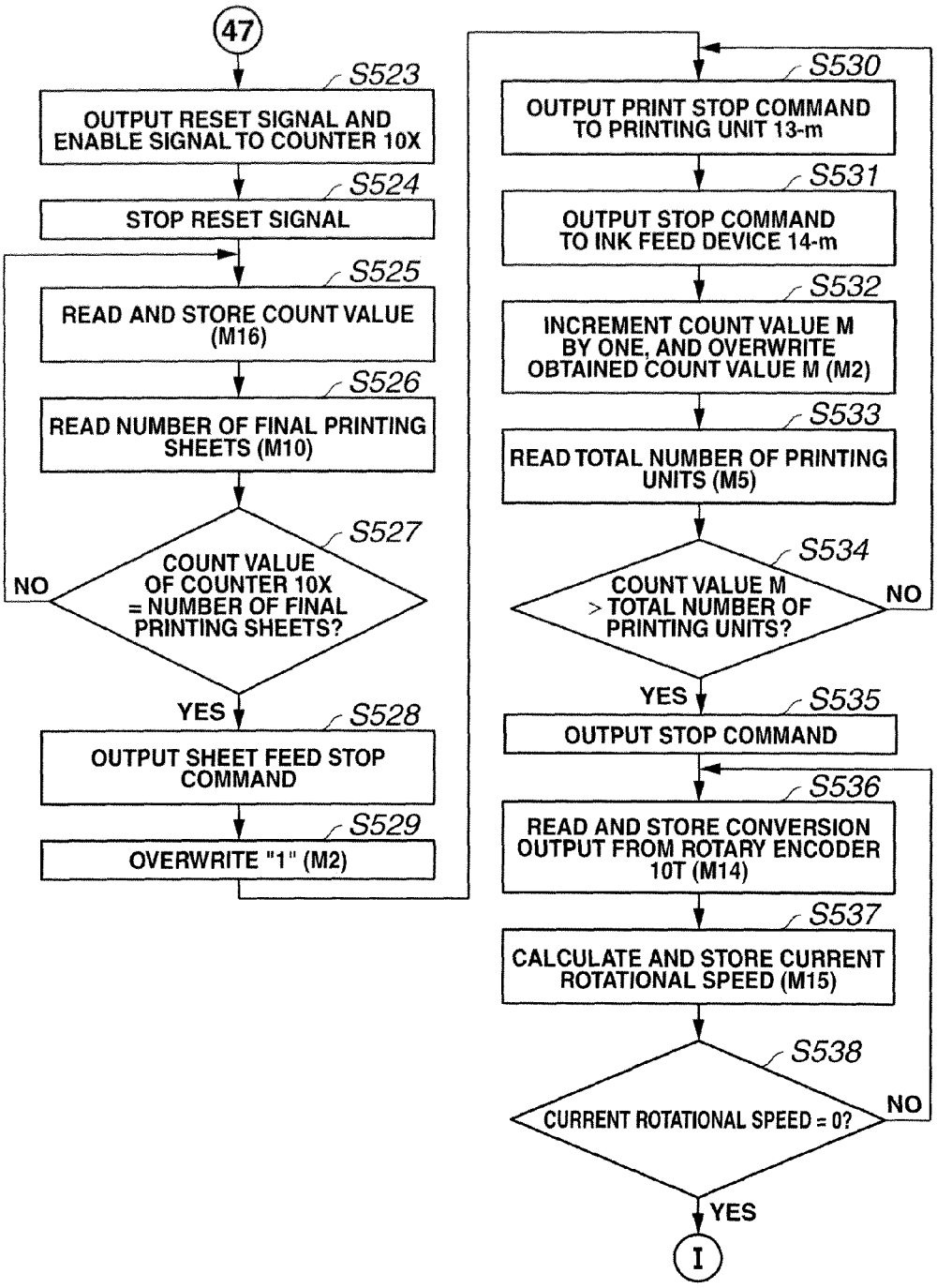

The test printing unit 101 executes processes in steps S279 (FIG. 4S) to S296 (FIG. 4T), the density difference calculation unit 102 executes a process in step S337 (FIG. 4Y), and the opening ratio calculation unit 103 executes a process in step S361 (FIG. 5B). The opening ratio setting unit 104 executes processes in steps S386 (FIG. 5E), S701 (FIG. 9A), and S719 (FIG. 9B), and the preliminary ink feed unit 105 executes processes in steps S416 (FIG. 5G) to S437 (FIG. 5H).

Figure 11:
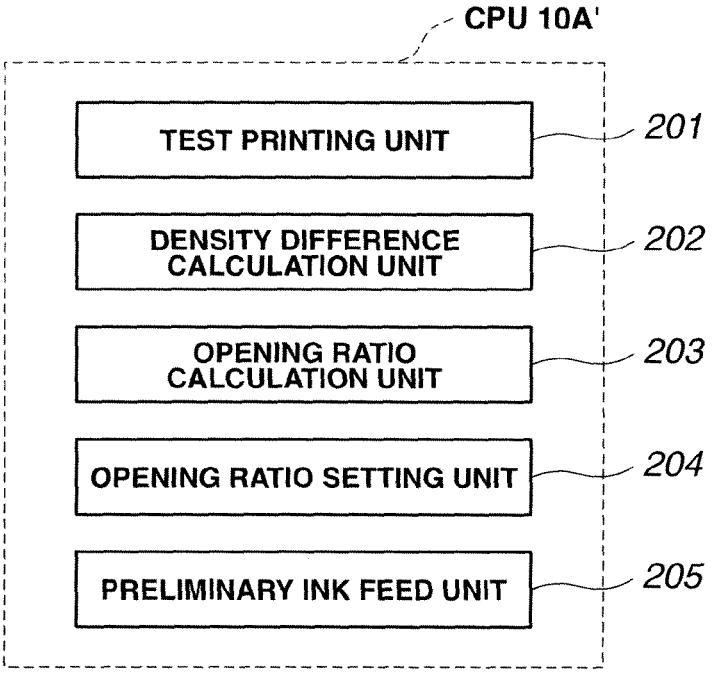
FIG. 11 is a functional block diagram of the CPU according to the second embodiment.

The CPU 10A' according to the second embodiment includes a test printing unit 201, density difference calculation unit 202, opening ratio calculation unit 203, opening ratio setting unit 204, and preliminary ink feed unit 205, as shown in FIG. 11. The test printing unit 201 performs test printing of sample sheets the number of which is preset before preliminary ink feeding. The density difference calculation unit 202 obtains the difference between the measured patch density value in each sample having undergone the test printing by the test printing unit 201, and a preset reference density value. The opening ratio calculation unit 203 obtains, the opening ratio of each ink fountain key in preliminary ink feeding, based on the density difference obtained by the density difference calculation unit 202, and the image area ratio in a range corresponding to each ink fountain key. The opening ratio setting unit 204 sets the opening ratio of each ink fountain key to that in preliminary ink feeding, which is obtained by the opening ratio calculation unit 203. The preliminary ink feed unit 205 performs the ink feed operation of the ink ductor roller while printing is suspended, after the opening ratio of each ink fountain key is set to that in preliminary ink feeding by the opening ratio setting unit 204.

Figure 9A:
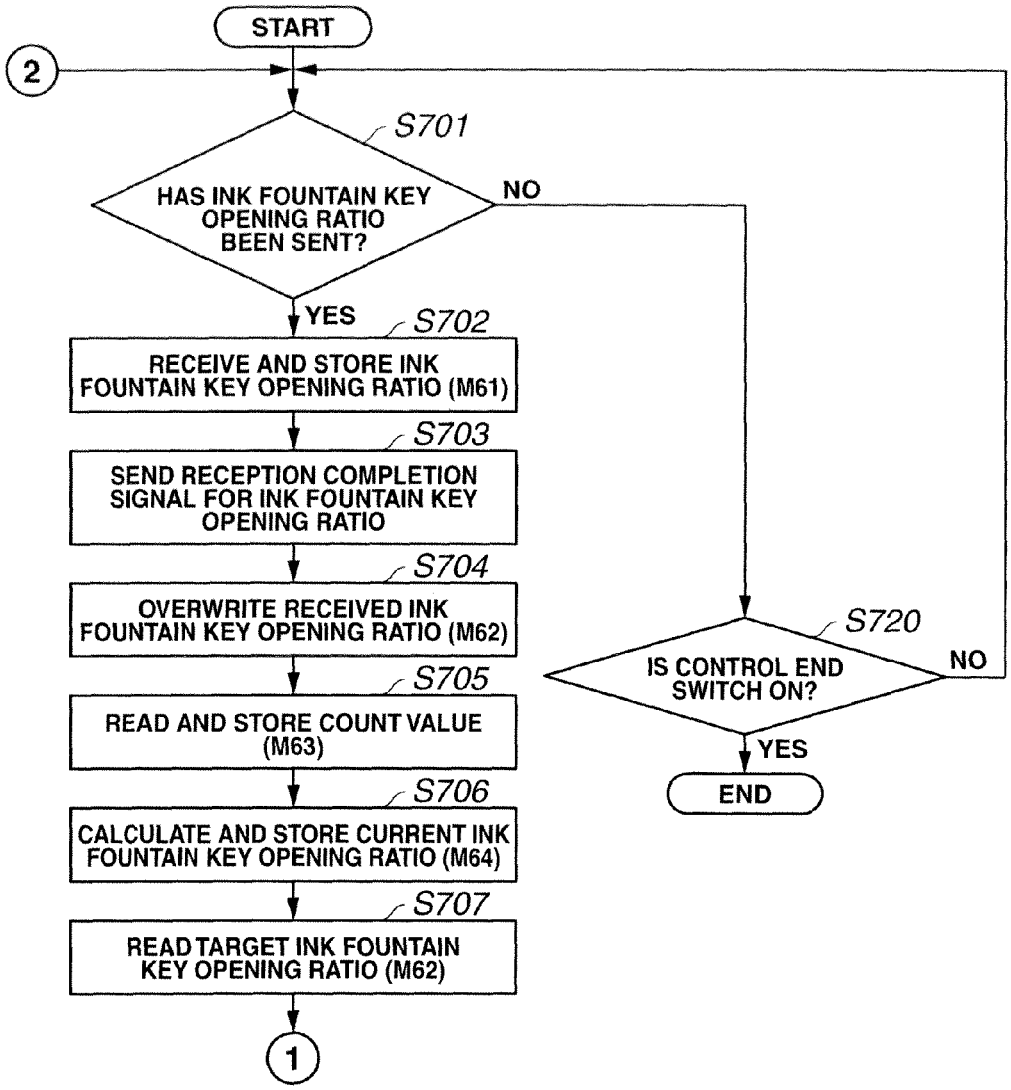
FIGS. 9A to 9D are flowcharts showing the processing operation of a CPU 16A shown in FIG. 8.
Figure 9B:
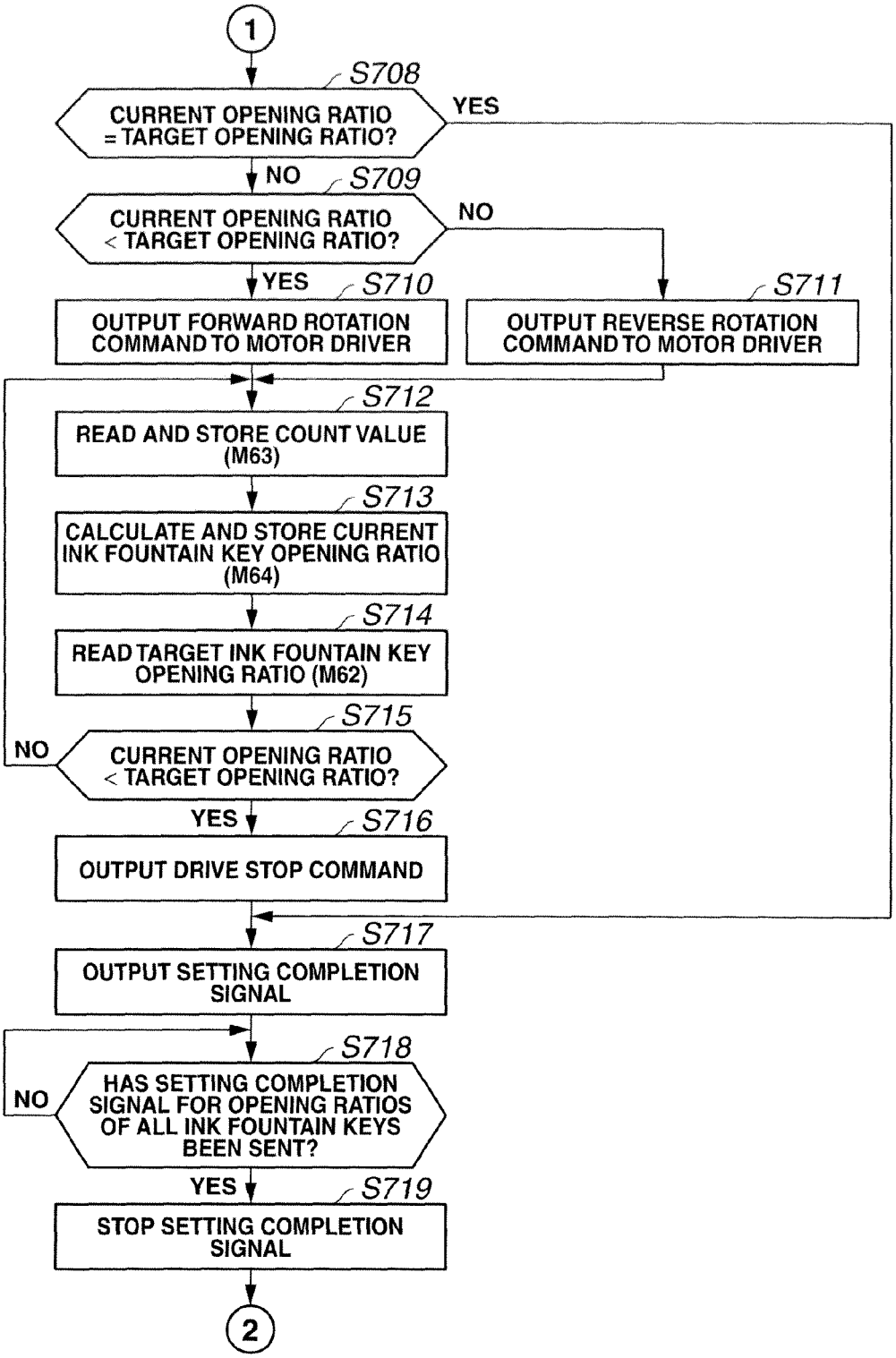
Figure 9C:
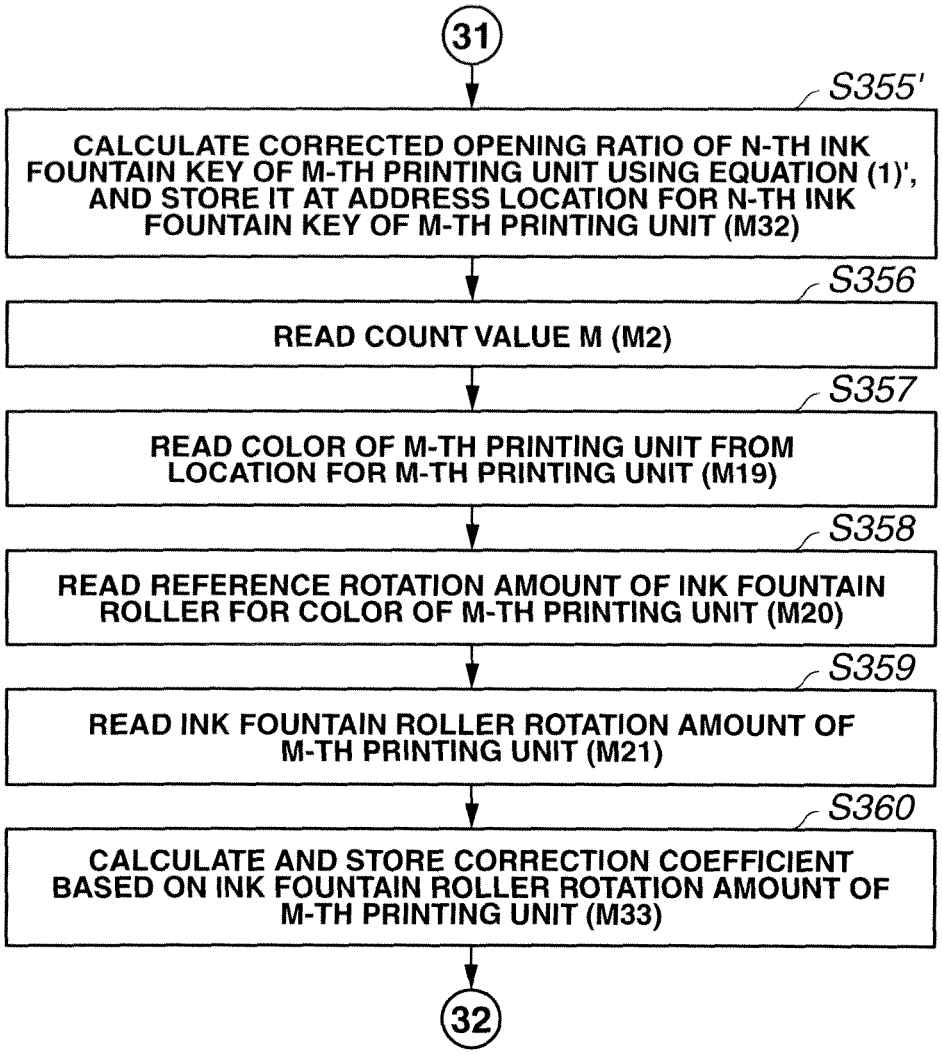
Figure 9D:
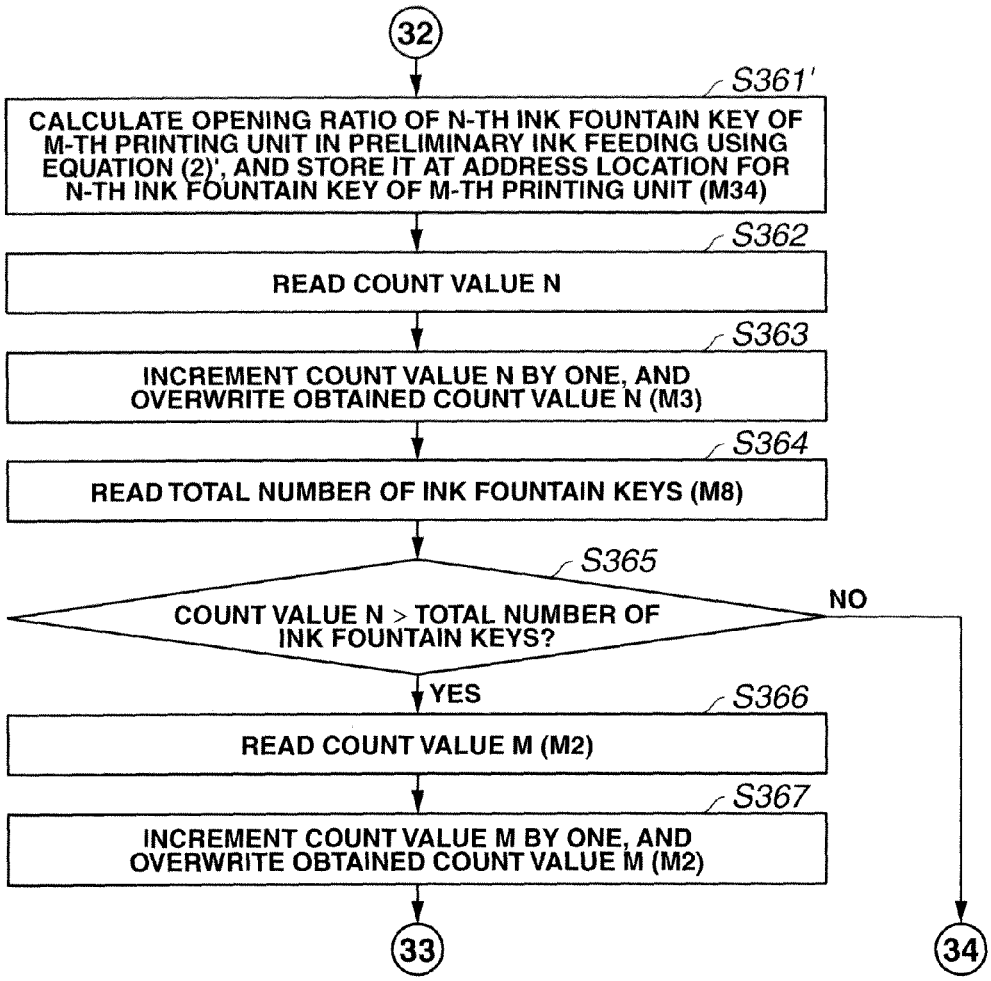

The test printing unit 201 executes processes in steps S279 (FIG. 4S) to S296 (FIG. 4T), the density difference calculation unit 202 executes a process in step S337 (FIG. 4Y), and the opening ratio calculation unit 203 executes a process in step S361' (FIG. 9D). The opening ratio setting unit 204 executes processes in steps S386 (FIG. 5E), S701 (FIG. 9A), and S719 (FIG. 9B), and the preliminary ink feed unit 105 executes processes in steps S416 (FIG. 5G) to S437 (FIG. 5H).

In the first and second embodiments, among the elements of the above-mentioned functional blocks, the test printing units 101 and 201, density difference calculation units 102 and 202, and opening ratio setting units 104 and 204 are not indispensable and can be omitted.

An ink supply amount adjustment method and apparatus for a printing press according to the present invention can be used for various types of printing presses to adjust the amount of ink, to be supplied to a printing plate, by adjusting the ink fountain key opening ratio.

As has been described above, according to the present invention, the opening ratio of each ink fountain key in preliminary ink feeding is obtained based on the difference between the density value (measured density value) of each density measurement patch and a preset reference density value, and the current opening ratio of each ink fountain key. The ink feed operation (preliminary ink feeding) of the ink ductor roller is performed while printing is suspended, after the opening ratio of each ink fountain key is set to the obtained opening ratio of preliminary ink feeding. Hence, the amount of ink to be supplied to a range corresponding to each ink fountain key has an appropriate value irrespective of the image area ratio in this range, so a normal printing product can be printed immediately after preliminary ink feeding.

Even when image data, i.e., the image area ratio or image area in a range corresponding to each ink fountain key is used in place of the current opening ratio of each ink fountain key used to obtain the opening ratio of each ink fountain key in preliminary ink feeding, the amount of ink to be supplied to a range corresponding to each ink fountain key has an appropriate value irrespective of the image area ratio in this range, so a normal printing product can be printed immediately after preliminary ink feeding as well.

By obtaining the opening ratio of each ink fountain key in preliminary ink feeding by taking account of the ink fountain roller rotation amount, the opening ratio of each ink fountain key in preliminary ink feeding becomes more precise, so a normal printing product can be more quickly obtained.

What is claimed is:

1. An ink supply amount adjustment method for a printing press including an ink fountain which stores ink, a plurality of ink fountain keys opening ratios of which are adjustable, an ink fountain roller supplied with the ink from the ink fountain through a gap between the ink fountain roller and the ink fountain keys, and an ink ductor roller which further supplies the ink, supplied to the ink fountain roller, to a printing plate by an ink feed operation, comprising the steps of:

measuring a density value of each density measurement patch printed in a range corresponding to each of the ink fountain keys on a printed printing sheet;

obtaining an opening ratio of each of the ink fountain keys in preliminary ink feeding, based on a difference between a measured density value of a patch and a preset reference density value, and one of a current opening ratio of each of the ink fountain keys and image data in the range corresponding to each of the ink fountain keys; and performing an ink feed operation of the ink ductor roller while printing is suspended, after setting the opening ratio of each of the ink fountain keys to the obtained opening ratio in preliminary ink feeding.

2. A method according to claim 1, wherein the step of obtaining the opening ratio comprises the step of obtaining the opening ratio of each of the ink fountain keys in preliminary ink feeding, by taking account of a rotation amount of the ink fountain roller.

3. A method according to claim 1, wherein the step of obtaining the opening ratio comprises the step of obtaining an opening ratio θij" (i=1 to m, j=1 to n) of each ink fountain key of each printing unit in preliminary ink feeding, using:

$$\theta ij''=\alpha i\times\Delta Dij\times\theta ij\times\beta i$$

where βi (i=1 to m) is a correction coefficient based on a rotation amount of an ink fountain roller of each printing unit, αi (i=1 to m) is a correction coefficient of an opening ratio of an ink fountain key for a color of each printing unit, ΔDij (i=1 to m, j=1 to n) is a measured density difference of each patch for the color of each printing unit on a test printing sample, and θij (i=1 to m, j=1 to n) is a current opening ratio of each ink fountain key of each printing unit.

4. A method according to claim 1, wherein the step of obtaining the opening ratio comprises the step of obtaining an opening ratio θij" (i=1 to m, j=1 to n) of each ink fountain key of each printing unit in preliminary ink feeding, using:

$$\theta ij''=\alpha i\times\Delta Dij\times Sij\times\beta i$$

where βi (i=1 to m) is a correction coefficient based on a rotation amount of an ink fountain roller of each printing unit, αi (i=1 to m) is a correction coefficient of an opening ratio of an ink fountain key for a color of each printing unit, ΔDij (i=1 to m, j=1 to n) is a measured density difference of each patch for the color of each printing unit on a test printing sample, and Sij (i=1 to m, j=1 to n) is an image area ratio in a range corresponding to each ink fountain key of each printing unit.

5. A method according to claim 1, wherein the step of obtaining the opening ratio comprises the step of obtaining the opening ratio of each of the ink fountain keys in preliminary ink feeding, using an image area ratio in the range corresponding to each of the ink fountain keys as the image data in the range corresponding to each of the ink fountain keys.

6. A method according to claim 1, wherein the step of obtaining the opening ratio comprises the step of obtaining the opening ratio of each of the ink fountain keys in preliminary ink feeding, using an image area in the range corresponding to each of the ink fountain keys as the image data in the range corresponding to each of the ink fountain keys.

7. An ink supply amount adjustment apparatus for a printing press including an ink fountain which stores ink, a plurality of ink fountain keys opening ratios of which are adjustable, an ink fountain roller supplied with the ink from the ink fountain through a gap between the ink fountain roller and the ink fountain keys, and an ink ductor roller which further supplies the ink, supplied to the ink fountain roller, to a printing plate by an ink feed operation, characterized by comprising:

a density value measurement unit which measures a density value of each density measurement patch printed in a range corresponding to each of the ink fountain keys on a printed printing sheet;

a calculation unit which obtains an opening ratio of each of the ink fountain keys in preliminary ink feeding, based on a difference between a measured density value of a patch and a preset reference density value, and one of a current opening ratio of each of the ink fountain keys and image data in a range corresponding to each of the ink fountain keys; and a preliminary ink feed unit which performs an ink feed operation of the ink ductor roller while printing is suspended, after the opening ratio of each of the ink fountain keys is set to the obtained opening ratio in preliminary ink feeding.

8. An apparatus according to claim 7, wherein said calculation unit obtains the opening ratio of each of the ink fountain keys in preliminary ink feeding, by taking account of a rotation amount of the ink fountain roller.

9. An apparatus according to claim 7, wherein said calculation unit obtains an opening ratio θij" (i=1 to m, j=1 to n) of each ink fountain key of each printing unit in preliminary ink feeding, using:

$$\theta ij''=\alpha i\times\Delta Dij\times\theta ij\times\beta i$$

where βi (i=1 to m) is a correction coefficient based on a rotation amount of an ink fountain roller of each printing unit, αi (i=1 to m) is a correction coefficient of an opening ratio of an ink fountain key for a color of each printing unit, ΔDij (i=1 to m, j=1 to n) is a measured density difference of each patch for the color of each printing unit on a test printing sample, and θij (i=1 to m, j=1 to n) is a current opening ratio of each ink fountain key of each printing unit.

10. An apparatus according to claim 7, wherein said calculation unit obtains an opening ratio θij" (i=1 to m, j=1 to n) of each ink fountain key of each printing unit in preliminary ink feeding, using:

$$\theta ij''=\alpha i\times\Delta Dij\times Sij\times\beta i$$

where βi (i=1 to m) is a correction coefficient based on a rotation amount of an ink fountain roller of each printing unit, αi (i=1 to m) is a correction coefficient of an opening ratio of an ink fountain key for a color of each printing unit, ΔDij (i=1 to m, j=1 to n) is a measured density difference of each patch for the color of each printing unit on a test printing sample, and Sij (i=1 to m, j=1 to n) is an image area ratio in a range corresponding to each ink fountain key of each printing unit.

11. An apparatus according to claim 7, wherein the image data is an image area ratio.

12. An apparatus according to claim 7, wherein the image data is an image area.

* * * * *